US012714185B2

(12) United States Patent
Constantinou et al.

(10) Patent No.: US 12,714,185 B2
(45) Date of Patent: Aug. 25, 2026

(54) OUTSOLES FOR ARTICLES OF FOOTWEAR

(71) Applicant: NIKE, Inc., Beaverton, OR (US)

(72) Inventors: Jay Constantinou, Beaverton, OR (US); Sami M. Fakhouri, Portland, OR (US); Laura C. Marshala, Portland, OR (US); Thea Moshofsky, Beaverton, OR (US); Jill D. Murfin, Portland, OR (US); David A. Stasiuk, Portland, OR (US); Randall S. Wolfe, Beaverton, OR (US); Tianhan Zhang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 217 days.

(21) Appl. No.: 17/936,590

(22) Filed: Sep. 29, 2022

(65) Prior Publication Data

US 2023/0097038 A1 Mar. 30, 2023

Related U.S. Application Data

(60) Provisional application No. 63/250,928, filed on Sep. 30, 2021.

(51) Int. Cl.
*A43B 13/12* (2006.01)

(52) U.S. Cl.
CPC ..... *A43B 13/125* (2013.01)

(58) Field of Classification Search
CPC ..... A43B 13/12; A43B 13/223; A43B 13/26; A43B 13/122
See application file for complete search history.

(56) References Cited

U.S. PATENT DOCUMENTS

| | | | | |
|---|---|---|---|---|
| 5,389,176 | A * | 2/1995 | Nakanishi | A43B 13/22 427/259 |
| D914,341 | S | 3/2021 | Gaboriault et al. | |
| 2011/0061149 | A1* | 3/2011 | Polacco | A43B 13/223 2/241 |
| 2014/0202042 | A1 | 7/2014 | Berend et al. | |
| 2015/0040428 | A1* | 2/2015 | Davis | A43B 13/12 12/146 B |

(Continued)

FOREIGN PATENT DOCUMENTS

| | | |
|---|---|---|
| CN | 111011983 A | 4/2020 |
| CN | 112869302 A | 6/2021 |

(Continued)

OTHER PUBLICATIONS

International Search Report and Written Opinion, mailed Jan. 13, 2023, issued for International Patent Application No. PCT/US2022/045202, 12 pages.

*Primary Examiner* — Grady Alexander Nunnery
(74) *Attorney, Agent, or Firm* — Klarquist Sparkman, LLP

(57) ABSTRACT

A sole structure for an article of footwear can include a midsole and an outsole. The outsole can include one or more layers, and the one or more layers can be printed material deposited directly onto the midsole. In some instances, the outsole can include a base layer and an outermost layer. The base layer can include a first printed material deposited directly onto the midsole and includes a first width. The outermost layer can include a second printed material deposited onto the base layer and includes a second width, and the second width can less than or greater than the first width.

13 Claims, 37 Drawing Sheets

(56) References Cited

U.S. PATENT DOCUMENTS

| | | | | |
|---|---|---|---|---|
| 2015/0047222 | A1* | 2/2015 | Rushbrook | A43B 13/141 36/83 |
| 2015/0320138 | A1 | 11/2015 | McDowell et al. | |
| 2015/0336298 | A1 | 11/2015 | Dean | |
| 2016/0157553 | A1 | 6/2016 | Cross | |
| 2016/0157558 | A1 | 6/2016 | Cross | |
| 2016/0374428 | A1 | 12/2016 | Kormann et al. | |
| 2017/0135439 | A1* | 5/2017 | Davis | A43B 13/181 |
| 2018/0186112 | A1 | 7/2018 | Jones et al. | |
| 2018/0339478 | A1* | 11/2018 | Lee | B33Y 40/10 |
| 2019/0091895 | A1 | 3/2019 | Knappworst et al. | |
| 2019/0168495 | A1 | 6/2019 | Millero, Jr. et al. | |
| 2019/0232591 | A1 | 8/2019 | Sterman et al. | |
| 2019/0283394 | A1 | 9/2019 | Ashcroft et al. | |
| 2019/0313733 | A1 | 10/2019 | Bartel et al. | |
| 2020/0017711 | A1 | 1/2020 | Kabagambe et al. | |
| 2020/0113276 | A1* | 4/2020 | Boudreau | A43B 13/127 |
| 2020/0146397 | A1 | 5/2020 | Coupe et al. | |
| 2020/0154822 | A1 | 5/2020 | Kita et al. | |
| 2020/0205512 | A1 | 7/2020 | Blanche et al. | |
| 2020/0245720 | A1 | 8/2020 | Jarvis | |
| 2020/0375311 | A1 | 12/2020 | Bartel et al. | |
| 2020/0384679 | A1 | 12/2020 | Jones et al. | |
| 2021/0000215 | A1 | 1/2021 | Wawrousek et al. | |
| 2021/0037908 | A1 | 2/2021 | Busbee | |
| 2021/0039339 | A1 | 2/2021 | Busbee | |
| 2021/0079188 | A1 | 3/2021 | Baghdadi et al. | |
| 2021/0177093 | A1 | 6/2021 | Perrault et al. | |

FOREIGN PATENT DOCUMENTS

| | | | |
|---|---|---|---|
| EP | 1 903 900 | B1 | 4/2008 |
| EP | 3 170 418 | A1 | 5/2017 |
| EP | 3 494 822 | A1 | 6/2019 |
| EP | 3 636 095 | A1 | 4/2020 |
| TW | I703939 | B | 9/2020 |
| WO | 2017/182930 | A2 | 10/2017 |
| WO | WO 2018/019315 | A1 | 2/2018 |
| WO | WO 2021/037638 | A1 | 3/2021 |

* cited by examiner

OUTSOLES FOR ARTICLES OF FOOTWEAR

CROSS REFERENCE TO RELATED APPLICATION

This application claims the benefit of U.S. Provisional Application No. 63/250,928, filed Sep. 30, 2021, which is incorporated by reference herein in its entirety.

FIELD

The present disclosure is directed to articles of footwear, and more particularly to outsoles for articles of footwear.

BACKGROUND

An article of footwear (also referred to herein as "article") typically includes two main components: a sole structure and an upper. The sole structure is configured for supporting the wearer's foot and providing cushioning between the wearer's foot and the ground. The sole structure can comprise a midsole and an outsole. The outsole forms the primary ground contacting surface, and the midsole is disposed between the outsole and the wearer's foot. The upper is coupled to the sole structure and is configured for securing the wearer's foot to the sole structure. An article of footwear can also comprise one or more other components, including insoles and securing mechanisms (e.g., laces, straps, etc.).

DETAILED DESCRIPTION

General Considerations

Figure 1:
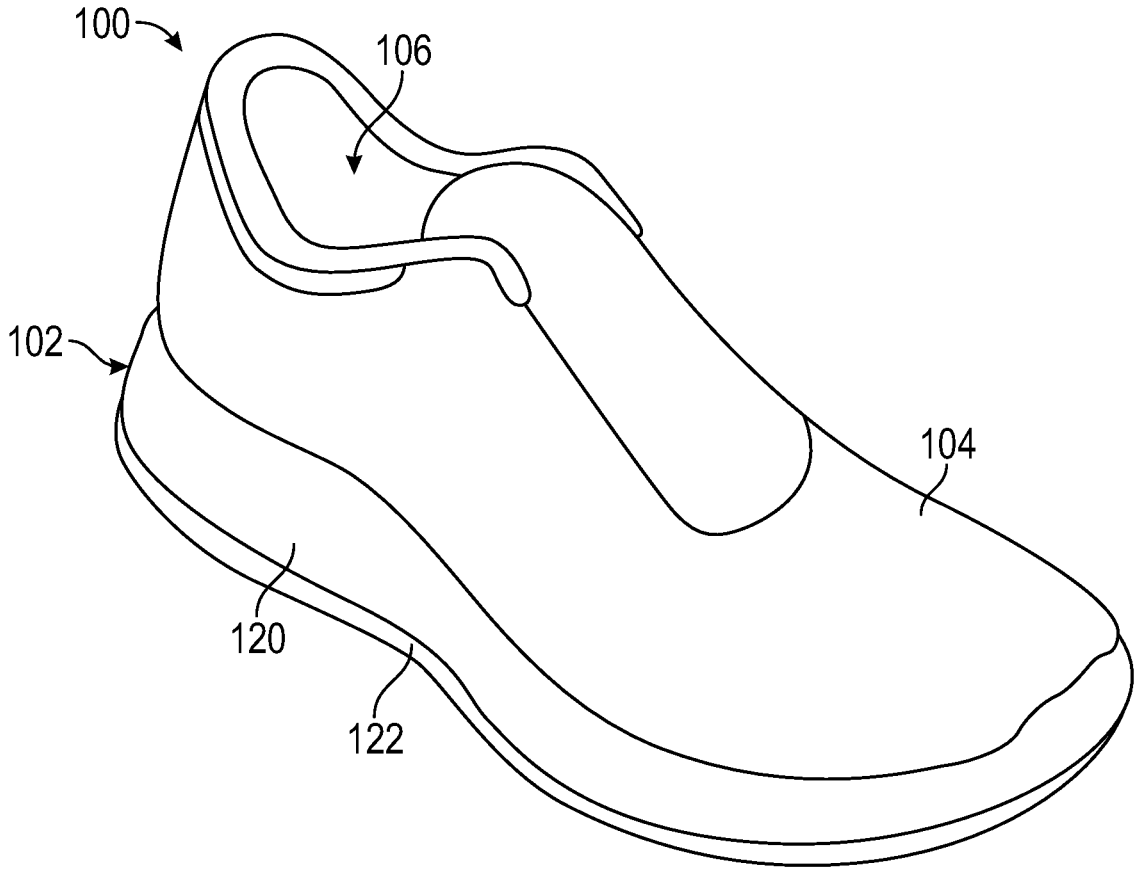
FIG. 1 depicts a perspective view of an article of footwear, according to one example.

The systems and methods described herein, and individual components thereof, should not be construed as being limited to the particular uses or systems described herein in any way. Instead, this disclosure is directed toward all novel and non-obvious features and aspects of the various disclosed examples, alone and in various combinations and subcombinations with one another. For example, any features or aspects of the disclosed examples can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting examples, instances, and/or illustrations.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not depict the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary in one or more particular implementations and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe (e.g., posterior/anterior). Similarly, a "longitudinal length" refers to a length of the article along the longitudinal axis, and a "longitudinal direction" refers to a direction along or parallel to the longitudinal axis. "Lateral axis" refers to a centerline of the article from the medial side to the lateral side. Similarly, a "lateral length" refers to a length of the article along the lateral axis, and a "lateral direction" refers to a direction along or parallel to the lateral axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole, and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary. The terms "directly attached" and "directly coupled" generally mean physically connected or linked without intermediate elements between the attached/coupled items, unless specifically stated to the contrary. For example, an outsole that is directly coupled to a midsole is physically linked without any adhesive (e.g., rubber cement) and/or fasteners (e.g., stitching, nails, etc.) therebetween. The absence of adhesive and/or fasteners does not mean that there cannot be any substance between an outsole and a midsole that are directly coupled together. For example, there may be one or more cleansing and/or priming agents applied to the midsole prior to directly coupling the outsole to the midsole, and the cleansing and/or priming agents (and/or residual material of the cleansing and/or priming agent) may be disposed between a directly coupled outsole and midsole.

As used herein, the terms "fixedly attached" and "fixedly coupled" refer to two components joined in a manner such that the components may not be readily separated from one another without destroying and/or damaging one or both components. Exemplary modalities of fixed attachment may include joining with permanent adhesive, stitches, welding or other thermal bonding, and/or other joining techniques. For example, an upper can be fixedly attached to a sole structure with permanent adhesive and/or stitching. In addition, two components may be "fixedly attached" or "fixedly coupled" by virtue of being integrally formed, for example, in a molding or printing process. In contrast, the terms "removably attached" or "removably coupled" refer to two components joined in a manner such that the components can be readily separated from one another to return to their separate, discrete forms without destroying and/or damaging either component. For example, a lace member can be removably attached to an upper. Exemplary modalities of temporary attachment may include mating-type connections, releasable fasteners, removable stitches, and/or other temporary joining techniques.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, sandals, etc. In some examples, the term "article of footwear" can be used to refer to one or more components of an article of footwear such as a sole structure without an upper attached thereto, or vice versa.

As used herein the term "printing" means directly depositing material from a printing device onto a substrate or a layer of previously printed material. In one or more aspects of the invention, printing includes extruding material from a printing device onto a substrate or a layer of previously printed material. In alternative aspects of the invention, printing includes ejecting (e.g., spraying) droplets of a material from a printing device. In yet other alternative aspects of the invention, printing includes depositing a powdered or granulated material and consolidating the powdered or granulated material by thermal activation or by deposition of a binding agent in contact with the powdered or granulated material. Printing according to the inventive aspects of this disclosure excludes injecting material into a cavity of a mold temporarily disposed adjacent to a surface of the substrate wherein a shape, a location, or a thickness of the injected material upon the substrate is constrained by the mold according to conventional injection molding techniques.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of (or substantially similar to) the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

Introduction to the Disclosed Technology

An article of footwear (also referred to herein as "article") typically includes two main components: a sole structure and an upper. The sole structure is configured for supporting the wearer's foot and providing cushioning between the wearer's foot and the ground. The sole structure can comprise a midsole and an outsole. The outsole forms the primary ground contacting surface, and the midsole is disposed between the outsole and the wearer's foot and provides cushioning and support. The upper is coupled to the sole structure and is configured for securing the wearer's foot to the sole structure. An article of footwear can also comprise one or more other components, including insoles and securing mechanisms (e.g., laces, straps, etc.).

The sole structures of typical articles of footwear include a plurality of molded components that are coupled together. For example, a midsole can be formed from a first material in a first molding process, and an outsole can be formed from a second material in a second molding process. Conventional outsoles can be formed by initially extruding, laminating, calendaring, or otherwise forming a sheet of material and then cutting the outsole from the sheet of material. This cutting process produces scrap material that is either discarded or recycled. Conventional outsoles can also be formed by molding uncured rubber and vulcanizing it in an energy-intensive vulcanization process, in which the vulcanized scrap and defective components cannot easily be recycled due to their thermoset properties. The midsole and outsole are then coupled together with a coupling means (e.g., via adhesive, fasteners, etc.), typically using a labor-intensive stock fitting process.

Molding processes have limitations in the shapes they can produce. Cutting components from sheet material also limits the shapes and designs which can be produced. These limitations reduce the options available when designing an outsole for an article of footwear.

Accordingly, there is a need to reduce waste, raw material and energy consumption, and/or design constraints for outsoles of articles of footwear, and/or to allow use of automated production methods.

Disclosed herein are various ways of printing an outsole directly onto a midsole and/or an upper of an article of footwear. The disclosed outsoles can be printed in various ways (e.g., 3-D printed, screen printed, etc.). In specific examples, the disclosed outsoles can be extruded or sprayed onto a substrate (e.g., a midsole and/or upper). The printed outsoles reduce waste and raw material consumption by reducing the amount of scrap material and/or by eliminating the need for coupling means (e.g., adhesive, fasteners, etc.) between the outsole and the midsole. The printed outsoles disclosed herein directly printed (e.g., directly extruded or sprayed) without the use of a mold and, thus, do not produce molded external surfaces and are free from the constraints of molding processes. Thus, the printed outsoles can, in some instances, comprise designs and/or structural elements that may not be feasible for a molded outsole and are not feasible when made using manual processes.

In some examples, the disclosed outsoles can be directly printed onto a midsole comprising a foam material. In other examples, the disclosed outsole can be directly printed onto midsoles comprising solid (unfoamed) material, including natural materials (e.g., leather, natural rubber, metal, etc.) and/or synthetic materials (e.g., synthetic polymers including synthetic rubbers, composites, metal alloys, etc.).

The printed outsoles can comprise one or more layers formed via one or more passes of the printhead. For example, in some instances, a printed outsole comprises a base layer printed directly onto the midsole of the article of footwear and an outermost layer printed onto the base layer (or an intermediate layer disposed between the base layer and the outermost layer). The base layer can, for example, be configured to bond with the midsole. The outermost layer can, for example, be configured to be the primary ground contacting surface of the outsole. In some instances, one or more other layers besides the outermost layer (e.g., a base layer) and/or the midsole can also contact the ground surface.

In some examples, the disclosed outsoles can be printed onto a bottom surface of a midsole (e.g., a ground-facing surface). Additionally, or alternatively, the outsoles disclosed herein can be printed onto one or more other surfaces of the midsole besides the ground-facing surface. For example, the outsoles can be printed on the side surfaces of the midsole (e.g., surfaces that are generally perpendicular to the bottom surface). In some examples, the outsole can be printed from a bottom surface to a side surface (and/or vice versa). This can be done in a continuous or non-continuous print pass. In some examples, the printed outsole can be disposed on one or more substrate materials (e.g., a first midsole material, a second midsole material, etc.). For instances, the printed material of the printed outsole can be printed on a first midsole material for a first portion of a print pass and on a second midsole material for a second portion of a print pass.

Disclosed herein are articles of footwear that can, for example, include a sole structure with a midsole and an outsole. The outsole can include one or more layers, and the one or more layers can be printed material deposited directly onto the midsole.

In some examples, the outsole can include a base layer and an outermost layer. The base layer can include a first printed material deposited directly onto the midsole and includes a first width. The outermost layer can include a second printed material deposited onto the base layer and includes a second width, and the second width can be less than the first width.

In other examples, the second width can be greater than the first width.

In some examples, the outsole can include a plurality of layers of print material, and one or more of the plurality of layers of print material can include at least one segment that is deposited directly onto the midsole. The plurality of layers of print material can form one or more reverse tapered shapes.

In some examples, the outsole can include a plurality of layers of print material, and one or more of the plurality of layers of print material can include at least one segment that is deposited directly onto the midsole. The plurality of layers of print material can form one or more interior segments and one or more barrier segments. The one or more barrier segments can circumscribe at least a portion of the one or more interior segments.

In some examples, a method of manufacturing a sole structure for an article of footwear can be provided. The method can include printing a base layer of an outsole directly onto a midsole and printing an outermost layer of the outsole onto the base layer of the outsole. The base layer can include a first width, and the outermost layer can include a second width, which is different than the first width.

In some examples, one or more segments of the outsole can be printed directly onto the midsole. The one or more segments can include a first laterally-extending segment having a first width and a second laterally-extending segment having a second width. The first laterally-extending segment and the second laterally-extending segment can be disposed adjacent to each other and spaced apart from each other by a distance that is greater than the first width and the second width.

In some examples, one or more segments of the outsole can be printed directly onto the midsole. The one or more segments can include a first laterally-extending segment having a first width, a second laterally-extending segment having a second width, and a longitudinally-extending segment extending from the first laterally-extending segment to the second laterally-extending segment and having a first length. The first length can be greater than the first width and the second width.

In some examples, one or more segments of the outsole can be printed directly onto the midsole. The one or more segments can include a first laterally-extending segment, a second laterally-extending segment, and a longitudinally-extending segment extending from the first laterally-extending segment to the second laterally-extending segment. A first intersection between the first laterally-extending segment and the longitudinally-extending segment can form a first angle. A second intersection between the second laterally-extending segment and the longitudinally-extending segment can form a second angle. The first angle or the second angle can be within a range of 85-120 degrees.

The substrate material may be a substrate material comprising one or more polymers, including an elastomeric material comprising one or more elastomers, such as a thermoplastic elastomeric material comprising one or more thermoplastic elastomers (TPEs). The substrate material may be a solid resin material, such as a solid elastomeric material, or may be a foam material, such as an elastomeric foam material. An elastomer may be defined as a polymer having an elongation at break greater than 100 percent, or greater than 200 percent, or greater than 400 percent, as determined using ASTM D-412-98 at 25 degrees Celsius. An elastomeric material may be defined as a composition having an elongation at break greater than 100 percent, or greater than 200 percent, or greater than 400 percent, as determined using ASTM D-412-98 at 25 degrees Celsius. The one or more polymers of a substrate material may include homopolymers and copolymers and combinations of homopolymers and copolymers. The one or more polymers may comprise, consist essentially of, or consist of a polymer chosen from a polyurethane, a polyurea, a polyester, a polyether, a polyamide, a polyimide, a polyolefin, a polystyrene, a polysiloxane, a polycarbonate, a polyacetate, and any combination thereof, including homopolymers and copolymers thereof. The one or more polymers may comprise, consist essentially of, or consist of a polymer chosen from a polyurethane, a polyester, a polyamide, a polystyrene, a polyolefin, and any combination thereof, including homopolymers and copolymers thereof. The one or more polymers may comprise, consist essentially of, or consist of polyurethanes. Examples of polyurethanes include thermoplastic polyurethanes (TPUs), such as polyester-polyurethane copolymers and polyether-polyurethane copolymers, including thermoplastic elastomeric polyurethanes. The one or more polymers may comprise, consist essentially of, or consist of polyesters. Examples polyesters include polyester homopolymers such as polyethylene terephthalate (PET), and polyester copolymers such as polyetheresters, including thermoplastic polyester copolymers. The one or more polymers may comprise, consist essentially of, or consist of polyamides. Examples of polyamide homopolymers include thermoplastic polyamide homopolymers such as Nylon-6, Nylon-6,6, and Nylon-11. Examples of polyamide copolymers include thermoplastic polyamide copolymers such as thermoplastic elastomeric polyamide block copolymers, for example polyether block amide (PEBA) thermoplastic elastomers. The one or more polymers may comprise, consist essentially of, or consist of polystyrenes. Examples of polystyrenes include thermoplastic polystyrene homopolymers such as thermoplastic polystyrene homopolymer elastomers. Examples of polystyrenes also include thermoplastic polystyrene copolymers such as thermoplastic polystyrene copolymer elastomers, including a polystyrene block copolymer elastomers, for example, a styrene-diene block copolymer such as a styrene-butadiene-styrene (SBS) copolymer or a styrene-ethylene-butadiene-styrene (SEBS) copolymer. The one or more polymers may comprise, consist essentially of, or consist of polyolefins. Examples of polyolefins include thermoplastic polyolefin elastomers, including thermoplastic polyolefin homopolymer elastomers and thermoplastic polyolefin copolymer elastomers. Examples of polyolefin homopolymers include polyethylene and polypropylene. Examples of polyolefin copolymers include polyethylene-polypropylene copolymers, as well as ethylene-vinyl acetate copolymers (EVA) and ethylene-vinyl alcohol (EVOH) copolymers. The one or more polymers may comprise, consist essentially of, or consist of thermoplastics. The one or more polymers may comprise, consist essentially of, or consist of elastomers. The one or more polymers may comprise, consist essentially of, or consist of thermoplastic elastomers, including a thermoplastic elastomer chosen from a thermoplastic polyurethane elastomer, a thermoplastic polyurea elastomer, a thermoplastic polyether elastomer, a thermoplastic polyester elastomer, a thermoplastic polyamide elastomer, a thermoplastic polyimide elastomer, a thermoplastic polystyrene elastomer, a thermoplastic polyolefin elastomer, a copolymer thereof, and any blend thereof. Particular examples of foam substrate materials which may be used, for example as midsole materials, include polyurethane (PU) foam, ethylene-vinyl acetate (EVA) foam, polyether block amide (PEBA) foam, and copolyester foam. One example of a thermoplastic polyurethane elastomer is ELASTOLLAN SP 9339 manufactured by BASF of Ludwigshafen, Germany.

Optionally, in addition to the one or more polymers of the substrate material, the substrate material may further comprise one or more additives. Examples of additives include fillers, polymerization initiators, crosslinking agents, UV light absorbers, anti-oxidants, processing aids such as lubricants and plasticizers, and colorants, such as pigments and dyes. Fillers may include non-polymeric fillers such as silica, clay, and titanium dioxide. Fillers may include polymeric fillers such as polymeric fibers and finely-ground polymeric powders, including ground recycled thermoset rubber and/or ground recycled thermoset or thermoplastic foam. Colorants such as naturally-occurring and synthetic pigments and dyes may be used. The substrate material may comprise one or more additives at a concentration of from about 0.1 weight percent to about 20 weight percent, or from about 0.2 weight percent to about 10 weight percent, or from about 0.5 weight percent to about 5 weight percent, based on a total weight of the substrate material. Alternatively, the substrate material may comprise less than about 0.1 weight percent of additives based on a total weight of the substrate material. A substrate comprising a foam substrate material, such as a midsole, may be provided as one or more unitary components (e.g., an injection molded foam midsole, or one or more injection molded components), fused foam particles (e.g., a plurality of foam beads fused together through a steam-chest molding process, a compression molding process, a 3-D printing process, or any combination thereof), and combinations thereof. A substrate comprising a solid resin substrate material, such as a midsole comprising or consisting of one or more solid resin components (e.g., a sole plate), may be provided as a single unitary component (e.g., as one injection molded component), or as one or more injection molded components which are affixed to each other after being injection molded separately, or which are affixed to each other by injection molding a second substrate material onto a first injection molded component.

In accordance with the present disclosure, the base layer, the outermost layer, and the optional intermediate layer comprise or consist of one or more printed materials (e.g., a first printed material, a second printed material, a third printed material, etc.) The printed material may be a thermoplastic material (i.e., a printed material which remains thermoplastic after being disposed on the substrate and/or on one or more layers of a printed material applied to the substrate). The printed material may be a thermosetting material (i.e., a printed material which cures to be a thermoset after being disposed on the substrate and/or on one or more layers of a printed material applied to the substrate). When the printed material is a printed thermoplastic material, the printed thermoplastic material may be applied to the substrate (e.g., a midsole) in a molten or softened state, which then solidifies onto the substrate and/or onto one or more layers of a printed material applied to the substrate (e.g., a base layer or an intermediate layer). When the printed material is a printed thermosetting material, the printed thermosetting material may initially be a thermoplastic material which subsequently cures into a thermoset material after being disposed onto the substrate and/or onto one or more layers of a printed material applied to the substrate. The printed thermosetting material may be a reactive material which cures into a thermoset material after being mixed with a reactive composition (e.g., a pre-polymer or water) and/or exposed to a form of actinic radiation. The activation of the reactive composition may occur shortly before it is disposed onto the substrate and/or the one or more layers of printed material applied to the substrate, while it is being disposed onto the substrate and/or the one or more layers of the printed material applied to the substrate, or after it has been disposed onto the substrate and/or the one or more layers of the printed material applied to the substrate.

The printed materials disclosed herein (e.g., the first printed material, the second printed material, the third printed material, etc.) include one or more polymers. The one or more polymers of a printed material may include homopolymers and copolymers and combinations of homopolymers and copolymers. The one or more polymers may comprise, consist essentially of, or consist of a thermoplastic. The one or more polymers may comprise, consist essentially of, or consist of a thermoplastic elastomer (TPE). The one or more polymers may comprise, consist essentially of, or consist of a polymer chosen from a polyurethane, a polyurea, a polyester, a polyether, a polyamide, a polyimide, a polyolefin, a polystyrene, a polysiloxane, a polycarbonate, a polyacetate, a polylactide, a vinyl polymer, and any combination thereof, including homopolymers and copolymers thereof. The one or more polymers may comprise, consist essentially of, or consist of a polymer chosen from a polyurethane, a polyester, a polyamide, a polystyrene, a polyolefin, and any combination thereof, including homopolymers and copolymers thereof. The one or more polymers may comprise, consist essentially of, or consist of polyurethanes. The one or more polymers can comprise, consist essentially of, or consist of a thermoplastic polyurethane, including a thermoplastic elastomeric polyurethane. Examples of polyurethanes include polyester-polyurethane copolymers, polyether-polyurethane copolymers, and polyether-ester polyurethane copolymers. The one or more polymers may comprise, consist essentially of, or consist of polyesters. Examples of polyesters include polyester homopolymers such as polyethylene terephthalate (PET), polyethylene terephthalate glycol (PETG), and polyester copolymers such as polyetheresters, including thermoplastic polyester copolymers. The one or more polymers may comprise, consist essentially of, or consist of a polyether, such as a polyether ether ketone (PEEK). The one or more polymers may comprise, consist essentially of, or consist of polyamides. Examples of polyamide homopolymers include thermoplastic polyamide homopolymers such as Nylon-6, Nylon-6,6, and Nylon-11. Examples of polyamide copolymers include thermoplastic polyamide copolymers such as thermoplastic elastomeric polyamide block copolymers, for example polyether block amide (PEBA) thermoplastic elastomers. The one or more polymers may comprise, consist essentially of, or consist of polystyrenes. The polystyrene may be a thermoplastic polystyrene, including a thermoplastic elastomeric polystyrene. The polystyrene may be a styrene homopolymer such as a high-impact polystyrene (HIPS). The polystyrene may be a styrene copolymer, such as a styrene block copolymer. The polystyrene may be a thermoplastic elastomeric styrene block copolymer. Examples of styrene block copolymers include styrene-diene block copolymers such as a styrene-butadiene-styrene (SBS) copolymer, a styrene-ethylene-butadiene-styrene (SEBS) copolymer, and an acrylonitrile-butadiene-styrene (ABS) copolymer. The one or more polymers may comprise, consist essentially of, or consist of polyolefins. Examples of polyolefins include thermoplastic polyolefin elastomers, including thermoplastic polyolefin homopolymer elastomers and thermoplastic polyolefin copolymer elastomers. Examples of polyolefin homopolymers include polypropylene and polyethylene, including high-density polyethylene (HDPE). Examples of polyolefin copolymers include polyethylene-polypropylene copolymers, as well as ethylene-vinyl acetate copolymers (EVA), and ethylene-vinyl alcohol (EVOH) copolymers. The one or more polymers may comprise, consist essentially of, or consist of a polycarbonate, including a polycarbonate homopolymer or copolymer. The one or more polymers may comprise, consist essentially of, or consist of a polylactide, such as polylactic acid (PLA) homopolymer or copolymer. The one or more polymers may comprise, consist essentially of, or consist of a vinyl polymer, including a vinyl homopolymer or a vinyl copolymer, such as a polyvinyl acetate (PVA) or polyvinyl alcohol. The one or more polymers may comprise, consist essentially of, or consist of thermoplastics. The one or more polymers may comprise, consist essentially of, or consist of elastomers.

In some examples, a plurality of the various printed layers of the outsole can comprise the same or similar printed material (e.g., composition, polymer type, etc.) and/or properties (e.g., color, pattern, dimensions, hardness, etc.). In other examples, the printed material of one or more of the printed layers of the outsole can comprise a different material and/or properties than one or more other printed layers of the outsole.

Examples of the Disclosed Technology

Figure 2:
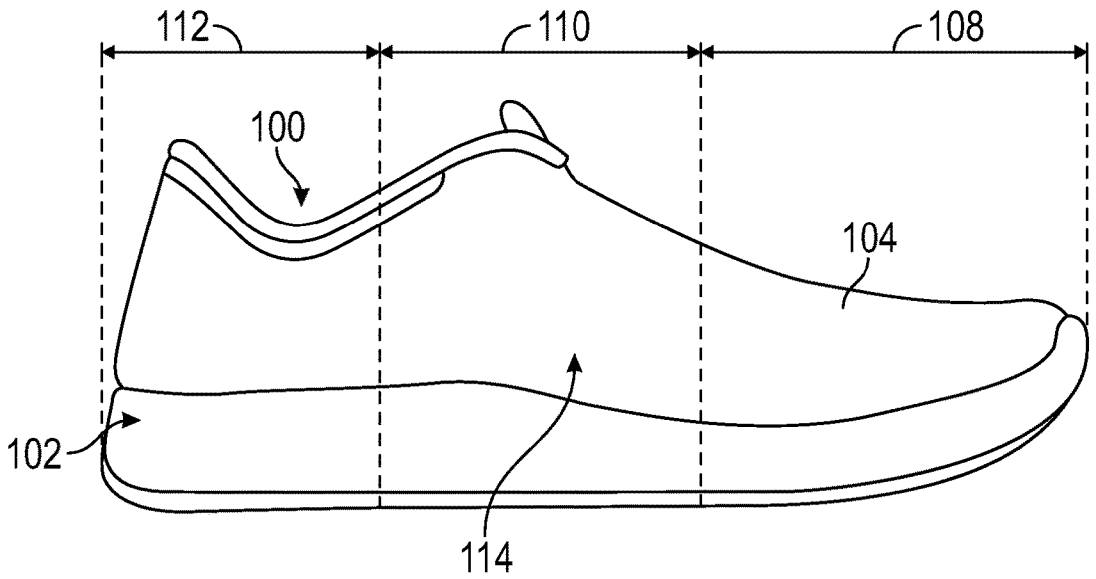
FIG. 2 depicts a lateral side view of the article of footwear of FIG. 1.
Figure 3:
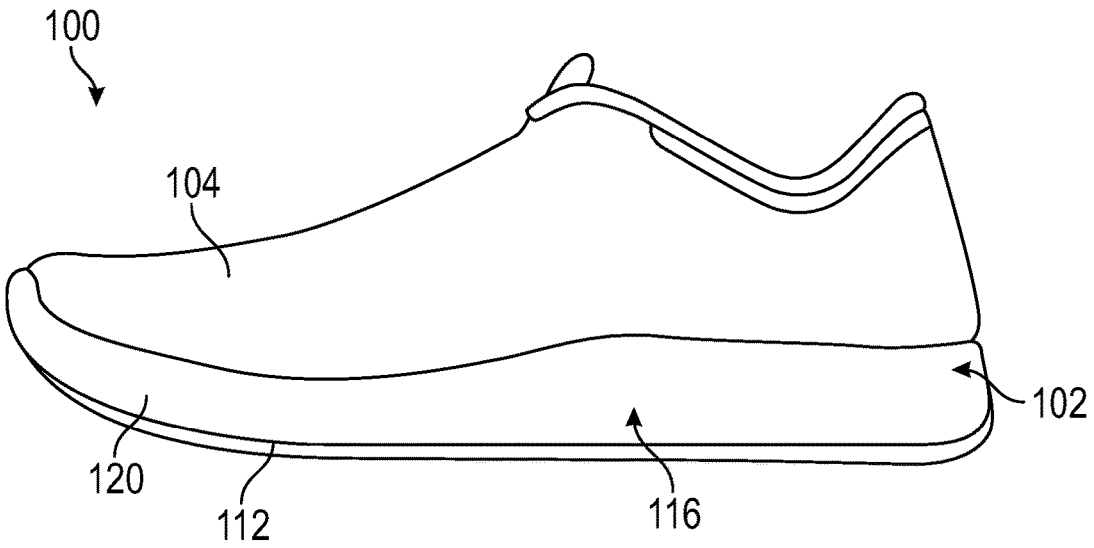
FIG. 3 depicts a medial side view of the article of footwear of FIG. 1.

For example, FIGS. 1-6 depict an article of footwear 100 and its components, according to one example. The article of footwear 100 can also be referred to as "the article 100," "the footwear 100," or "the shoe 100." FIG. 1 depicts a perspective view of the article of footwear 100. FIG. 2 depicts an elevation view of a lateral side of the article of footwear 100 (e.g., configured to be worn on a right foot of a wearer). FIG. 3 depicts an elevation view of a medial side of the article of footwear 100.

Referring to FIG. 1, the article of footwear 100 comprises a sole structure 102 and an upper 104. The upper 104 is coupled to and extends from the sole structure 102 and forms a foot-receiving cavity 106 between the sole structure 102 and the upper 104. The article of footwear can also include a closure system to adjust the foot-receiving cavity 106. In this manner, the closure system can be used, for example, to secure/release the article of footwear 100 to/from a wearer's foot. Exemplary closure systems include laces, straps, bands, cables, cords, ratcheting mechanisms, hook-and-loop, etc.

Referring to FIG. 2, the article of footwear 100 can be divided into one or more regions (which can also be referred to as "zones," "portions," or "sections"). For example, in an anterior posterior direction, the article of footwear 100 (and/or its components) can be divided into (and/or include) a forefoot region 108, a midfoot region 110, and a heel region 112. The forefoot region 108 of the article of footwear 100 can correspond to anterior portions of a foot, including toes and joints connecting metatarsal bones with phalanx bones of the foot. The midfoot region 110 of the article of footwear 100 can correspond with an arch area of the foot. The heel region 112 of the article of footwear 100 can correspond with posterior portions of the foot, including a calcaneus bone.

Figure 4:
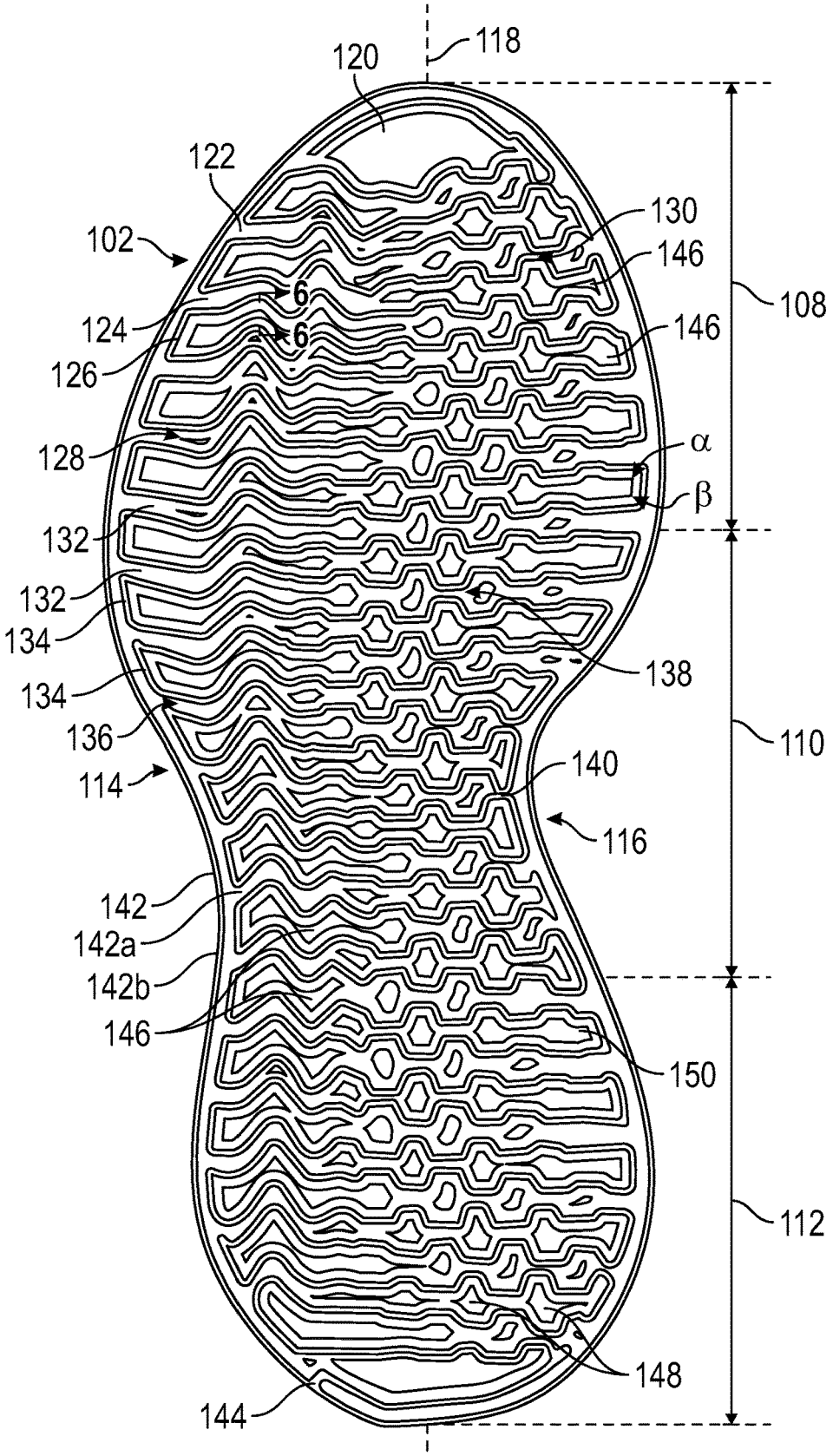
FIG. 4 depicts a bottom plan view of the sole structure of the article of footwear of FIG. 1.

In a medial/lateral direction, the article of footwear 100 (and/or its components) can be divided into a lateral side portion 114 and a medial side portion 116, both of which extend through the forefoot region 108, the midfoot region 110, and the heel region 112. For example, FIG. 2 depicts the lateral side portion 114 of the article of footwear 100, and FIG. 3 depicts the medial side portion 116 of the article of footwear 100. The lateral side portion 114 and the medial side portion 116 are separated by a longitudinal axis 118, as depicted in FIG. 4.

The article of footwear 100 can also be described in reference to a superior/inferior direction. For example, in the orientation depicted in FIGS. 2-3, the superior direction is up, and the inferior direction is down.

Referring to FIG. 1, the upper 104 of the footwear 100 can be formed of various materials. For example, the upper 104 can be formed of one or more of the following materials: textiles, foam, leather, polymers, and/or synthetic leather. In some examples, the upper 104 can be formed as a single, unitary component (e.g., by knitting or molding). In other examples, the upper 104 can comprise a plurality of components that are coupled together (e.g., by stitching, adhesive, fasteners, etc.).

The upper 104 can be fixedly coupled to the sole structure 102 in various ways. The upper 104 can be attached (e.g., stitched) to a strobel, and the strobel can be attached to the midsole 120 (e.g., with an adhesive). In other examples, the strobel can be omitted, and the upper 104 can be attached to a component of the sole structure 102. In some such examples, the upper 104 can be directly attached to the midsole 120 and/or a cushioning element (e.g., an airbag) of the sole structure 102 via adhesive, stitching, and/or other means for coupling.

The article of footwear 100 can, in some instances, further comprise a sockliner (which may also be referred to as "an insole"). The sockliner can be configured to be positioned directly underfoot and is configured to cushion and/or support the wearer's foot. The sockliner can comprise various materials including textile, leather, foam, and/or other types of materials.

Figure 5:
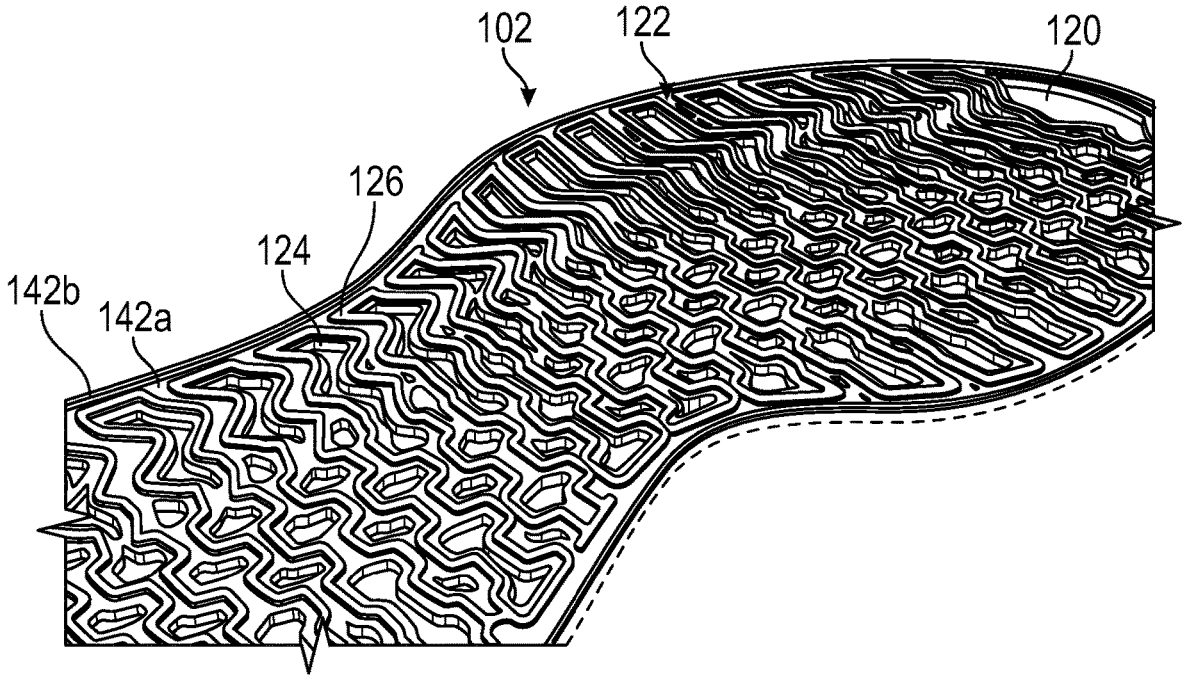
FIG. 5 depicts a partial perspective view of the sole structure of the article of footwear of FIG. 1.

Referring now to FIGS. 3-5, the sole structure 102 of the article of footwear 100 comprises a midsole 120 and an outsole 122. In some examples, the sole structure can include one or more additional components. For instance, the sole structure can comprise a plurality of cushioning elements. Various types of cushioning elements can be used, either alone or in various combinations. For example, the cushioning elements can be fluid-filled capsules (e.g., airbags). As another example, the cushioning elements can be foam pads. As yet another example, the cushioning elements can include a plurality of bead-like members contained within a flexible membrane.

The sole structure 102 can be coupled to the upper 104 in various ways. For example, in some instances, the sole structure 102 and the upper can be coupled together with adhesive, fasteners, stitching, and/or other means for coupling. In certain examples, the article of footwear 100 can include a strobel that is coupled (e.g., sewn) to an inferior portion of the upper 104, and the strobel can be coupled to the midsole 120 (e.g., via adhesive).

The midsole 120 of the sole structure 102 is configured to be positioned under the wearer's foot. As such, the midsole 120 can, for example, be configured to provide cushioning and support. The midsole 120 can be configured to flex and/or elastically deform as the wearer's foot applies pressure upon the midsole 120 and/or as the article of footwear 100 impacts a ground surface.

In some examples, the midsole 120 can comprise a polymeric material, such as an elastomeric foam material. Exemplary substrate materials are described above.

Furthermore, the midsole 120 can be provided as one or more unitary components (e.g., injection molded foam midsoles), fused foam particles (e.g., foam beads fused through a steam-chest molding process, a compression molding process, a 3-D printing process, or any combination thereof), and combinations thereof.

The outsole 122 of the sole structure 102 is configured to be the primary ground-contacting surface of the article of footwear 100, though the midsole and/or other portions of the article of footwear may, in at least some instances, also contact the ground. Accordingly, the outsole 122 can, for example, be configured to provide traction and/or to protect the other components of the sole structure 102 and/or the upper 104. In some examples, the outsole can comprise various traction elements (e.g., nubs, ribs, cleats, lugs, patterns, etc.) configured for engaging one or more types of ground surfaces. For example, the outsole can comprise a plurality of ribs arranged in various orientations. This outsole configuration can be used, for example, on relatively hard and smooth surfaces such as a road, a sidewalk, a hard dirt trail, a running track, a tennis court, a basketball court (e.g., hardwood, concrete, asphalt, etc.), to name a few examples. Additionally, or alternatively, the outsole can comprise cleats or lugs configured to engage and/or penetrate the ground surface (e.g., dirt, grass, various track surfaces, etc.).

Unlike typical articles of footwear, the outsole 122 of the article of footwear 100 comprises printed material deposited directly onto the midsole 120. Accordingly, the outsole 122 of the article of footwear 100 is directly coupled to the midsole 120 without the need for adhesive and/or other coupling means between the midsole and the outsole. Additionally, the outsole 122 of the article of footwear 100 also reduces waste material compared to typical outsoles because the outsole 122 is not cut from a sheet of material like typical outsoles. Also, by forming the outsole 122 via printing rather than molding, the outsole 122 can comprise one or more features that would be difficult or impossible to achieve when forming an outsole via a molding process.

The outsole 122 can be printed directly onto the midsole 120 in various ways. For example, in some examples, three-dimensional printing can be used. Examples of three-dimensional printing systems that can be used include fused filament fabrication (FFF) and/or other kinds of three-dimensional printing technologies for thermoplastic or thermosetting materials, including printing technologies which extrude thermoplastic or thermosetting materials. The printed thermoplastic material can be applied in a molten or softened state, which then solidifies onto the midsole and/or one or more layers of the outsole.

The printed materials disclosed herein (e.g., the first printed material, the second printed material, the third printed material, etc.) of the outsole 122 may include a printed material as describe above, including a printed thermoplastic material.

The outsole can comprise one or more layers of printed material. Each layer can be configured for one or more purposes. For example, a first layer printed directly onto the midsole can be configured for bonding with the midsole and/or for forming a base for subsequent layers of the outsole that are printed onto the first layer. In this manner, the first layer may be referred to as a "bonding layer" and/or a "base layer." The first layer and/or a subsequent layer of the outsole can be configured for contacting a ground surface by presenting an outermost ground-facing surface at a portion of a finished sole structure. As such, a layer configured for contacting the ground may be referred to as a "ground-contacting layer," a "traction layer," and/or an "outermost layer." In some examples, the outsole can comprise a single layer, in which case the single layer can be configured to be both a bonding/base layer and a traction/outermost layer.

Each layer of the outsole can be formed via one or more passes of the printed material. For example, in some instances, a layer (e.g., a base layer and/or a traction layer) can be formed via a single pass. In other instances, a layer can be formed via a plurality of passes of the printed material. The plurality of passes of a layer can, in some examples, be adjacent (i.e., directly contacting each other) at one or more segments of the layer. In other examples, the plurality of passes of the layer can be spaced apart from each other at one or more segments such that there is a gap therebetween.

Figure 6:
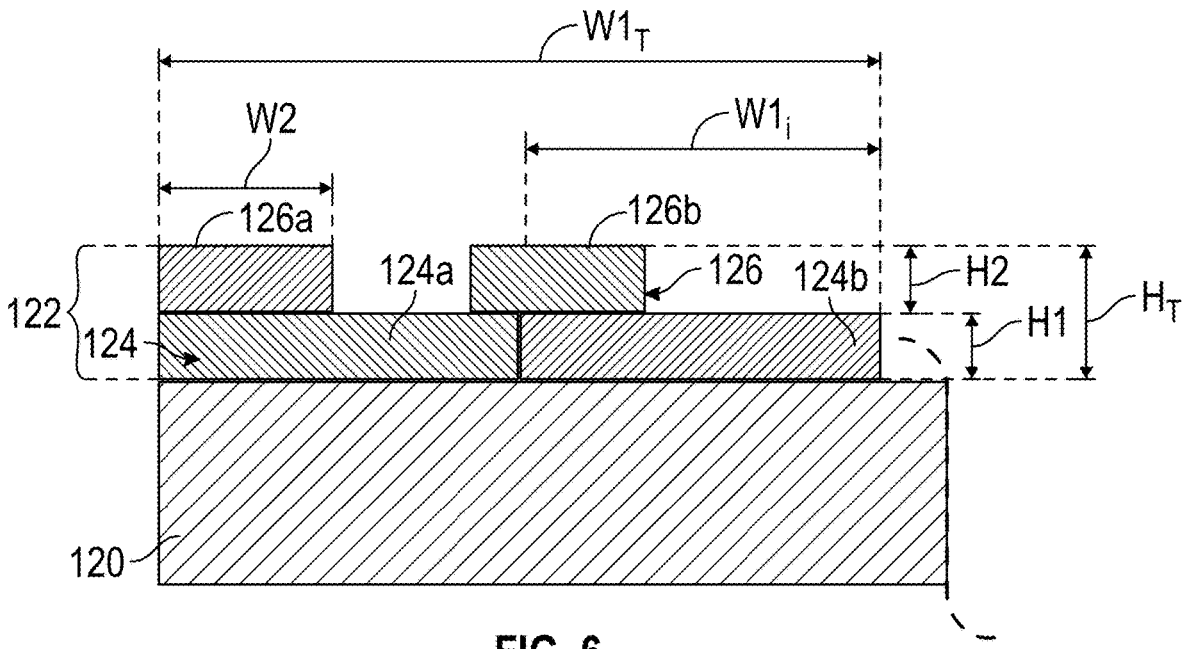
FIG. 6 depicts a schematic cross-sectional view of a portion of the sole structure of the article of footwear of FIG. 1, taken along the line 6-6 as depicted in FIG. 4.

FIGS. 4-6 depict the sole structure 102 of the article of footwear 100, which comprises the midsole 120 and the outsole 122. As mentioned above, the outsole 122 is printed directly onto the midsole 120. In FIGS. 4-5, the midsole 120 is depicted as black, and the outsole 122 is depicted as white and green. In FIG. 6, the sole structure is depicted in a schematic cross-sectional view.

Referring to FIG. 6, the outsole 122 comprises two layers printed onto the midsole 120. More specifically, the outsole 122 comprises a base layer 124 and an outermost layer 126. The base layer 124 of the outsole 122 is printed (e.g., extruded, sprayed, etc.) directly onto the midsole 120 and comprises two segments 124*a* and 124*b*. The two segments 124*a* and 124*b* of the base layer 124 are disposed adjacent to each other so as to appear as a relatively wide, single segment at the location depicted in FIG. 6. At one or more other locations the two segments 124*a* and 124*b* of the base layer 124 can be spaced apart from each other such that there is a gap therebetween (see, e.g., the location reference by arrow 128 in FIG. 4). The outermost layer 126 is printed directly onto the base layer 124 and comprises two segments 126*a* and 126*b*. The two segments 126*a* and 126*b* of the outermost layer 126 are spaced apart from each other at the location depicted in FIG. 6. At one or more other locations, the two segments 126*a* and 126*b* of the outermost layer 126 can be disposed adjacent to each other so as to appear as a relatively wide, single segment (see, e.g., the location reference by arrow 130 in FIG. 4).

A multi-segment layer can be formed in various ways. For example, in some instances, a single printhead can form multiple segments by making two passes (e.g., adjacent or spaced apart) at a region of the print surface (e.g., the midsole). A plurality of printheads can be used as an additional or alternative means for forming a plurality of segments of a single layer and/or forming multiple layers.

In some examples, a first printhead can dispense a first print material onto the midsole, which varies in one or more properties (e.g., hardness, type, etc.) relative to a second print material dispensed onto the midsole by a second printhead. In lieu of or in addition to using various print materials, the first printhead and the second printhead (and/or the printing system) can also differ in one more other print parameters (e.g., print speed, nozzle size/shape, flow rate, deposition temperature, etc.).

In other examples, in lieu of or in addition to multiple passes, the dimensions of a layer can be adjusted by varying one or more parameters of the printing system. These parameters include, the print nozzle shape/size, the relative speed between the substrate (e.g., the midsole) and the printhead, the distance between the substrate and the printhead, the deposition temperature of the print material, etc.

Referring still to FIG. 4, the outsole 122 can comprise one or more features configured to improve bonding and/or reduce delamination (e.g., peeling) between the outsole 122 and the midsole 120 and/or between the various layers of the outsole 122.

As one example of a feature that can reduce delamination, one or more of the layers of the outsole can comprise linking segments between adjacent pairs of segments. For example, the outsole 122 comprises a first plurality of segments 132, which extend generally laterally, and a second plurality of segments 134, which extend generally longitudinally between adjacent pairs of the first plurality of segments 132. In this manner, the second plurality of segments 134 tie the first plurality of segments 132 together. The interconnected nature of the segments reduces the likelihood that the outsole 122 will detach from the midsole 120 (compared to an outsole comprising a plurality of individual, i.e., non-interconnected, lateral ribs). In some instances, the length of a second segment 134 can be greater than a width of one or both segments of a pair of first segments 132, either individually or collectively.

As another example, one or more of the layers can comprise relatively gradual changes in direction. This can be accomplished by forming U-shaped turns in the printed material, where the base of "U" is relatively long. Additionally, or alternatively, curves in the printed material can comprise relatively large radii of curvature.

In some examples, a pair of laterally-extending segments connected by a longitudinally-extending segment can comprise a first angle (e.g., the angle $\alpha$) formed between a first laterally-extending segment and the longitudinally-extending segment and a second angle (e.g., the angle $\beta$) formed between a second laterally-extending segment and the longitudinally-extending segment. The first angle and/or the second angle can be within a range of 75-135 degrees, or optionally 85-120 degrees or 90-110 degrees.

As another example, one or more of the layers can comprise parallel segments (see, e.g., arrow 136) and non-parallel segments (see, e.g., arrow 138). In some examples, the non-parallel segments can diverge, converge, and/or intersect (see, e.g., line 140).

As another example, one or more of the layers can include one or more segments comprising a serpentine or sinuous path. In other words, at least a portion of a layer can be a non-straight line. This can, for example, increase the contact area between the outsole and the midsole and/or each layer of the midsole.

As another example, an outsole can include one or more barrier segments. The barrier segments can extend around or adjacent to a peripheral edge of the outsole (i.e., the edge defining the bottom surface of the outsole—the portion of the outsole depicted in FIG. 4). The barrier segment can protect one or more other segments of the outsole. In FIG. 4, the outsole 122 comprises a barrier segment 142 circumscribing the interior segments of the outsole and defining the peripheral edge of the outsole. An outsole can, in some instances, include a plurality of barrier segments. In other examples, an outsole can be formed without a barrier segment.

In the depicted example, the barrier segment 142 includes both a base layer portion 142*a* and an outermost portion 142*b*. In other examples, a barrier segment can include fewer (e.g., only a base layer) or more layers (e.g., one or more intermediate layers).

The base layer portion 142*a* of the barrier segment 142 links the other segments of the base layer 124 that extend generally laterally. In this manner, the base layer portion 142*a* can, for example, reduce the number of "free" or "exposed" edges and/or corners of the outsole, which may be prone to delamination. As such, the base layer portion 142*a* can, among other things, reduce delamination of the outsole from the midsole. Although the base layer portion 142*a* is directly coupled to the other segments of the base layer 124, in other examples, the base layer portion of the barrier segment can be space apart from one or more other segments of the base layer (e.g., similar to the outermost portion 142*b*).

The outermost portion 142*b* of the barrier segment 142 extends around the peripheral edge of the outsole 122 circumscribing the interior segments of the outermost layer 126. The outermost portion 142*b* of the barrier segment 142 can thus protect the edges and/or corners of the interior segments of the outermost layer 126, which in turn can reduce delamination.

In the illustrated example, the outermost portion 142*b* is spaced apart from the interior segments of the outermost layer 126 around most of the outsole, and there is one connecting segment 144 between the outermost portion and the interior segments of the outermost layer 126 at the heel region 112. Rather than being spaced apart, the outermost portion of the barrier can, in other examples, link one or more interior segments of the outermost layer 126 (e.g., similar to the base layer portion 142*a*). Additionally (or alternatively), an outsole can comprise fewer or more connecting segments than depicted in the illustrated example, and/or the connecting segments can be disposed in one or more additional or alternative locations.

Figure 7:
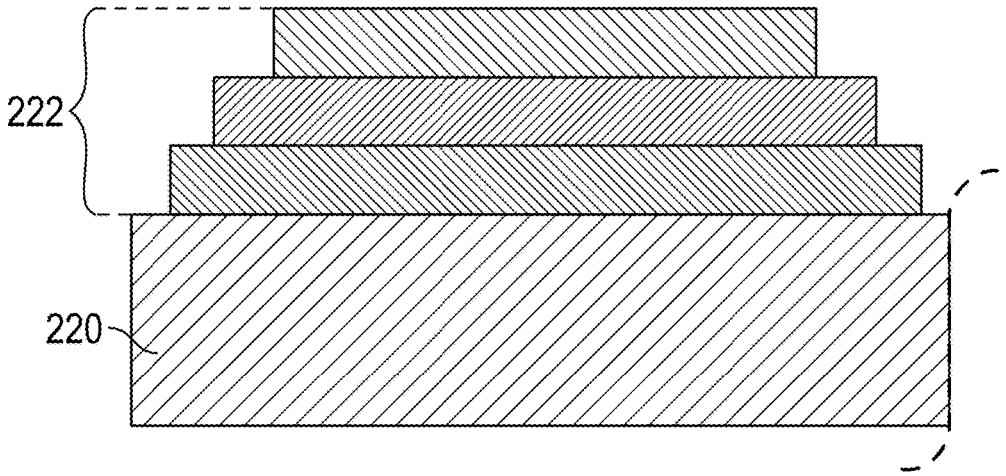
FIG. 7 depicts a schematic cross-sectional view of a portion of a sole structure for an article of footwear, according to another example.

FIG. 7 depicts yet another example of a feature that can reduce delamination. This example comprises stepwise or tapered outsole layers, including a widest base layer followed by a narrower intermediate layer, and a narrower still outermost layer. The size of the steps and/or the degree of taper can be determined by the height and/or the relative change of widths of the layers. For example, shorter layers and/or relatively small changes in width for each layer can produce a smoother or more gradual taper, and taller layers and/or relatively large changes in width for each layer can produce a more step-like or aggressive taper.

The dimensions of the layers of the outsole can be selected according to one or more factors, including material type of the midsole, material type of the printed outsole material, outsole pattern, and/or other factors. For example, in some instances, a base layer of the outsole can comprise one or more segments having a width (see "$W1_T$" and $W1_i$" in FIG. 6) in within a range of 0.5-20 mm. In certain examples, one or more segments of the base layer can comprise a width within a range of 2-16 mm. In particular examples, one or more segments of the base layer can comprise a width within a range of 7-11 mm. In other examples, one or more segments of the base layer can comprise a width within a range of 3-6 mm.

For example, in some instances, an outermost layer of the outsole can comprise one or more segments having a width W2 (see FIG. 6) within a range of 0.25-20 mm. In certain examples, one or more segments of the outermost layer can comprise a width within a range of 0.5-10 mm. In particular examples, one or more segments of the outermost layer can comprise a width within a range of 0.75-5 mm. In other examples, one or more segments of the outermost layer can comprise a width within a range of 1-3 mm.

The width of a segment of a layer can be formed by a single pass or deposition of print material (see, e.g., "$W1_i$" in FIG. 6). Alternatively, a plurality of passes, each comprising an individual width, can be used to collectively form a total width of the segment (see, e.g., "$W1_T$" in FIG. 6). The width dimension of a printed layer can be the nominal or average width of the segment, allowing for slight variation (e.g., +/−0-20% in some examples, or optionally +/−0-10% or +/−0-5% in other examples). For example, a base layer can, in some instances, can comprise a nominal width of 8 mm, while comprising one or more portions with a width less than 8 mm (e.g., 7.75 mm) and/or more portions with a width greater than 8 mm (e.g., 8.25 mm).

Referring to FIG. 6, the height of the outsole (e.g., $H_T$) and the height of the individual layers (e.g., H1 and H2) of the outsole can be configured in various manners. The height of the outsole can be formed by a single layer at one or more locations or can be formed by a collective "stack" of layers at one or more other locations. In some instances, the height of the outsole (or an individual layer or a stack of layers) can be within a range of 0.25-30 mm. In particular instances, the height of the outsole can be within a range of 0.5-5 mm or within a range of 1-3 mm. In certain examples, the height of an individual layer can be within a range of 0.25-4 mm or 0.5-2 mm. The term "height" can also be referred to herein as "thickness."

In some examples, the total height (which may also be referred to as a maximum height) of the outsole is uniform or at least substantially uniform across the outsole. In other examples, the total height of the outsole can vary across the outsole such that the outsole has a first total height a first location of the outsole and a second total height at a second location of the outsole. For example, an outsole can comprise a "lugged pattern" where the lugs have a total height that is greater than the total height of the recessed portions disposed between the lugs.

As noted above, an outsole can comprise a single layer or a plurality of layers (e.g., 2-30). An outsole can also comprise one or more first regions having a certain number of layers (e.g., one) and one or more second regions having a different number of layers (e.g., a plurality) than the first region. For example, a toe region of the outsole can comprise fewer layers (and/or thinner layers) than a heel region of the outsole to form a "heeled shoe" (e.g., a hiking boot). As another example, a toe region of the outsole can comprise more layers (and/or thicker layers) than a heel region of the outsole to form a running shoe (e.g., a short-distance running shoe).

Any layer of printed material (e.g., a base layer, an outermost layer, etc.) can comprise a varying dimension (e.g., width, height, and/or length). For example, a base layer can comprise a first portion comprising a width of 4-6 mm (e.g., formed by a single pass) and a second portion comprising a width of 8-10 mm (e.g., formed by a plurality of passes).

Besides dimensions, one or more other of the properties of each layer can also be selected to reduce delamination. For example, in some instances, the hardness and/or rigidity of a layer can be selected to improve bonding with the layer on which it is printed. As one example, a relatively hard and/or rigid base layer of the outsole can be used when the midsole is relatively rigid and/or rigid, or a relatively soft and/or flexible base layer of the outsole can be used when the midsole is relatively soft and/or flexible. This allows the base layer of the outsole and the midsole to move (e.g., flex) together, which can reduce the likelihood of the outsole peeling away from the midsole.

The various hardness disclosed herein are Shore durometer values (e.g., 65A or 40D) and are determined by an ASTM D2240 test (e.g., Type A or Type D), unless explicitly stated otherwise. For example, a printed layer can exhibit a durometer Shore A hardness of less than 90 or less than 85 or less than 80. The printed layer can exhibit a durometer Shore A hardness of greater than 40, greater than 50, greater than 60, or greater than 65. The polymer layer can exhibit a durometer Shore A hardness of 40 to 90 Shore A, optionally from 45 to 80 Shore A, 50 to 85 Shore A, from 55 to 80 Shore A, or from 60 to 70 Shore A. The polymer layer can exhibit a durometer Shore A hardness of 45A, 50A, 55A, 60A, 65A, 70A, 75A, 77A, 80A, 85A, 90A, any range of Shore A hardness values encompassed by any of the foregoing values, or any combination of the foregoing Shore A hardness values.

A sample of a finished shoe can be taken for the purpose of testing the Shore durometer value. The material to be tested can be removed (e.g., delaminated from the midsole and/or other layers of the outsole) and tested according to the ASTM D2240 test. In the event that a layer is too small (e.g., too narrow and/or too thin) to be properly tested via the ASTM D2240 test, a proxy sample with adequate width and thickness can be used. The proxy should be the same material and have the same deposition temperature. In lieu of or in addition to the testing methods discussed above, a manufacturer's stated nominal durometer value for the material to be printed can be used. The stated nominal durometer value can be found on the packaging, brochure, website, and/or other information source provided by the manufacturer.

As yet another example, the outsole can comprise one or more relatively flexible layers between the outermost layer and the midsole. The flexible layer(s) can be a base layer of the outsole coupled directly to the midsole and/or an intermediate layer of the outsole disposed between the outermost layer and the base layer of the outsole. The flexible layer(s) can, for example, allow the outmost layer (i.e., the primary ground-contacting layer) of the outsole to flex relative to the midsole, which can reduce delamination of the outsole from the midsole.

The various delamination features described herein can be used individually or separately.

As depicted in FIGS. 4-5, the outsole 122 comprises a plurality of interconnected segments that form open cells where the bottom surface of the midsole 120 is exposed. One advantage printing the outsole directly to the midsole (as opposed to applying adhesive or other means for coupling therebetween) and/or leaving portions of the midsole without outsole material disposed thereon is that the midsole is less constrained by the outsole the coupling means and can therefore flex and move more naturally in response to force exerted on the midsole. This can, for example, allow the midsole to be more responsive and flexible than articles of footwear with typical outsoles. The outsoles disclosed herein can be used, for example, with the midsoles disclosed in U.S. Publication No. 2020/0093221, which is incorporated by reference herein.

The cells defined by the outsole can comprise various shapes, including standard geometric shapes (e.g., circular, ovular, triangular, rectangular, square, etc.) and non-standard shapes (see, e.g., FIG. 4). In some instances, various regions of the shoe can comprise different cell configurations (e.g., size and/or shape).

For example, as depicted in FIG. 4, the outsole 122 comprises a plurality of elongate cells 146 disposed adjacent the lateral edge and the medial edge of the outsole, which extend toward the central longitudinal axis 118 of the outsole. The elongate cells 146 on both the lateral cells and the medial cells extend from a location at or proximate the toe region to a location at or proximate the heel region. The elongate cells on the lateral side of the outsole are more elongate than the cells on the medial side of the outsole. Various other configurations can be used in other examples.

Between the elongate cells 146, the outsole 122 comprises a plurality of somewhat round cells 148 (referred to herein as "rounded cells" for simplicity). The rounded cells 148 extend from a location at or proximate the toe region to a location at or proximate the heel region.

In some instances, the elongate cells 146 and the rounded cells 148 adjoin to form hybrid cells 150.

In other examples, an outsole can include various other cell configurations and/or comprise other configurations that do not form closed cells. Additional examples are discussed below.

For the sake of brevity, like reference numbers refer to like components, unless explicitly stated otherwise. For example, reference numbers 120, 122 refer to the midsole and outsole of the article of footwear 100, respectively, and reference numbers 220 and 222 refer to another example of a midsole and an outsole respectively.

Figure 8:
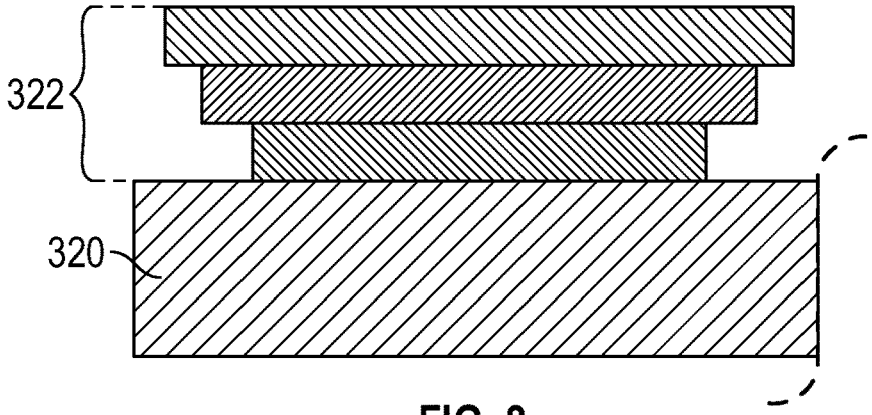
FIG. 8 depicts a schematic cross-sectional view of a portion of a sole structure for an article of footwear, according to another example.
Figure 9:
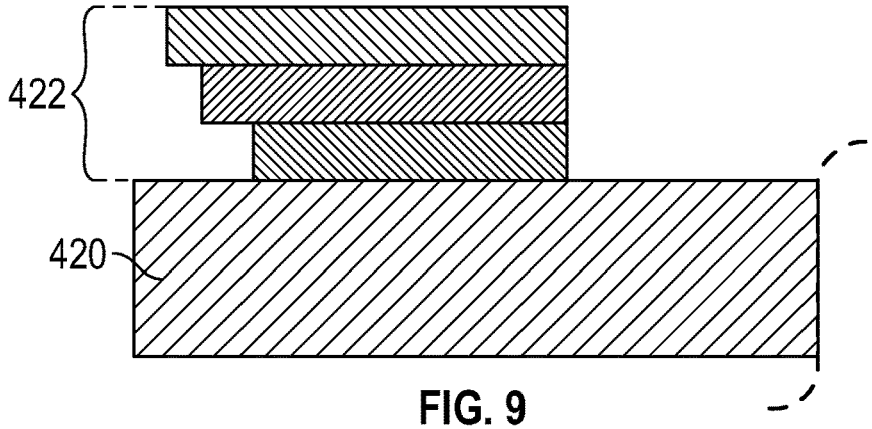
FIG. 9 depicts a schematic cross-sectional view of a portion of a sole structure for an article of footwear, according to another example.
Figure 10:
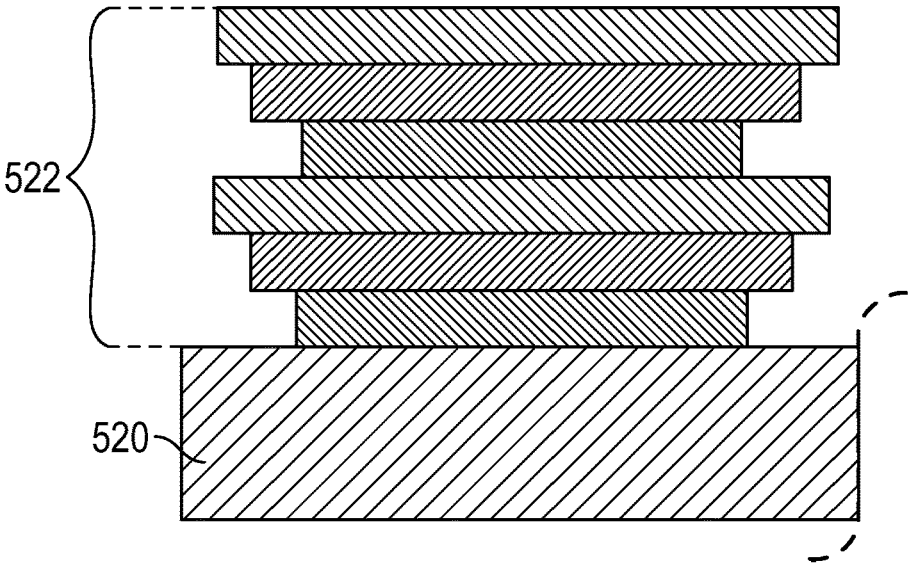
FIG. 10 depicts a schematic cross-sectional view of a portion of a sole structure for an article of footwear, according to another example.

As mentioned above, printing an outsole or at least a portion of an outsole directly onto the midsole provides one or more advantages related to manufacturability. For example, printed outsoles can comprise features (e.g., traction elements) comprising a "reverse tapered" shape. As used herein, "reversed tapered" means narrow towards the midsole and wider away from the midsole. Outsoles comprising exemplary reverse tapered shapes are depicted schematically in FIGS. 8-10. The reverse tapered shapes depicted in FIGS. 8-10 would be impossible or impractical to form via molding.

Figure 11:
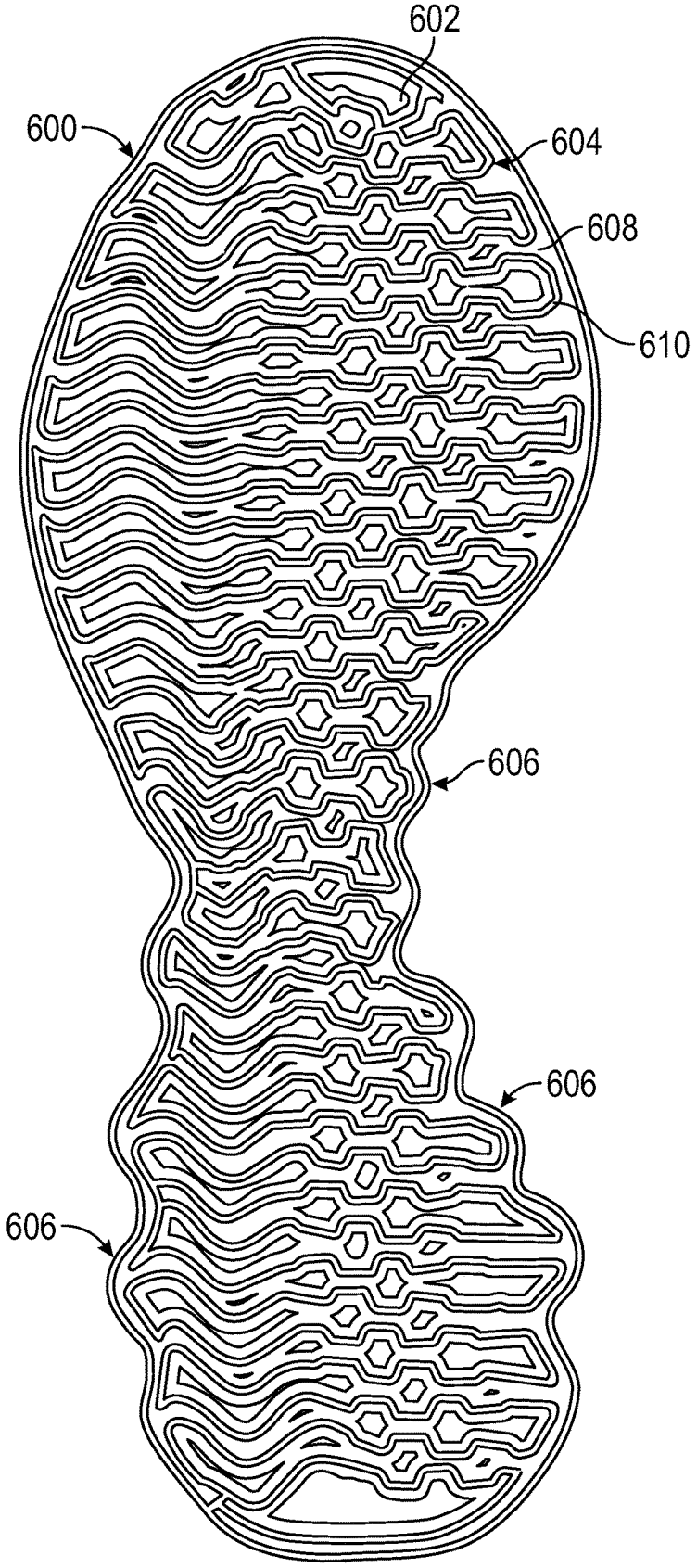
FIG. 11 depicts a bottom plan view of a sole structure for an article of footwear, according to another example.

FIG. 11 depicts a sole structure 600 for an article of footwear. The sole structure 600 comprises a midsole 602 and an outsole 604. The outsole 604 is directly coupled to the midsole 602 via printing (e.g., 3-D printing). The sole structure 600 is configured similar to the sole structure 102 of the article of footwear 100 in that the sole structure 600 and the sole structure 102 each comprise a plurality of layers disposed on the midsole and arranged, and the layers form a plurality of interconnected segments arranged in a serpentine pattern.

The outsole 604 differs from the outsole 122 in other respects. For example, the outsole 604 includes a wavy or undulating outer peripheral edge 606 dispose on the lateral and medial sides and extending from the midfoot region to the heel region, whereas the outsole 122 comprise a smoother, rounded outer peripheral edge at the heel region.

The outsole 604 can, among other things, provide good bonding with the midsole and/or provide a visually pleasing aesthetic. The outsole 604 can also provide performance and manufacturing advantages. For example, the performance of an article of footwear comprising the outsole 604 is enhanced because outsole material is located only where needed, which reduces weight. As another example, the outsole 604 can be printed efficiently due to its relatively large radius curves (e.g., reduces cycle times) and connected lines (e.g., to limit start/stop).

The outsole 604 comprises a base layer 608 and a ground-contacting layer 610. In some locations, the base layer 608 is wider than at other locations. In some examples, the wider portions of the base layer 608 (or any other layer) can be formed by performing a plurality (e.g., 2-10) of print passes in which the print material of each pass directly contacts the print material of an adjacent pass. The narrower portions of the base layer (or any other layer) can be formed by performing fewer (e.g., 1-9) print passes. In other examples, the wider and narrower portions can be formed by using different print nozzles.

The ground-contacting layer 610 (which can also be referred to as the "outermost layer") also comprises some narrow segments and some wider segments. Like the base layer, the varying width of the ground-contacting layer 610 can be formed in various ways (e.g., single/adjacent print passes and/or wide/narrow print nozzles).

Figure 12:
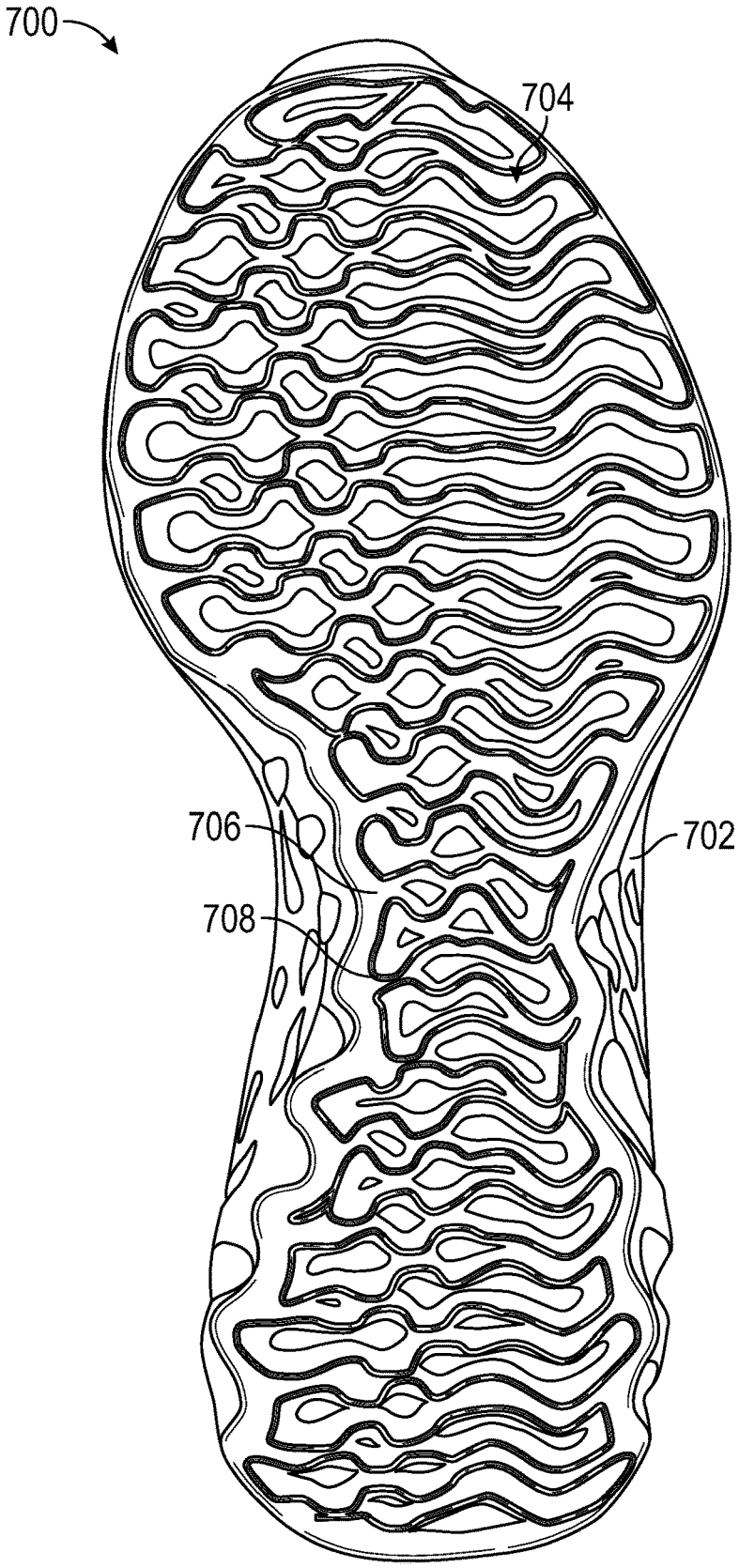
FIG. 12 depicts a bottom plan view of a sole structure for an article of footwear, according to another example.
Figure 13:
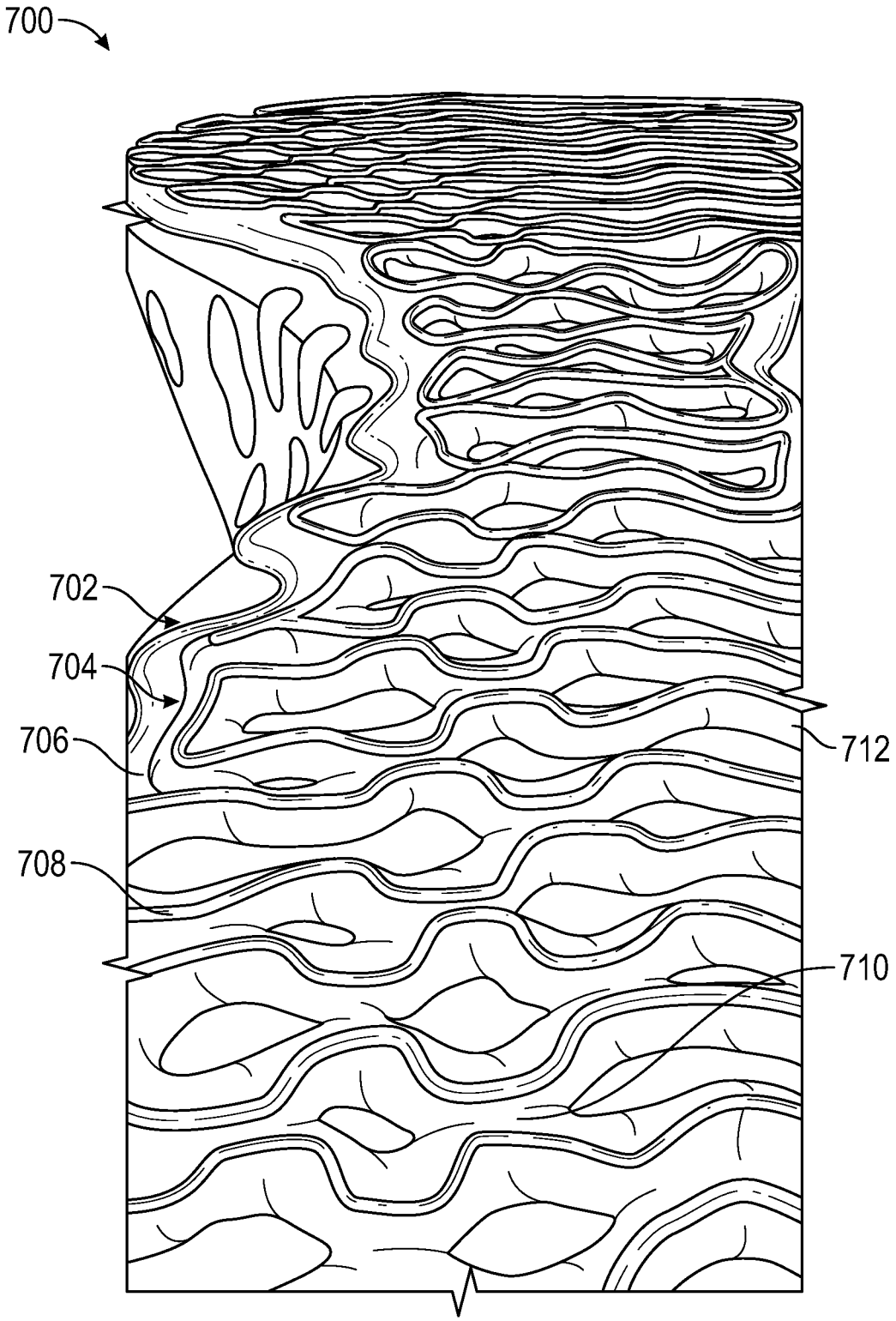
FIG. 13 depicts a partial perspective view of the sole structure of FIG. 12.

FIGS. 12-13 depict a sole structure 700 for an article of footwear. The sole structure comprises a midsole 702 and an outsole 704. The sole structure 700 (particularly the outsole 704) is configured similar to the sole structure 600 and the outsole 604. It should be noted that the sole structure 600 depicted in FIG. 11 is configured for a right shoe, and the sole structure 700 depicted in FIGS. 12-13 is configured for a left shoe.

In the illustrated example, the midsole 702 comprises an elastomeric foam substrate material comprising EVA. In other examples, the substrate material of the midsole may comprise a solid resin material or a foam material comprising one or more different polymers. For example, the midsole can comprise a solid resin sole plate (e.g., a sole plate of a solid resin material comprising a TPU).

The outsole 704 comprises a base layer 706 and an outermost layer 708. In the illustrated example, the base layer 706 is translucent and has a clear color, and the outermost layer 708 is opaque and has a florescent yellow color. In other examples, the base layer and/or the outermost layer 708 can comprise various other translucency (transparent, opaque, etc.) and/or various other colors.

Referring now to FIG. 13, in some locations, a plurality of segments of the base layer 706 of the outsole 704 can contact each other. In this manner, the segments of the base layer adjoin to form relatively wide portions 710. At other locations, the segments of the base layer can be spaced apart to form relatively narrow portions 712. The outermost layer 708 of the outsole can also comprise relatively wide and/or relatively narrow segments. As discussed above, the wide/narrow segments can be formed by adjacent segments/single segments and/or by using wide/narrow print nozzles to deposit the layers onto the midsole.

Figure 14:
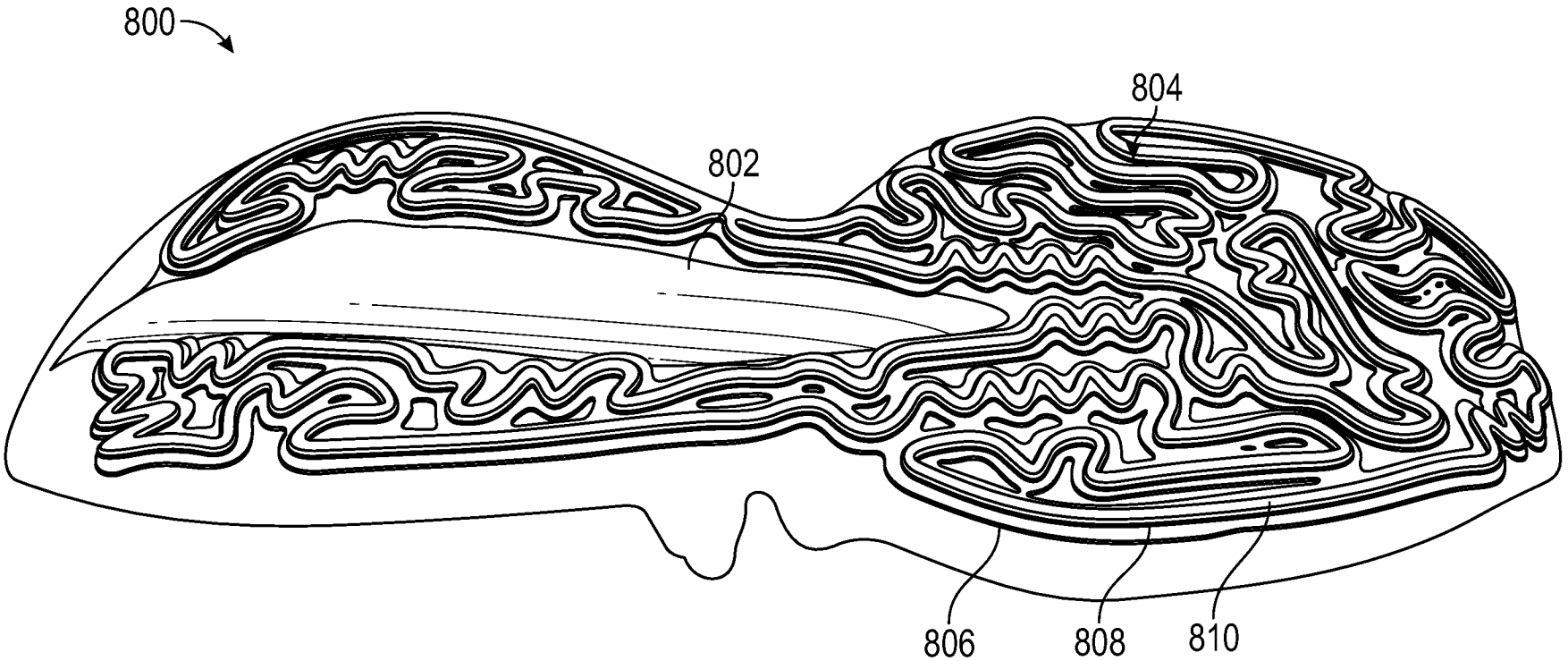
FIG. 14 depicts a perspective view of a sole structure for an article of footwear, according to another example.

FIG. 14 depicts a sole structure 800, according to another example. The sole structure 800 comprises a midsole 802 and an outsole 804. The midsole 802 comprises a split configuration extending from the posterior portion of the toe region to the heel region.

The outsole 804 can comprise a plurality of layers. For example, the outsole comprises three layers, including a first layer 806, a second layer 808, and a third layer 810. The first layer 806 is disposed directly onto the midsole 802. The second layer 808 is disposed directly on the first layer 806. The third layer 810 is disposed directly on the second layer 808. In this manner, the first layer 806 forms a base layer configured, among other things, for coupling the outsole to the midsole. The third layer 810 forms an outermost layer configured, among other things, for contacting a ground surface. The second layer 808 forms an intermediate layer configured, among other things, for coupling the first layer 806 and the third layer 810 together.

In other examples, the outsole can comprise less (e.g., 1-2) or more (e.g., 4-50) than three layers. Also, the outsole can comprise various heights, widths, patterns, colors, transparency, etc.

Figure 15:
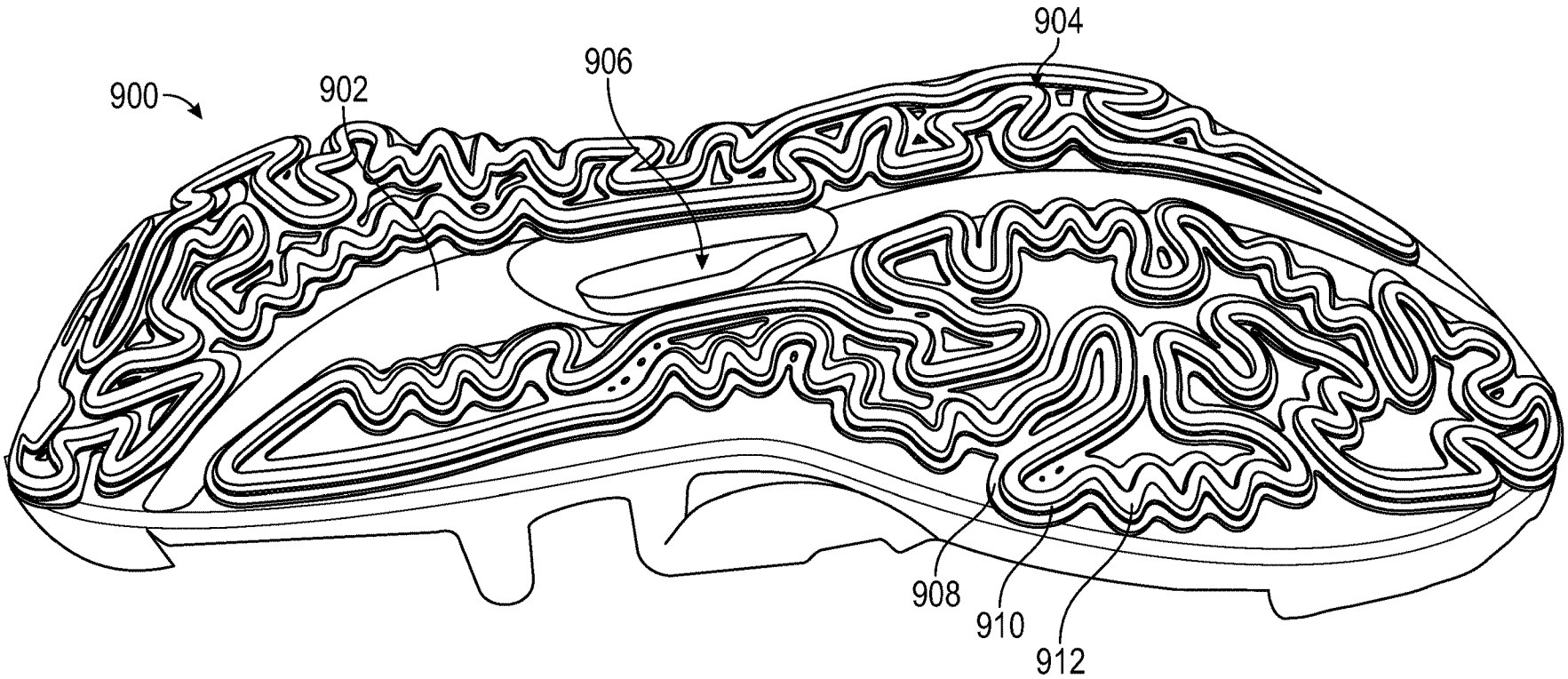
FIG. 15 depicts a perspective view of a sole structure for an article of footwear, according to another example.

FIG. 15 depicts a sole structure 900, according to another example. The sole structure 900 comprises a midsole 902 and an outsole 904. The midsole 902 comprises a split configuration extending from the toe region to the heel region and includes an opening 906 in the midfoot/arch region.

The outsole 904 can comprise a plurality of layers. For example, the outsole 904 comprises three layers, including a first layer 908, a second layer 910, and a third layer 912. The first layer 908 is disposed directly onto the midsole 902. The second layer 910 is disposed directly on the first layer 908. The third layer 912 is disposed directly on the second layer 910. In this manner, the first layer 908 forms a base layer configured, among other things, for coupling the outsole to the midsole. The third layer 912 forms an outermost layer configured, among other things, for contacting a ground surface. The second layer 910 forms an intermediate layer configured, among other things, for coupling the first layer 908 to the third layer 912.

Unless explicitly stated otherwise, it should be noted that each of the outsoles disclosed herein can be formed by directly printing the outsole onto a midsole.

Figure 16:
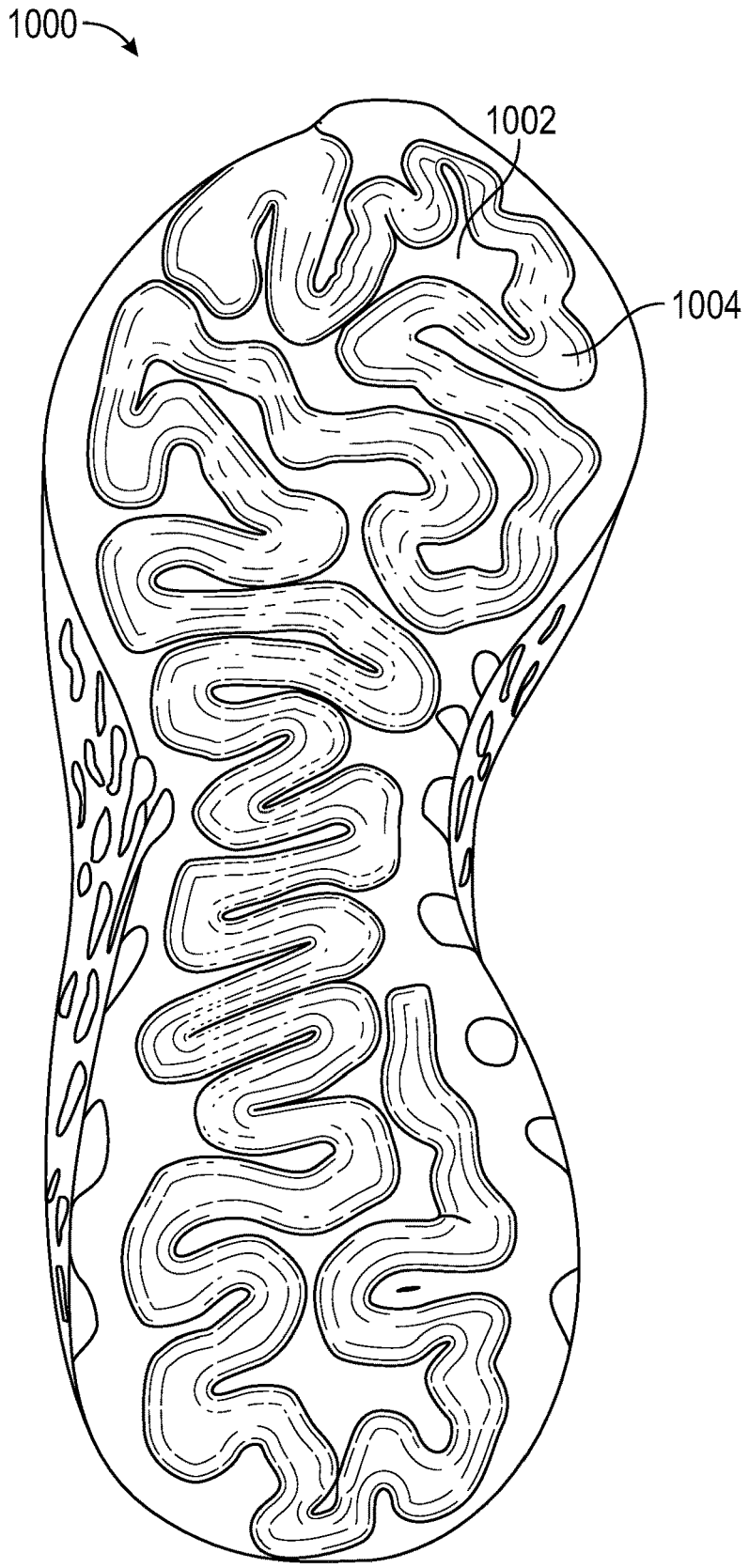
FIG. 16 depicts a bottom plan view of a sole structure for an article of footwear, according to another example.

FIG. 16 depicts a sole structure 1000, according to another example. The sole structure 1000 comprises a midsole 1002 and an outsole 1004 directly coupled to the midsole 1002. The outsole 1004 comprises a plurality of layers arranged in a serpentine path.

Figure 30:
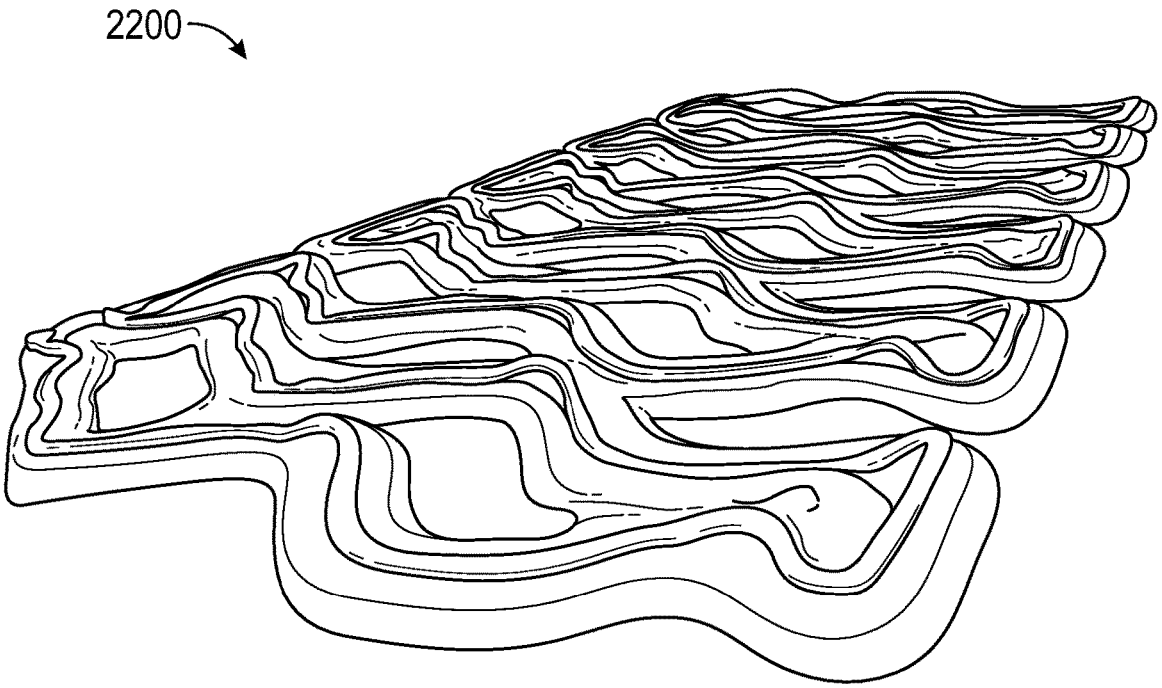
FIG. 30 depicts a partial perspective view of an outsole for an article of footwear, according to another example.
Figure 31:
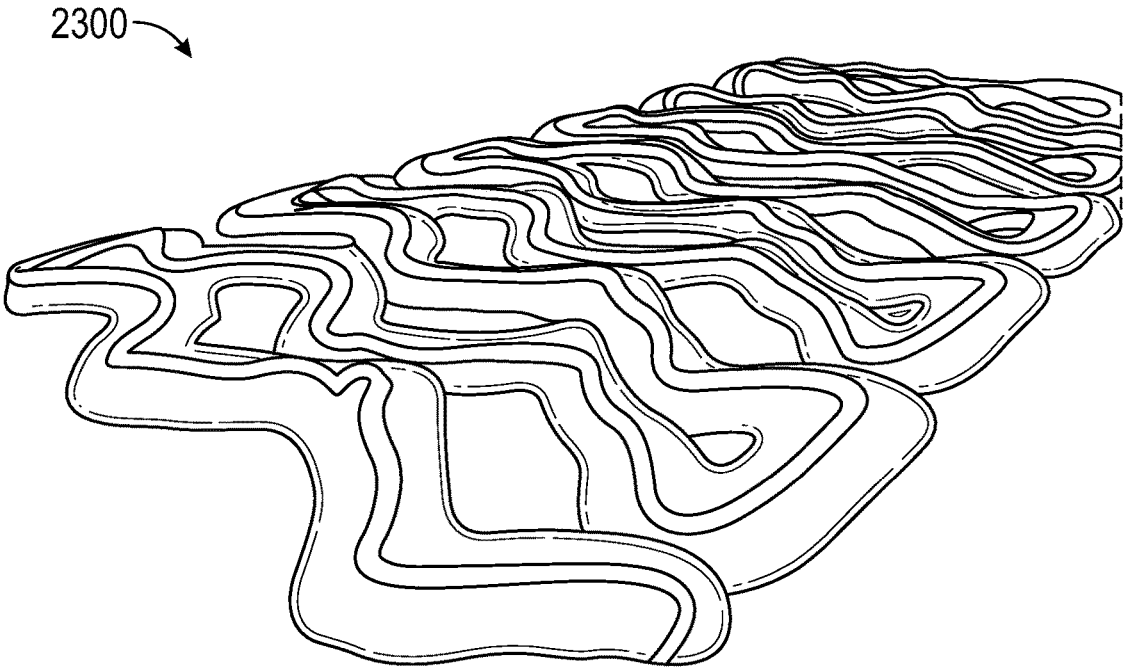
FIG. 31 depicts a partial perspective view of an outsole for an article of footwear, according to another example.

In the illustrated example, each layer of the plurality of layers follows a similar path to form a "stacked" layer configuration. In other examples, one or more of the layers can follow a different path than one or more other layers for at least one segment of the layer. For example, see the outsoles 2200 and 2500 depicted in FIGS. 30 and 33, respectively.

Figure 17:
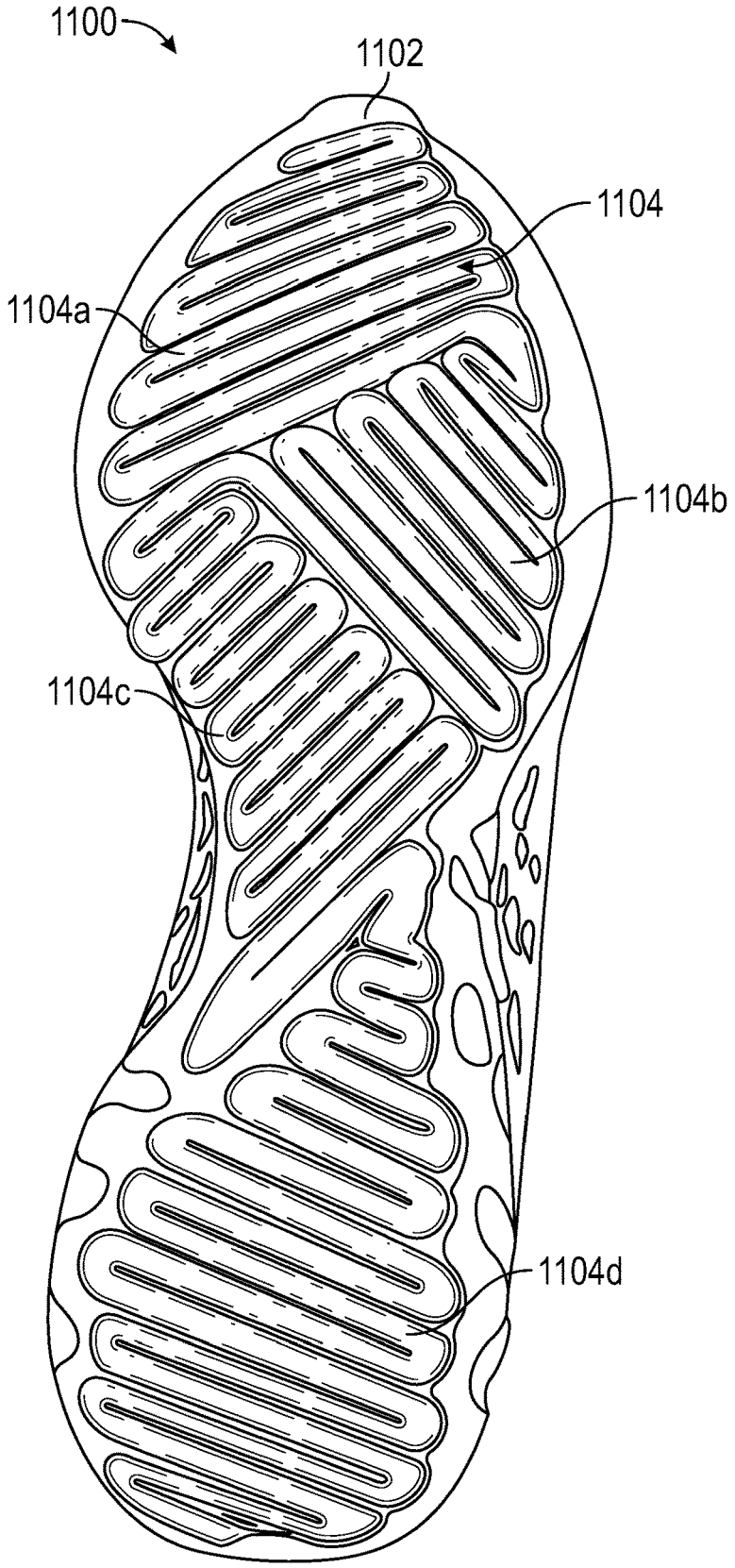
FIG. 17 depicts a perspective view of a sole structure for an article of footwear, according to another example.

FIG. 17 depicts a sole structure 1100, according to another example. The sole structure 1100 comprises a midsole 1102 and an outsole 1104 directly coupled to the midsole 1102. The outsole 1104 comprises a plurality of layers arranged in a serpentine path.

The outsole 1104 comprises a plurality of regions **1104*a*-1104*d***. In each region, the layers of the outsole zigzag across the midsole in a particular orientation, which is different than the other regions. The various regions can, for example, be configured based on specific predetermined parameters including durability, traction, relative location on the article of footwear, etc.

Figure 18:
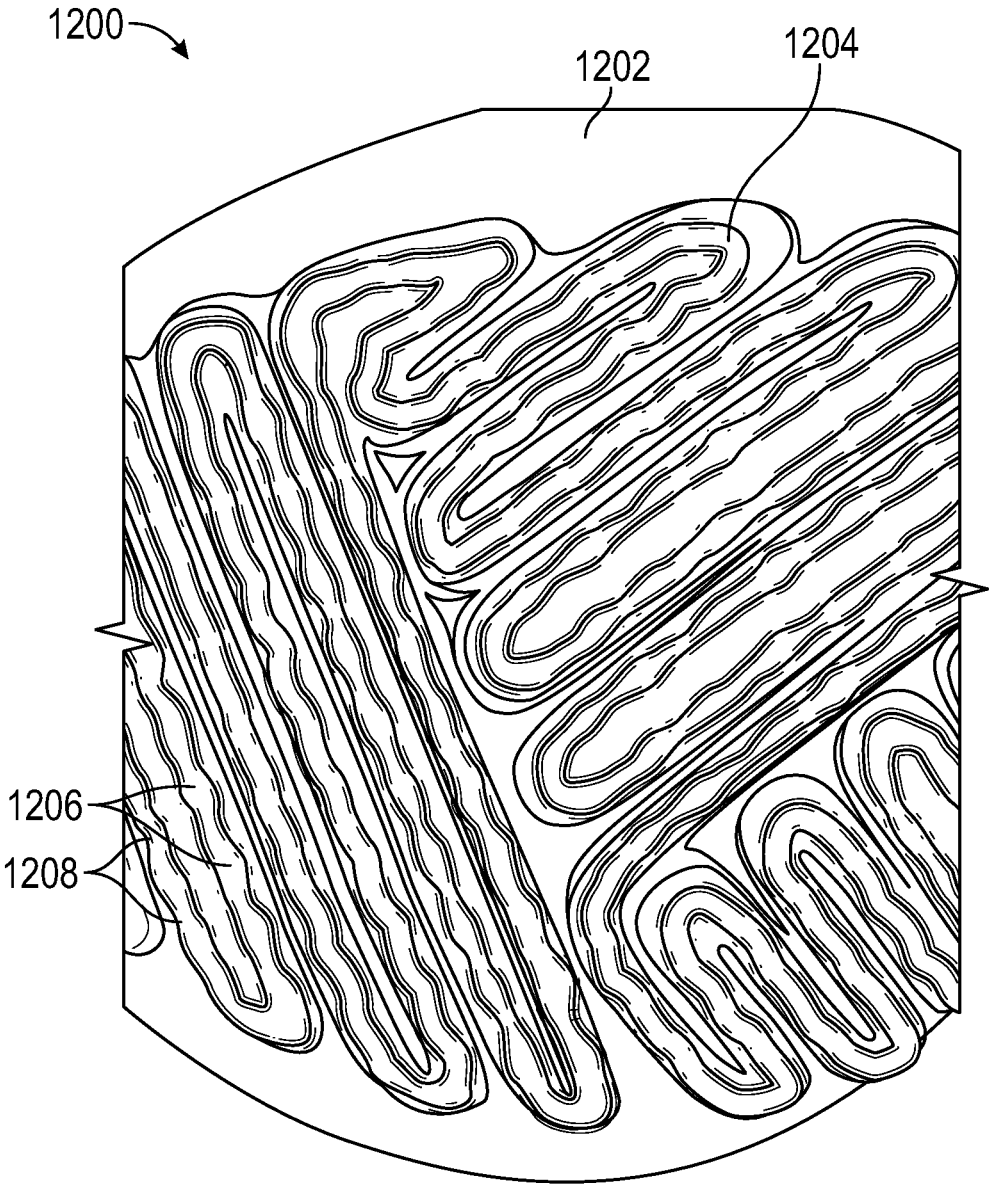
FIG. 18 depicts a partial bottom plan view of a sole structure for an article of footwear, according to another example.

FIG. 18 depicts a toe portion of a sole structure 1200, according to another example. The sole structure 1200 comprises a midsole 1202 and an outsole 1204 directly coupled to the midsole 1202.

The outsole 1204 comprises various regions, each with a zigzag configuration oriented in a different direction.

The outsole 1204 also comprises a plurality of layers (e.g., three). As depicted, the outermost layer comprises a width that varies along its length such that there is a plurality of wide regions 1206 and a plurality of narrow regions 1208 arranged in an alternating pattern. This wide/narrow configuration gives the outermost layer a "wavy" texture and/or appearance, which can also be referred to as "peaks and valleys." The wavy texture can, for example, provide increased traction.

The wavy texture can be formed, for example, be altering the flow rate of the print material and/or the speed of the print nozzle relative to the midsole. For example, increasing the flow rate of print material and/or decreasing the speed of the print nozzle forms the wide regions. Decreasing the flow rate of print material and/or increasing the speed of the print nozzle forms the narrow regions.

The width and/or height of the layers can also be altered by changing the deposition temperature of the print material.

Figure 19:
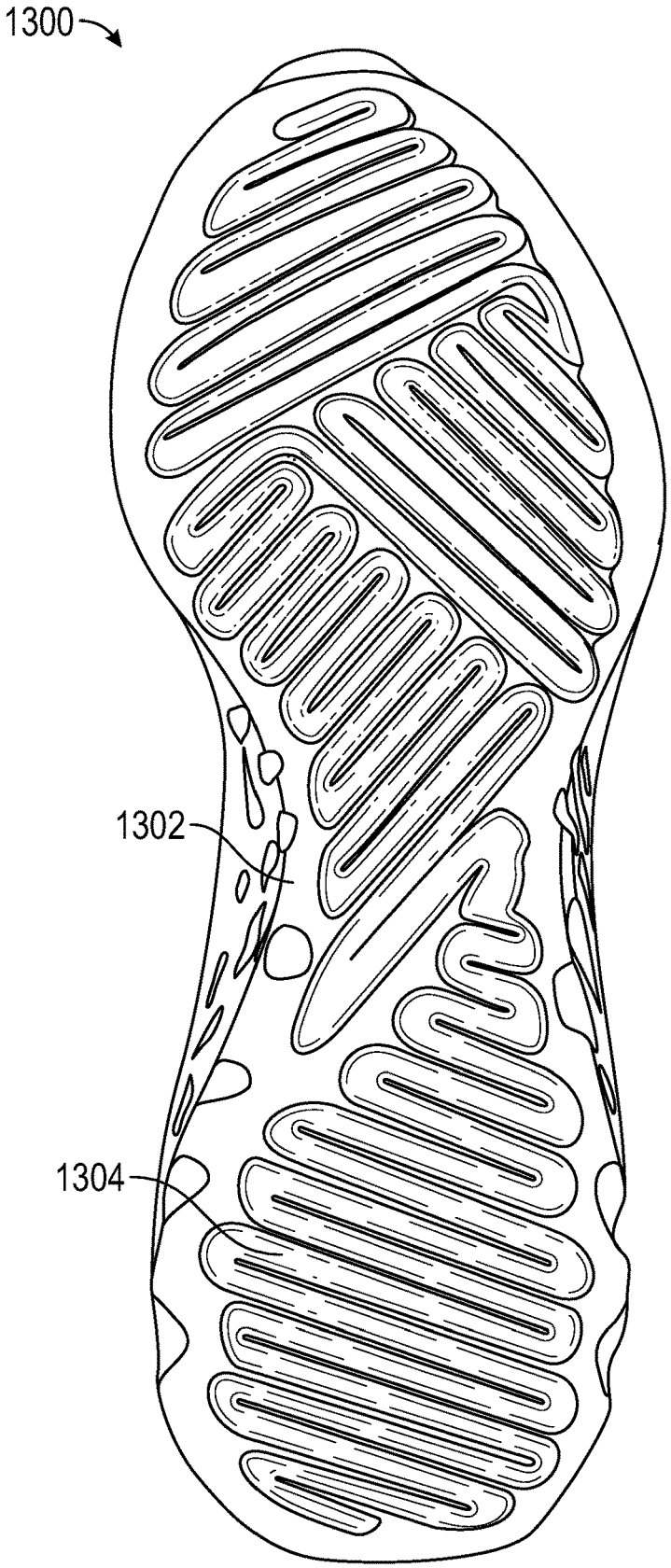
FIG. 19 depicts a bottom plan view of a sole structure for an article of footwear, according to another example.

FIG. 19 depicts a sole structure 1300, according to another example. The sole structure 1300 comprises a midsole 1302 and an outsole 1304 directly coupled to the midsole 1302. The outsole 1304 comprises a plurality of layers arranged in a serpentine path.

The outsole 1304 comprises a plurality of regions. In each region, the layers of the outsole zigzag across the midsole in a particular orientation, which is different than the other regions.

Figure 20:
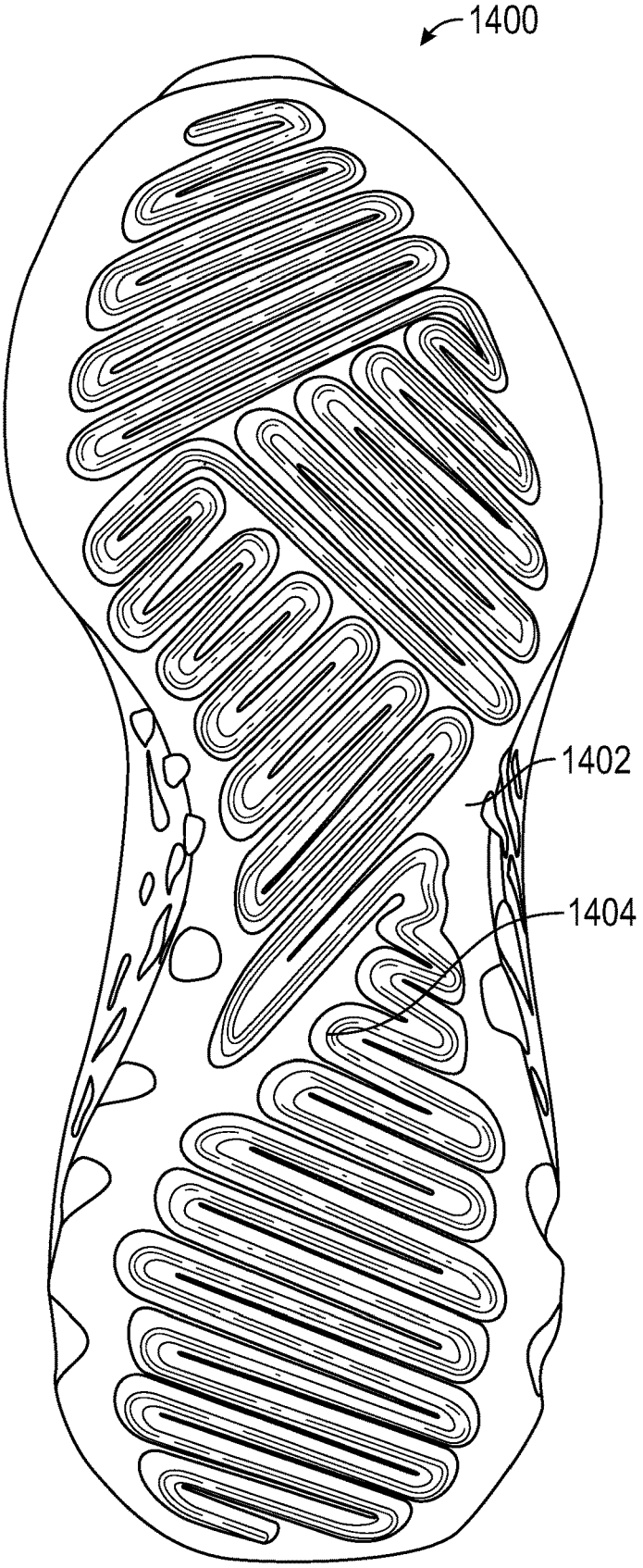
FIG. 20 depicts a bottom plan view of a sole structure for an article of footwear, according to another example.

FIG. 20 depicts a sole structure 1400, according to another example. The sole structure 1400 comprises a midsole 1402 and an outsole 1404 directly coupled to the midsole 1402.

The outsole 1404 comprises a plurality of layers arranged in a continuous serpentine path. In other words, the print nozzle deposits a continuous bead of material onto the outsole for at least one layer (or a plurality of layers). In other examples, one or more of the layers can be formed in a non-continuous manner.

The outsole 1404 comprises a plurality of regions. In each region, the layers of the outsole zigzag across the midsole in a particular orientation, which is different than the other regions.

Figure 21:
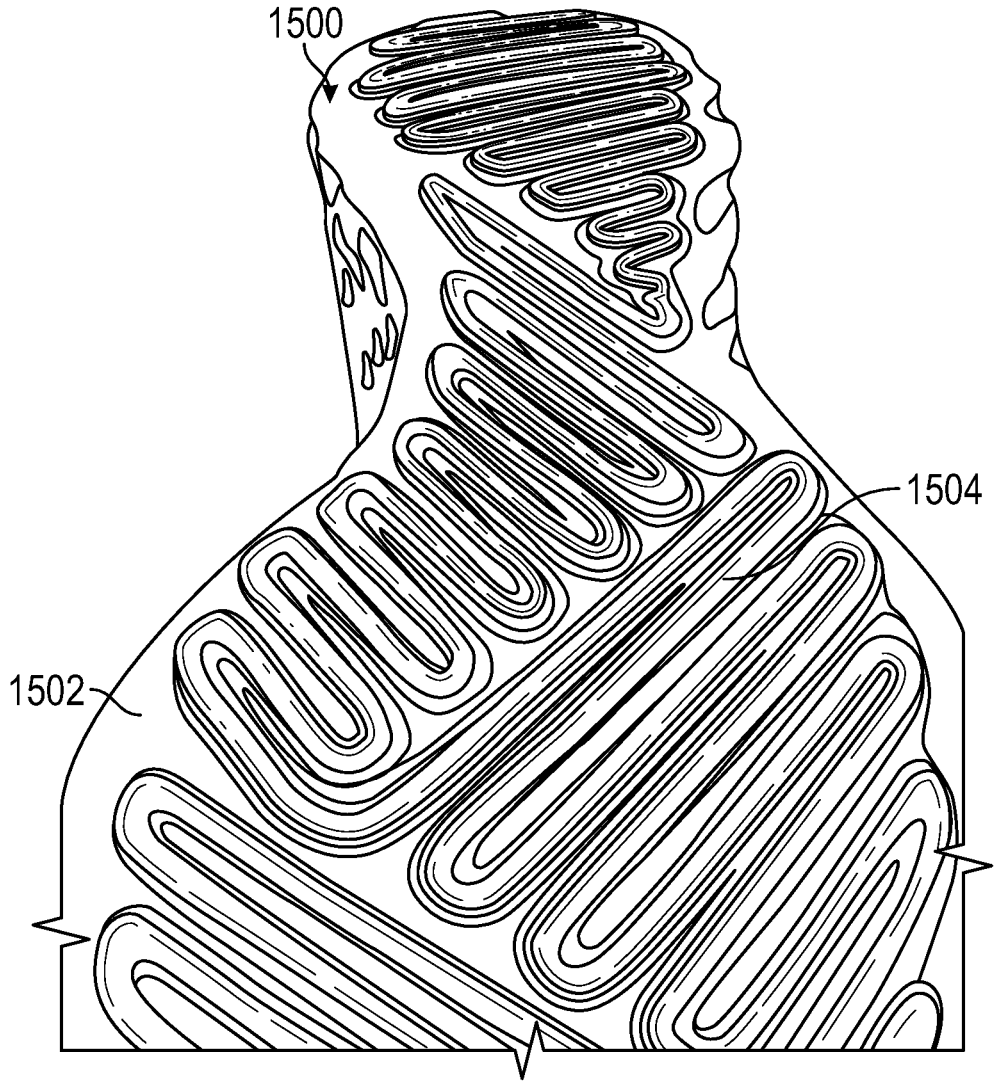
FIG. 21 depicts a partial perspective view of a sole structure for an article of footwear, according to another example.

FIG. 21 depicts a sole structure 1500, according to another example. The sole structure 1500 comprises a midsole 1502 and an outsole 1504 directly coupled to the midsole 1502.

The outsole 1504 comprises a plurality of layers arranged in a continuous serpentine path. The outsole 1504 comprises a plurality of regions. In each region, the layers of the outsole zigzag across the midsole in a particular orientation, which is different than the other regions.

Figure 22:
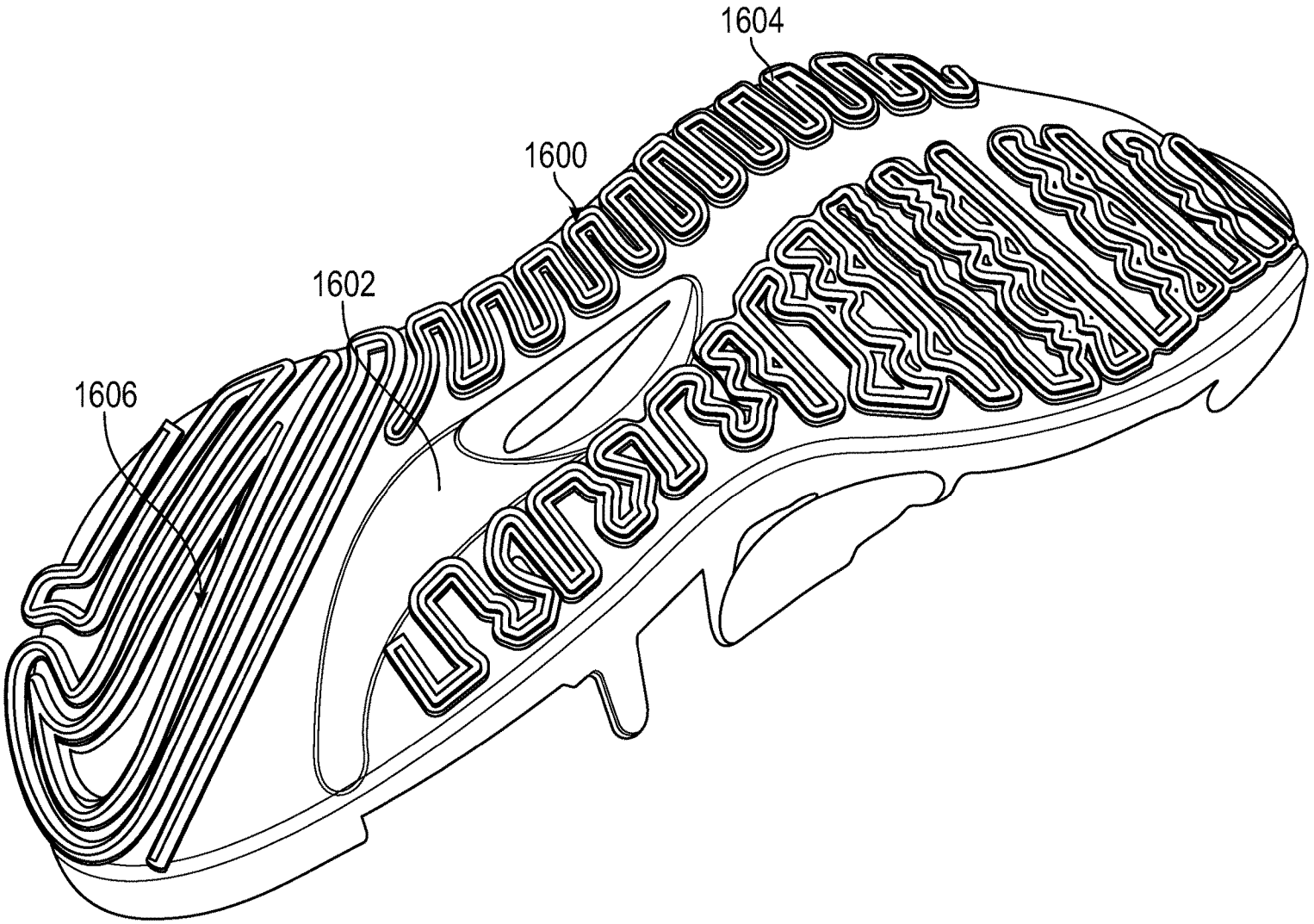
FIG. 22 depicts a perspective view of a sole structure for an article of footwear, according to another example.
Figure 23:
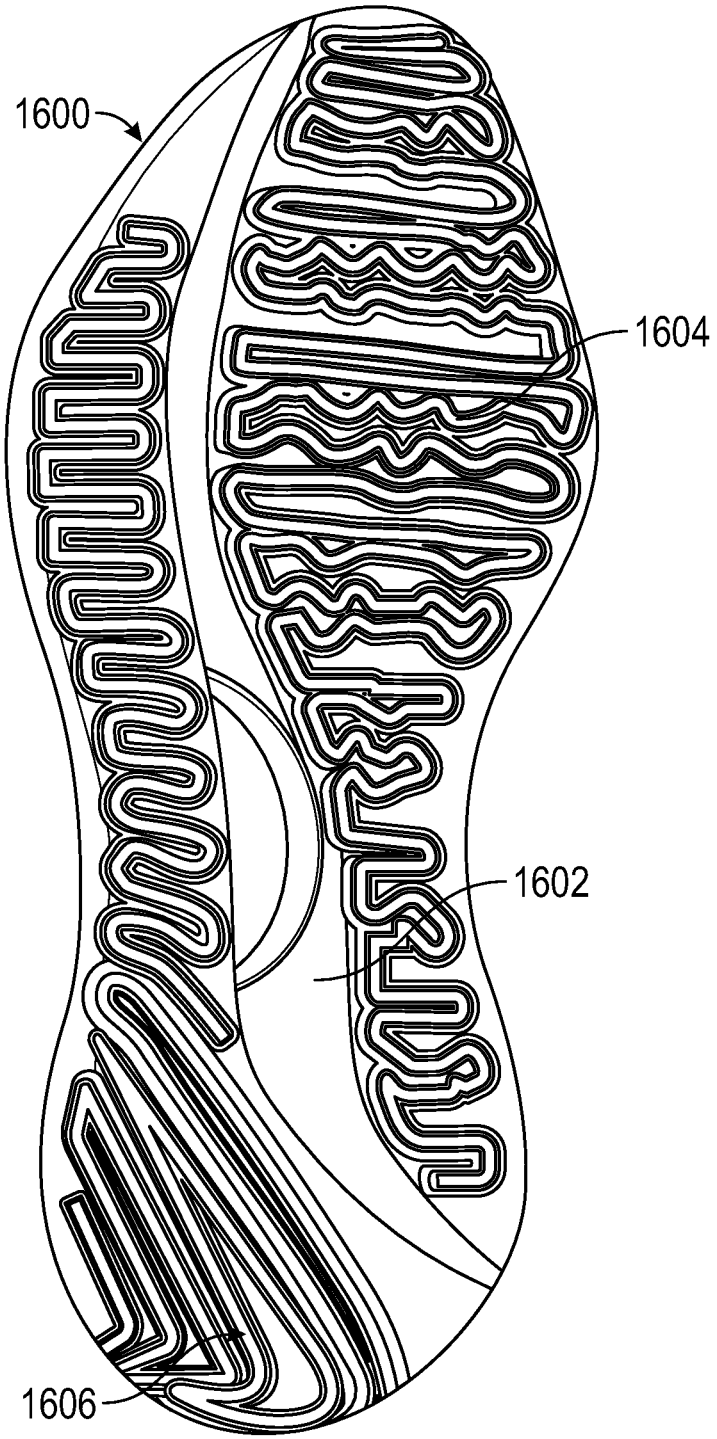
FIG. 23 depicts a bottom plan view of the sole structure of FIG. 22.
Figure 24:
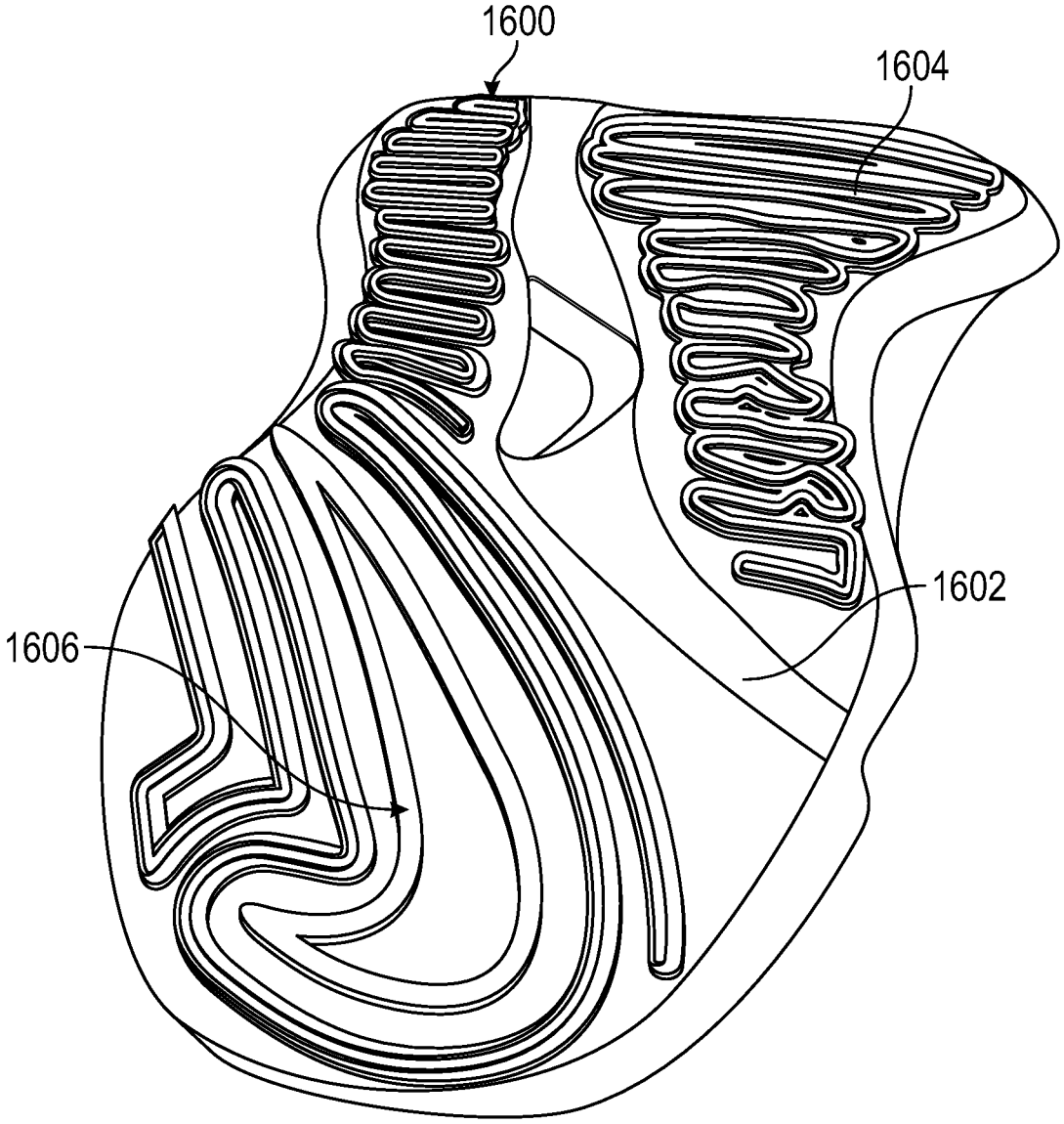
FIG. 24 depicts a perspective view of the sole structure of FIG. 22.

FIGS. 22-24 depict a sole structure 1600, according to another example. The sole structure comprises a midsole 1602 and an outsole 1604. The outsole 1604 comprises a plurality of printed layers.

An outsole can include one or more design elements (e.g., logos, shapes, symbols, etc.) integrated therein. For example, the outsole 1604 includes a logo 1606 (i.e., a Swoosh®) disposed at the heel region of the sole structure.

Figure 25:
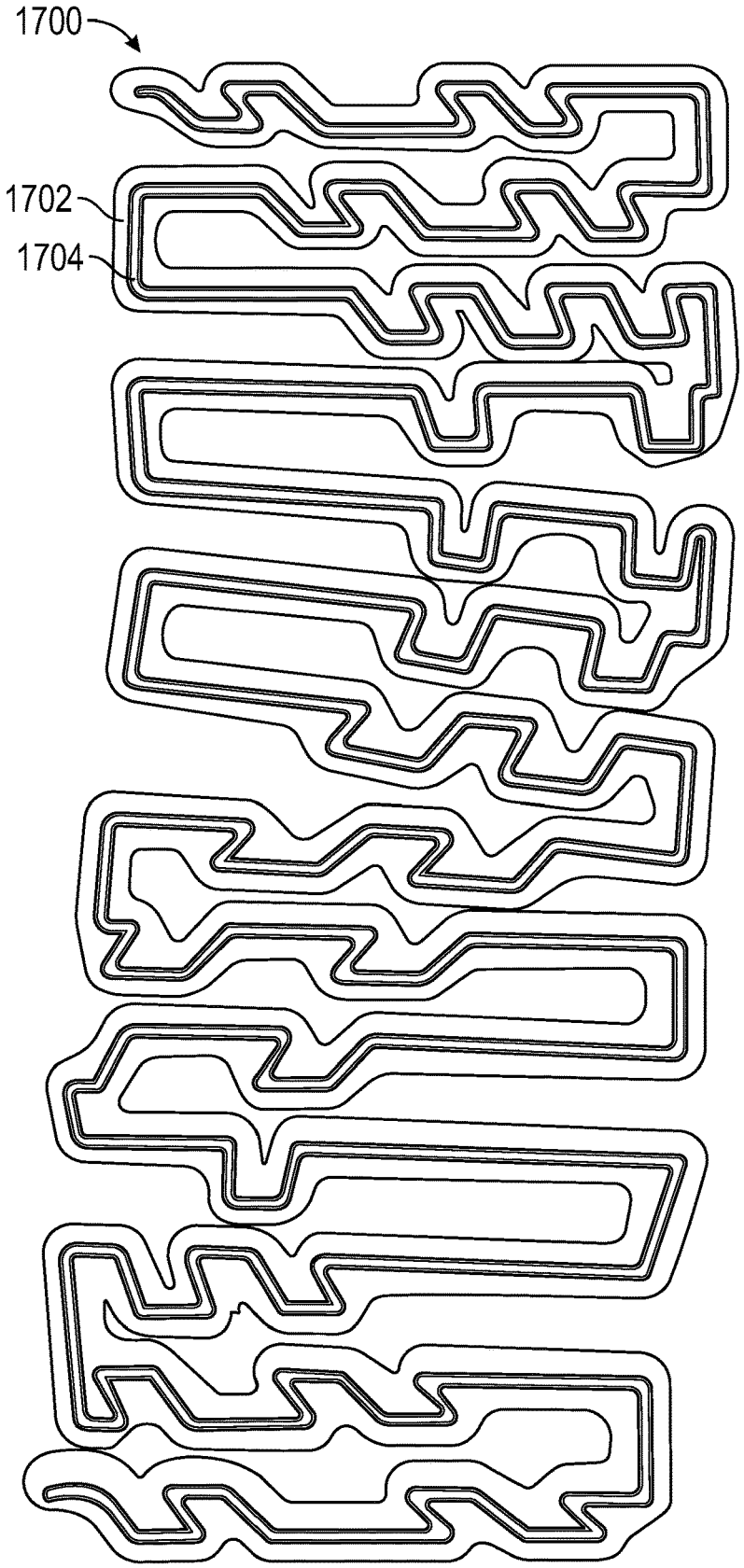
FIG. 25 depicts a bottom plan view of an outsole for an article of footwear, according to one example.

FIG. 25 depicts an outsole 1700, according to another example. The outsole 1700 comprises a first layer 1702 and a second layer 1704. Although not shown directly coupled to a midsole, the outsole 1700 (or any other outsole shown herein separated from an midsole) can be directly coupled (e.g., printed) to a midsole.

Figure 26:
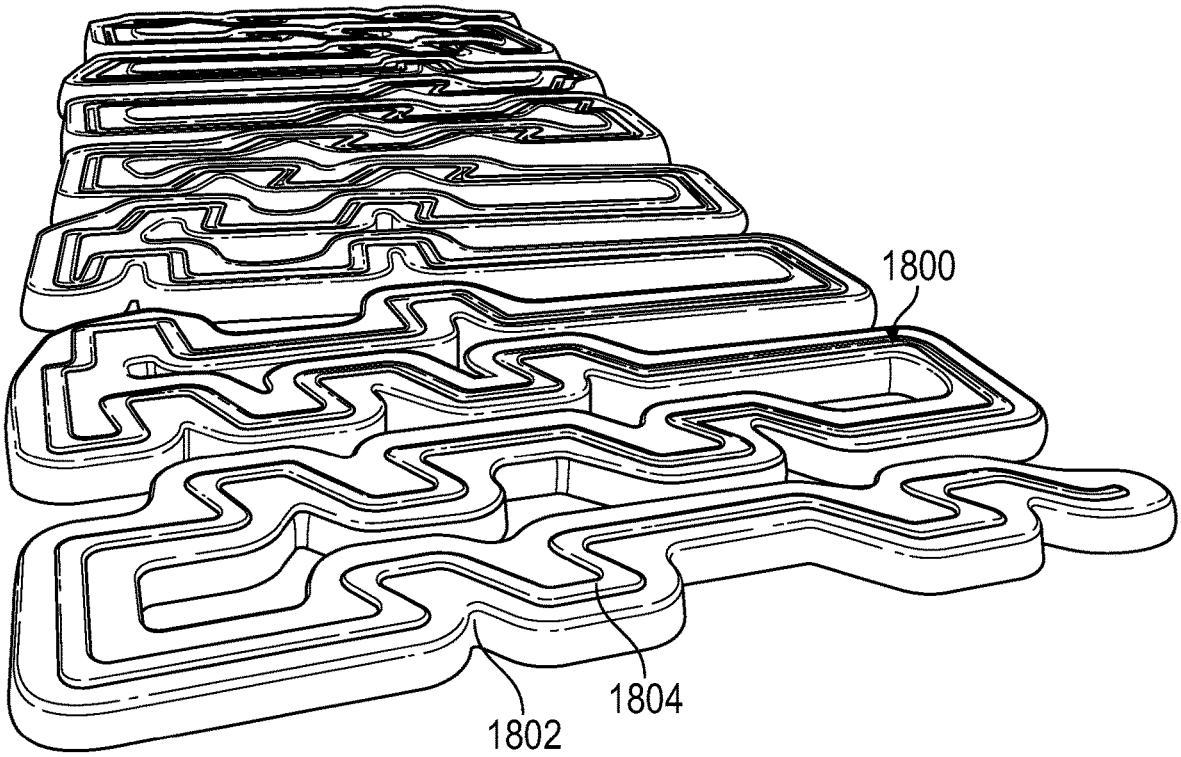
FIG. 26 depicts a perspective view of an outsole for an article of footwear, according to another example.

FIG. 26 depicts an outsole 1800, according to another example. The outsole 1800 comprises a first layer 1802 and a second layer 1804.

Figure 27:
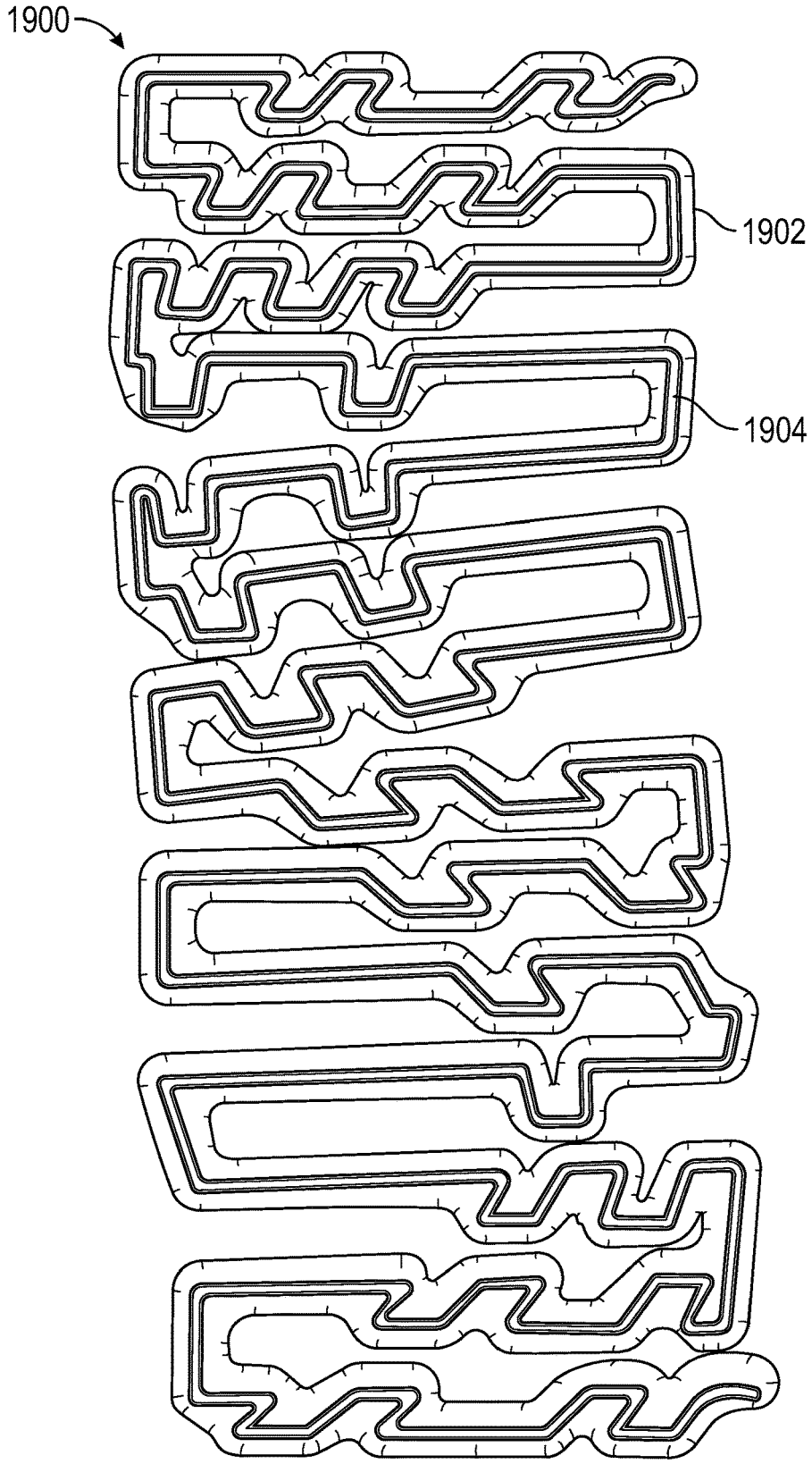
FIG. 27 depicts a bottom plan view of an outsole for an article of footwear, according to another example.
Figure 28:
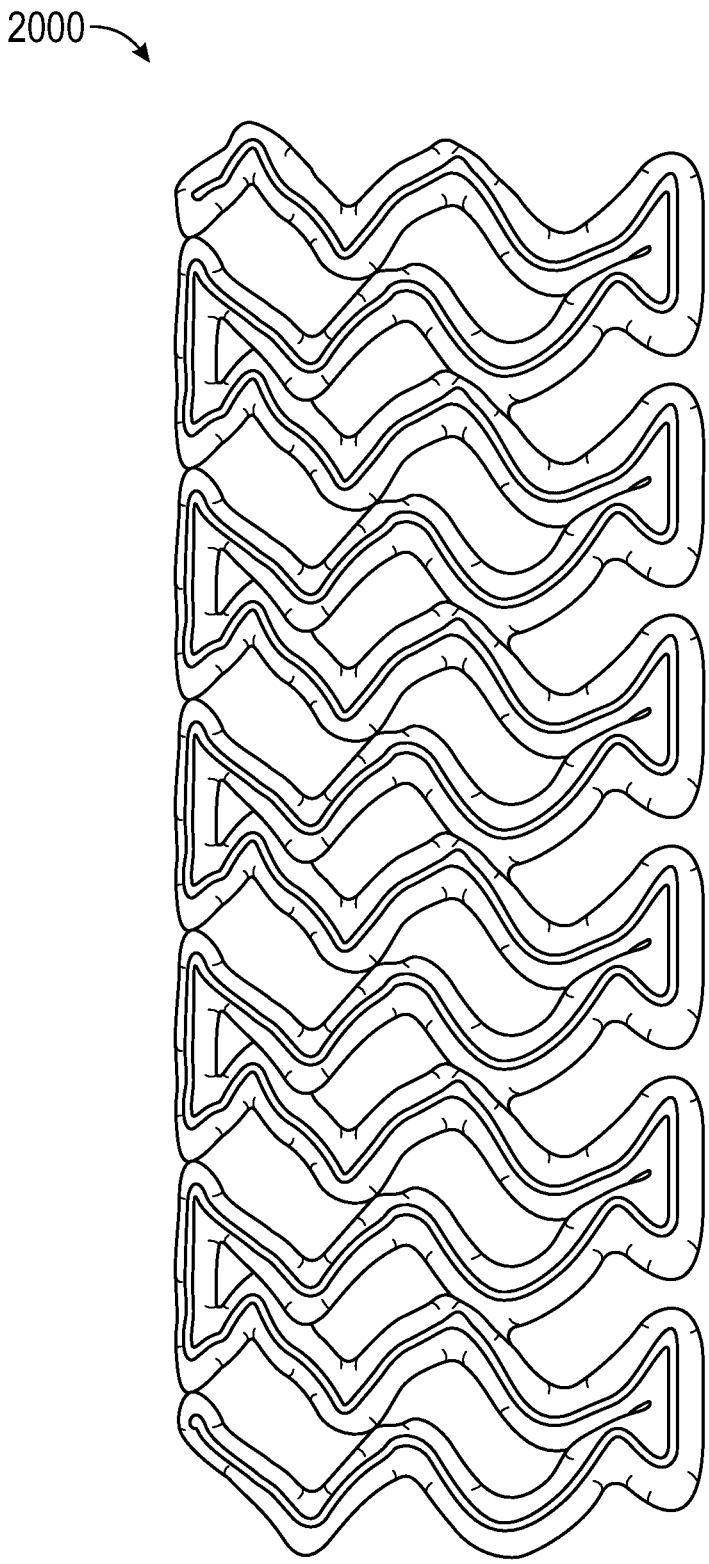
FIG. 28 depicts a perspective view of an outsole for an article of footwear, according to another example.
Figure 29:
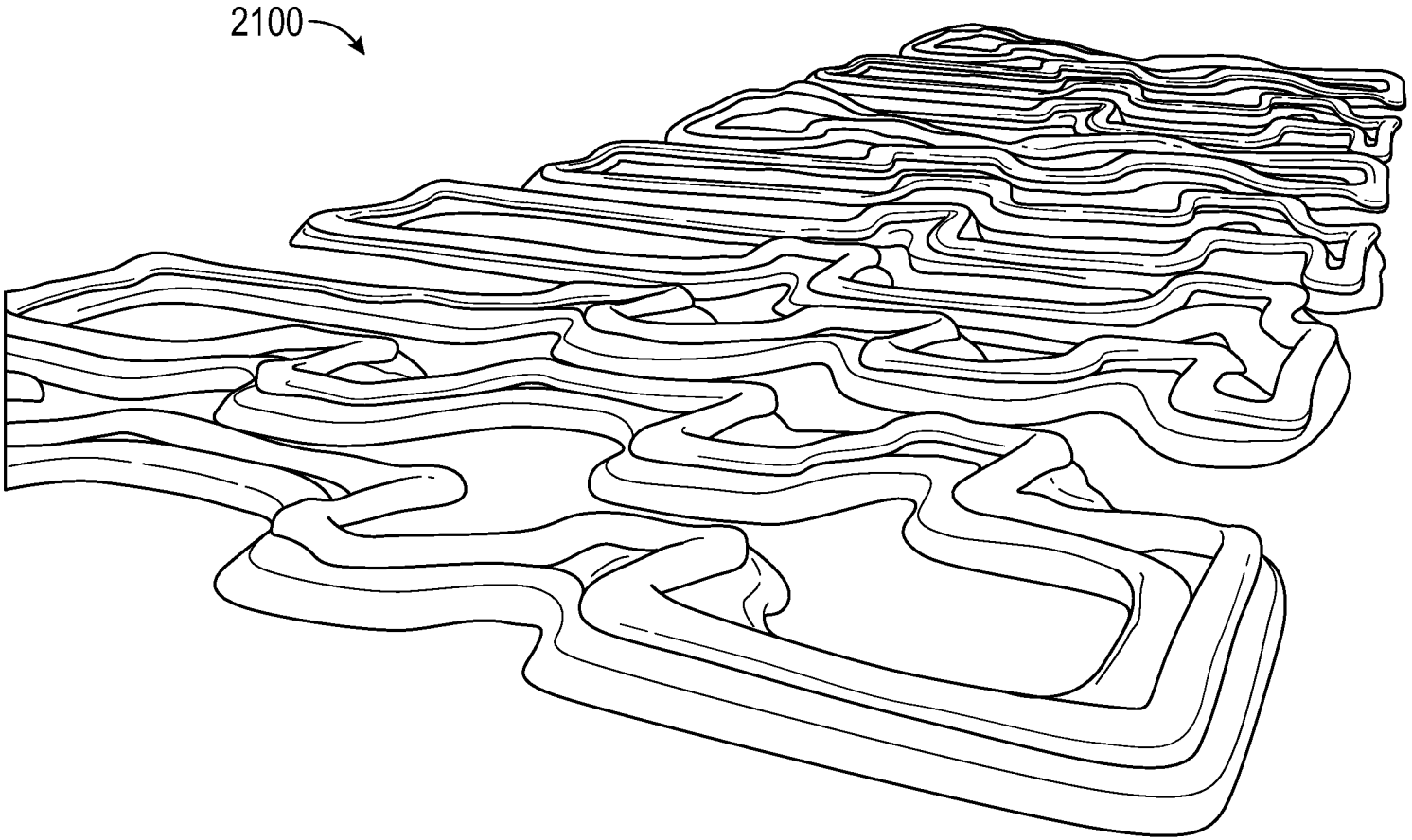
FIG. 29 depicts a partial perspective view of an outsole for an article of footwear, according to another example.

FIG. 27 depicts an outsole 1900, according to another example. The outsole 1900 comprises a first layer 1902 and a second layer 1904.

Figure 32:
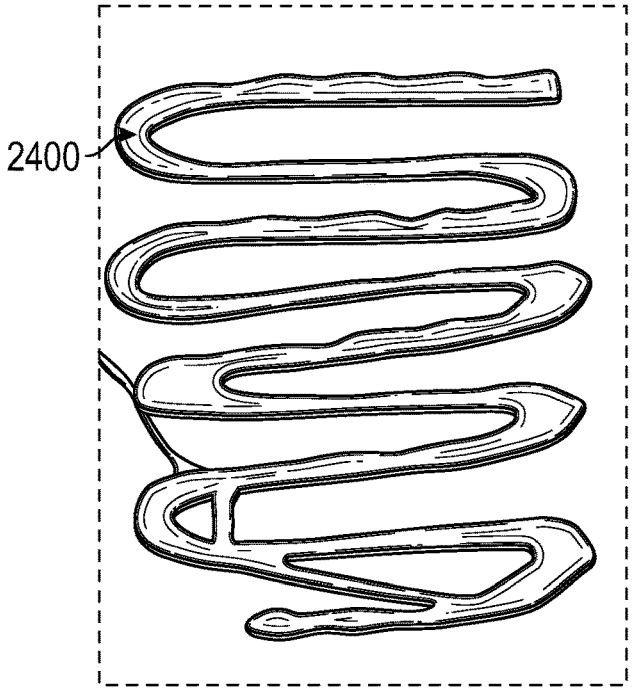
FIG. 32 depicts a partial bottom plan view of a sole structure for an article of footwear, according to another example.
Figure 33:
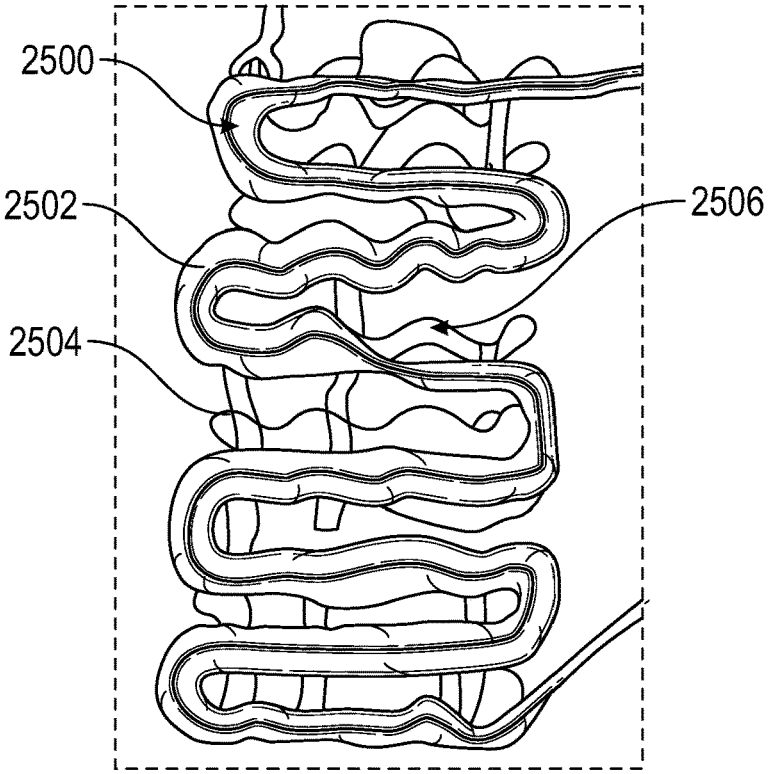
FIG. 33 depicts a partial bottom plan view of a sole structure for an article of footwear, according to another example.

FIGS. 28-36 depict various other outsoles (or at least portions of outsoles) for an article of footwear. The various configurations depicted herein can be used separately or combined, either in whole or in-part. Each configuration can provide its own advantages. For example, referring to FIG. 33, the outsole 2500 comprises a first layer 2502 and a second layer 2504. The first layer 2502 comprises a first serpentine pattern oriented in a first direction (i.e., left-right as depicted in FIG. 32), and the second layer 2504 comprises a second serpentine pattern oriented in a second direction (i.e., up-down as depicted in FIG. 33). The first and second patterns can be rotationally offset (e.g., by 90 degrees in the depicted example). This can, for example, help "tie" the layers together, which can reduce delamination.

As also depicted in FIG. 33, a midsole can comprise one or more recesses 2506. The outsole 2500 can extend into the recesses 2506 of the midsole, which can improve bonding and reduce delamination (e.g., particularly against shear forces exerted on the outsole 2500).

Figure 34A:
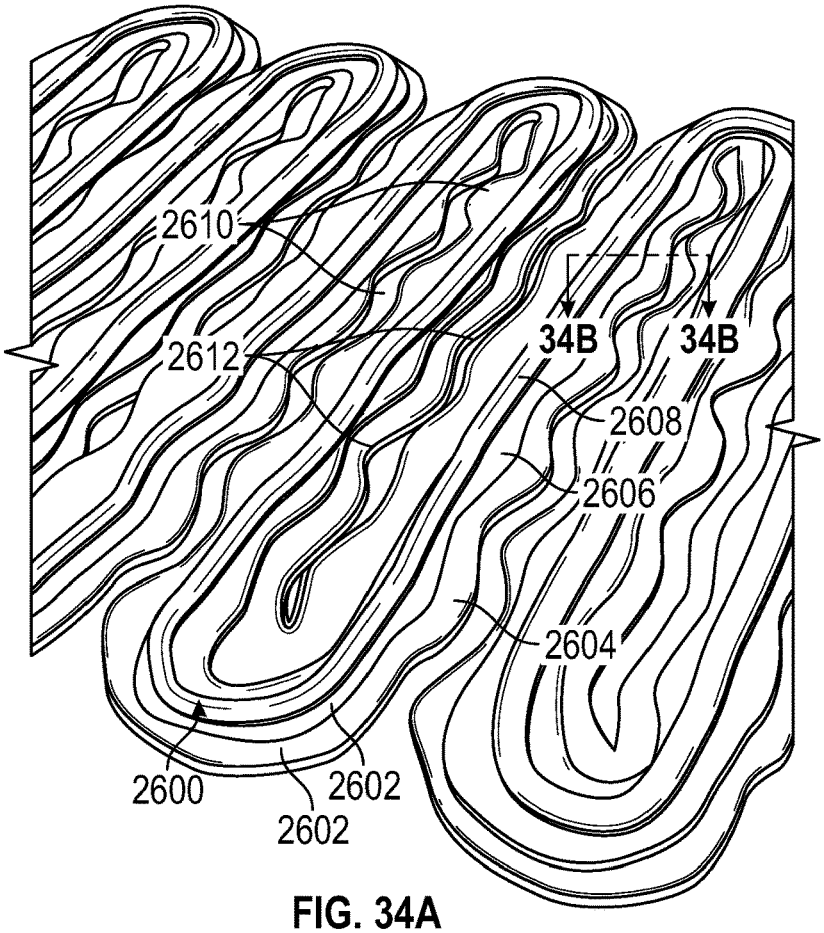
FIG. 34A depicts a partial perspective view of an outsole for an article of footwear, according to another example.
Figure 34B:
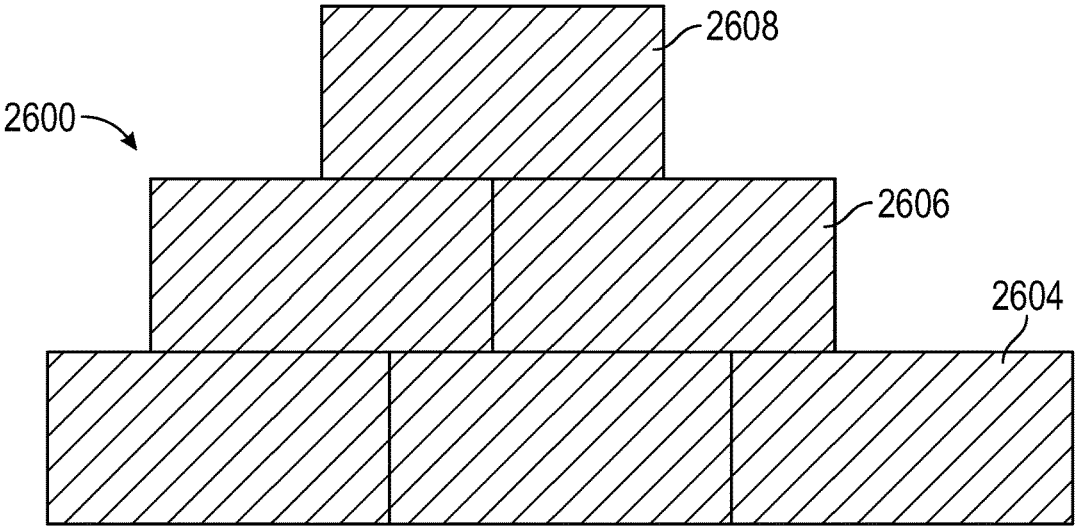
FIG. 34B depicts a schematic cross-sectional view of the outsole of FIG. 34A, taken along the line 34B-34B depicted in FIG. 34A.
Figure 35A:
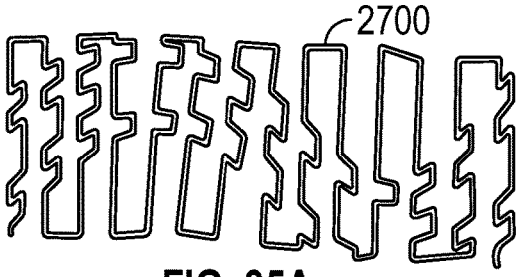
FIGS. 35A-35J depicts perspective views of several exemplary outsole for articles of footwear.
Figure 35F:
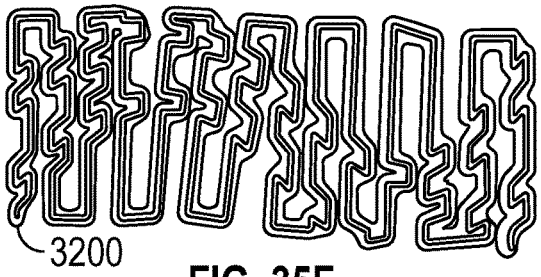
Figure 35B:
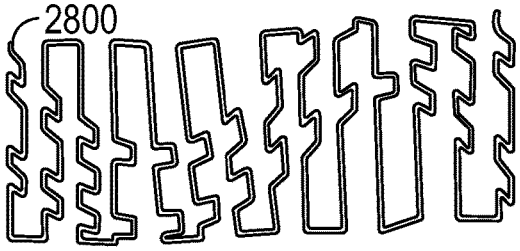
Figure 35G:
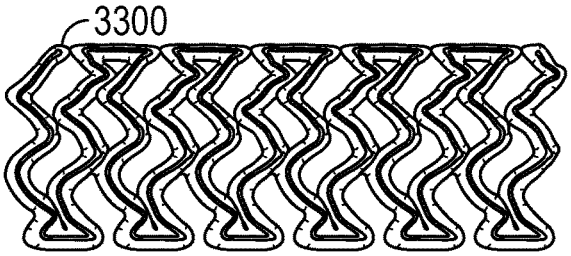
Figure 35C:
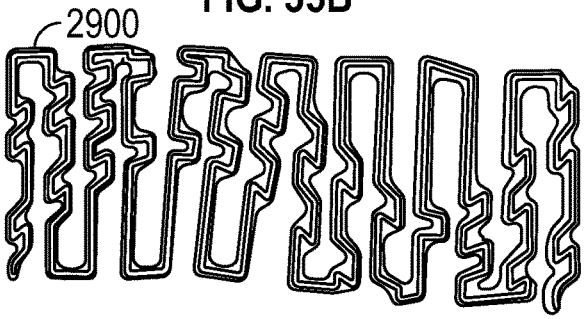
Figure 35H:
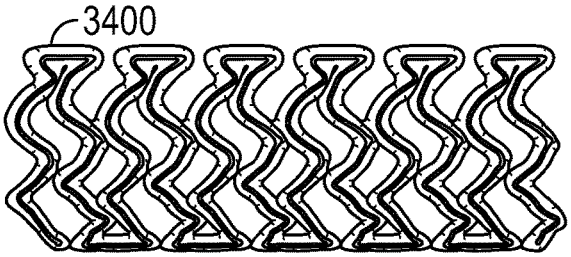
Figure 35D:
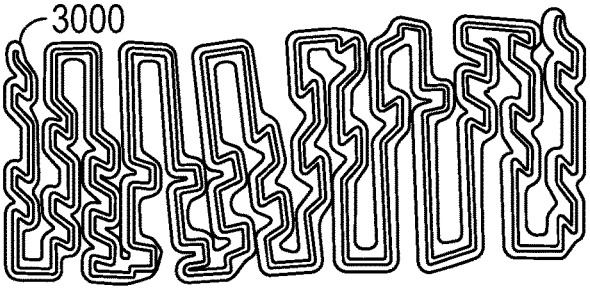
Figure 35I:
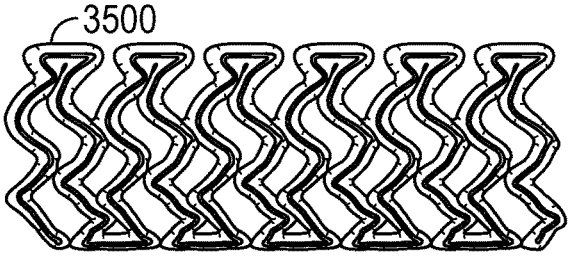
Figure 35E:
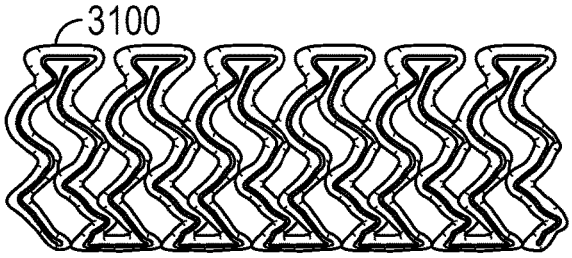
Figure 35J:
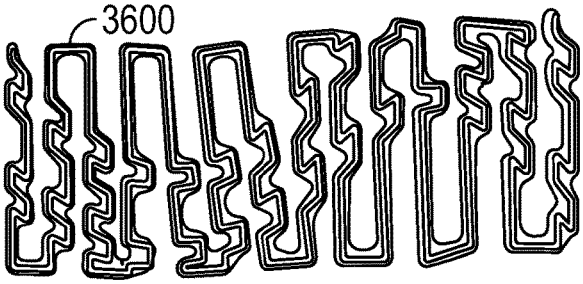
Figure 36:
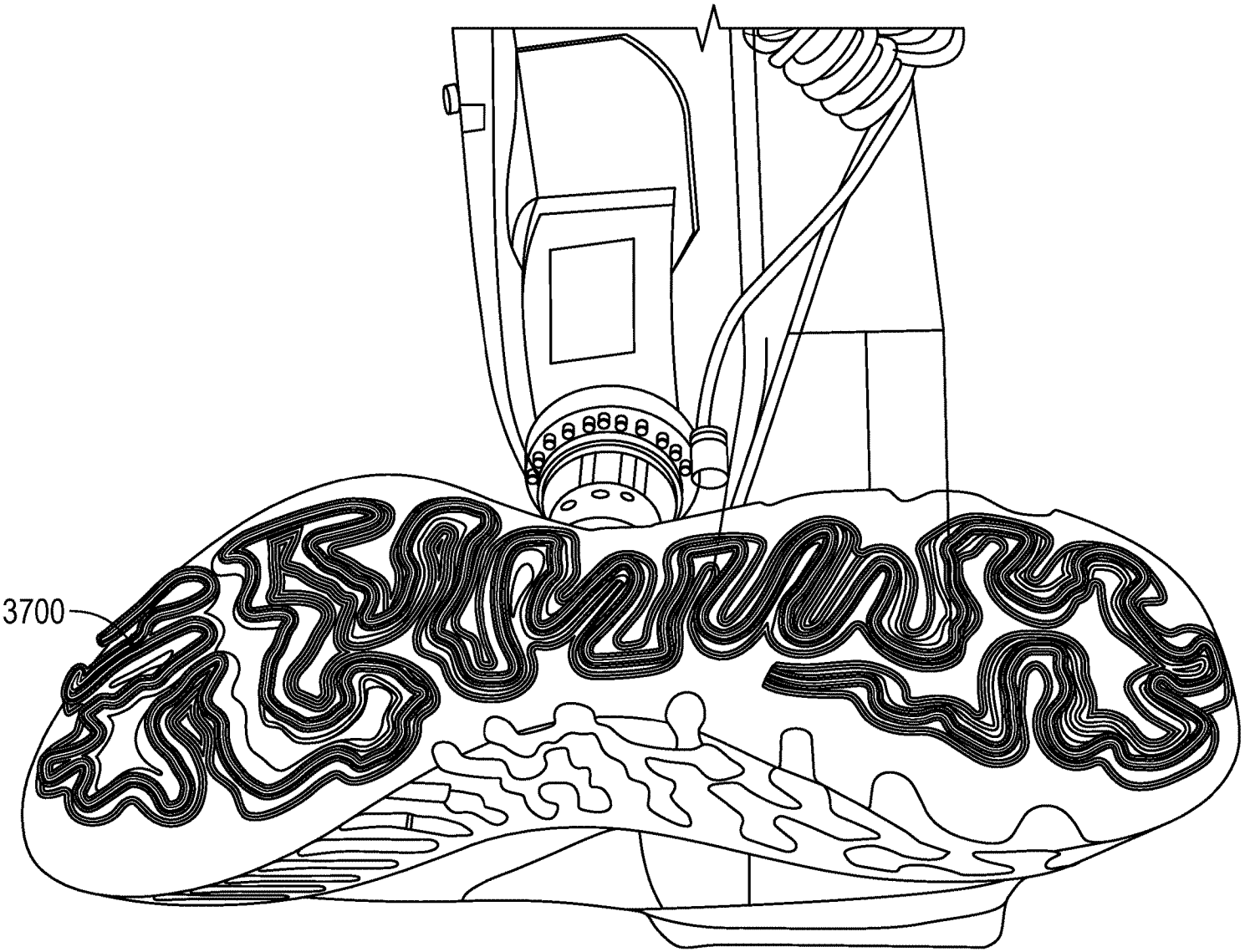
FIG. 36 depicts a perspective view of an exemplary sole structure for an article of footwear with the sole structure releasably coupled to a holder element of an exemplary sole structure printing station.

As another example, the outsole 2600 depicted in FIG. 34A comprises three layers that form a plurality of thin ribs 2602 at the edges of each layer. The ribs 2602 can, for example, provide a textured outer surface, which improves traction. A first, base layer 2604 of the outsole 2600 is formed via three adjacent print passes, which can be deposited directly onto a midsole. A second, intermediate layer 2606 of the outsole 2600 is formed via two adjacent print passes deposited directly onto the first layer 2604. The second layer 2606 is narrower than the first layer 2604. A third, outermost layer 2608 is formed via one print pass deposited directly onto the second layer 2606. The third layer 2608 is narrower than the second layer 2606 and the first layer 2604. In this manner, the outsole 2600 comprises a stepwise (or pyramid-like) cross-sectional profile taken in a plane perpendicular to the print path, as depicted schematically in FIG. 34B. As depicted in FIG. 34A, the width of each layer varies in a wide-narrow-wide-narrow manner. The wider segments 2610 of each layer can be formed, for example, by using a slower relative speed between the printhead and the midsole and/or increasing the flow rate of the print material. The narrower segments 2612 of each layer can be formed, for example, by using a faster relative speed between the printhead and the midsole and/or decreasing the flow rate of the print material.

Figure 37:
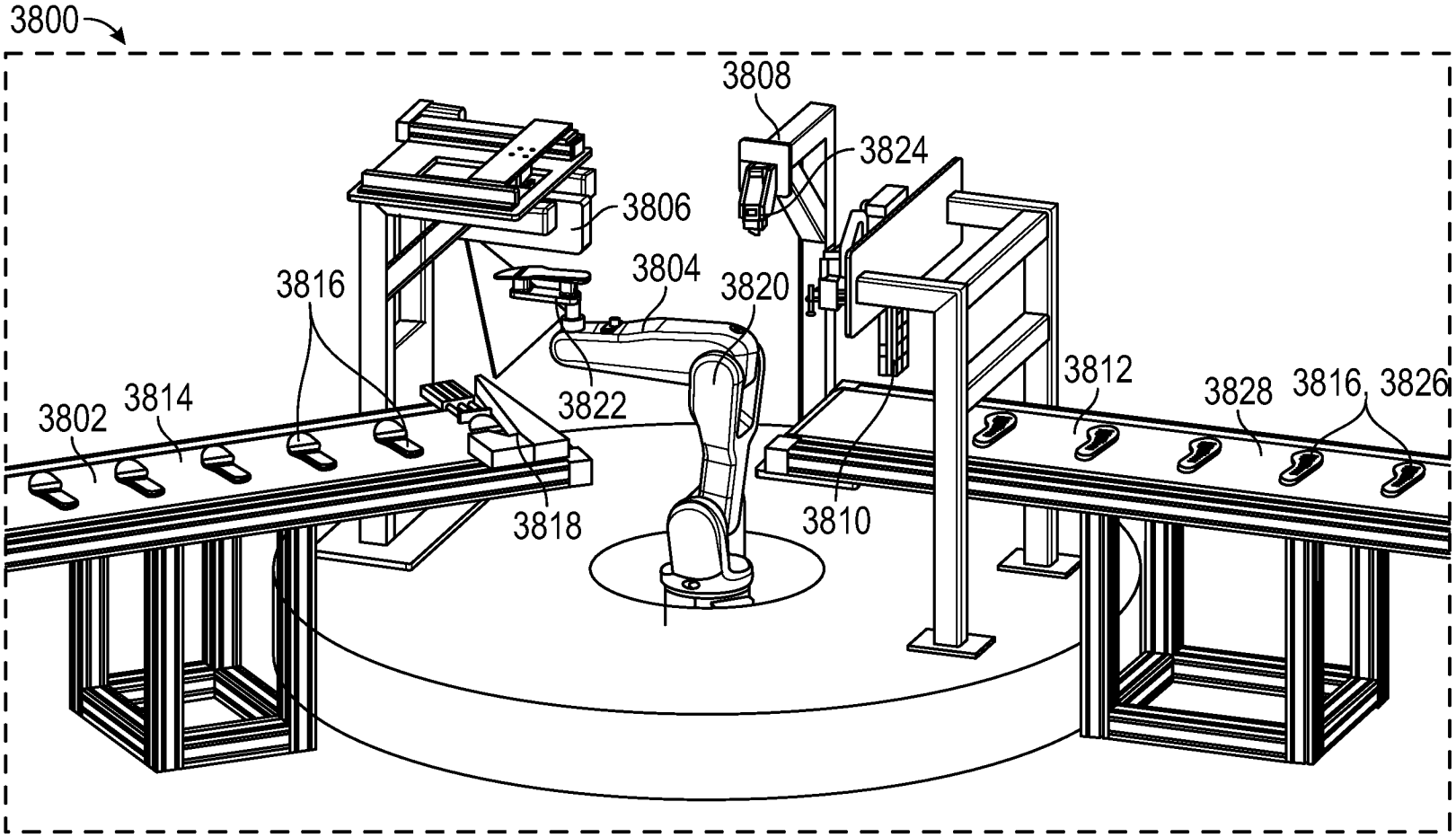
FIG. 37 depicts a perspective view of a sole structure printing station, according to one example.
Figure 38:
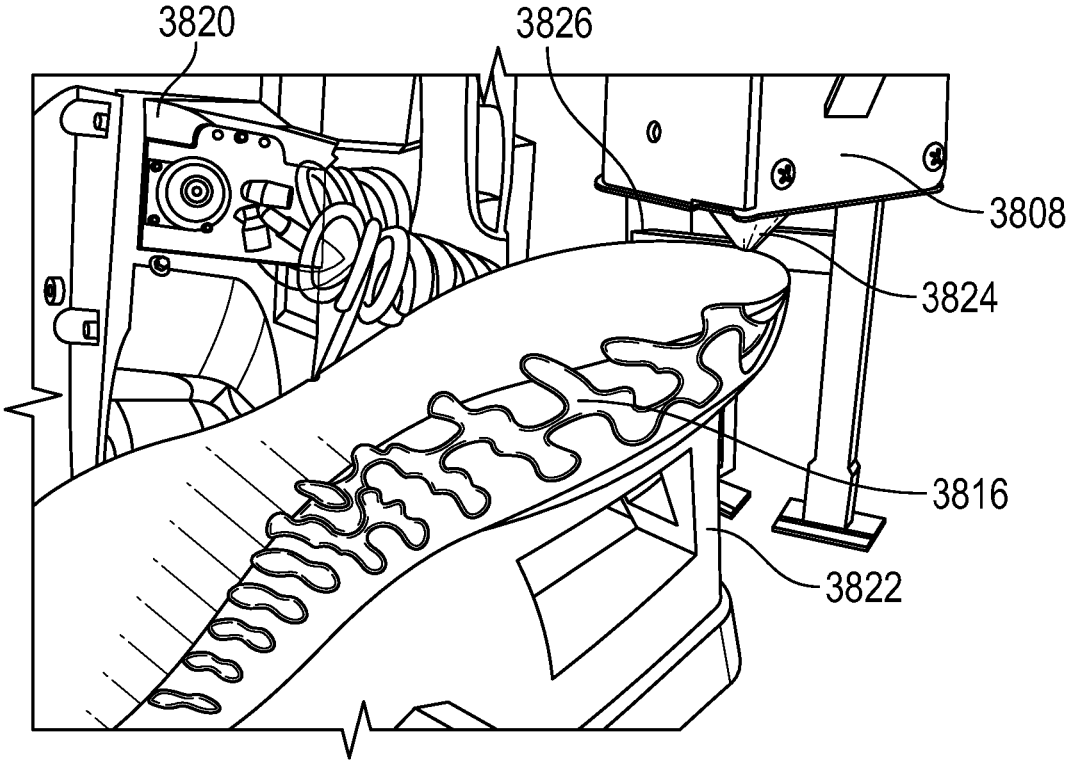
FIGS. 38-43 depict an exemplary process for printing an outsole of a sole structure onto a midsole of a sole structure using the sole structure printing station of FIG. 37.
Figure 39:
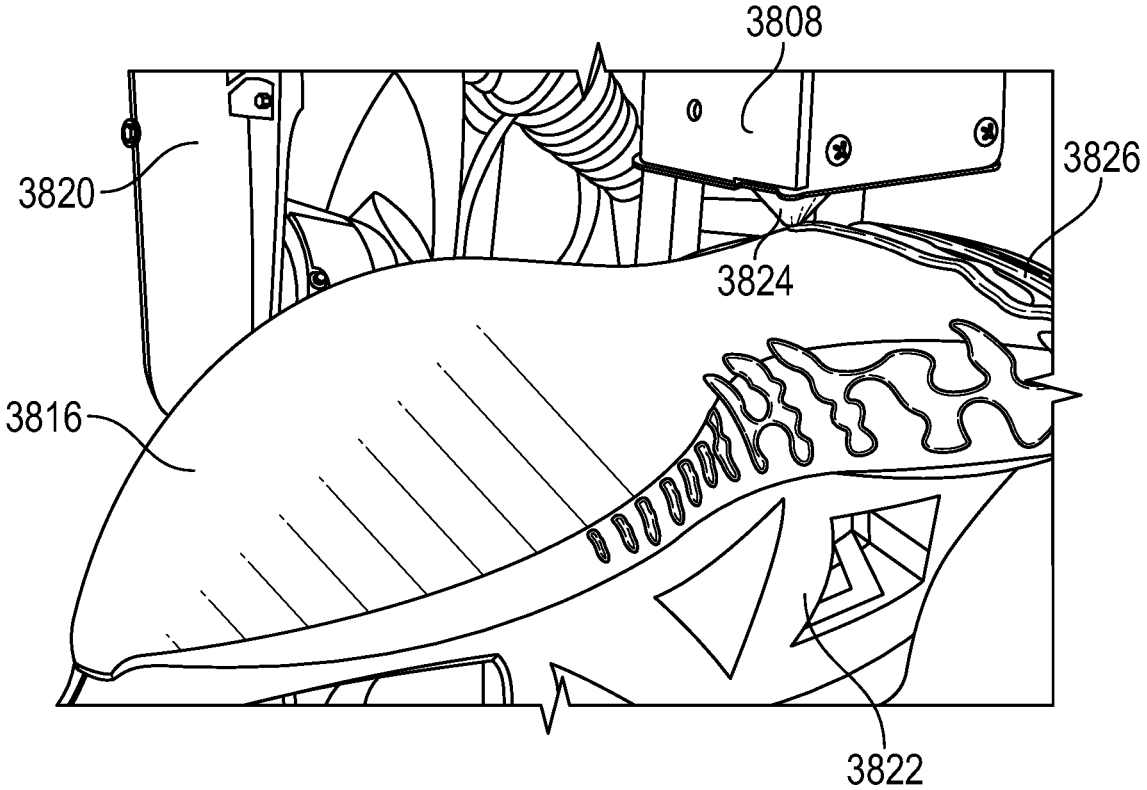
Figure 40:
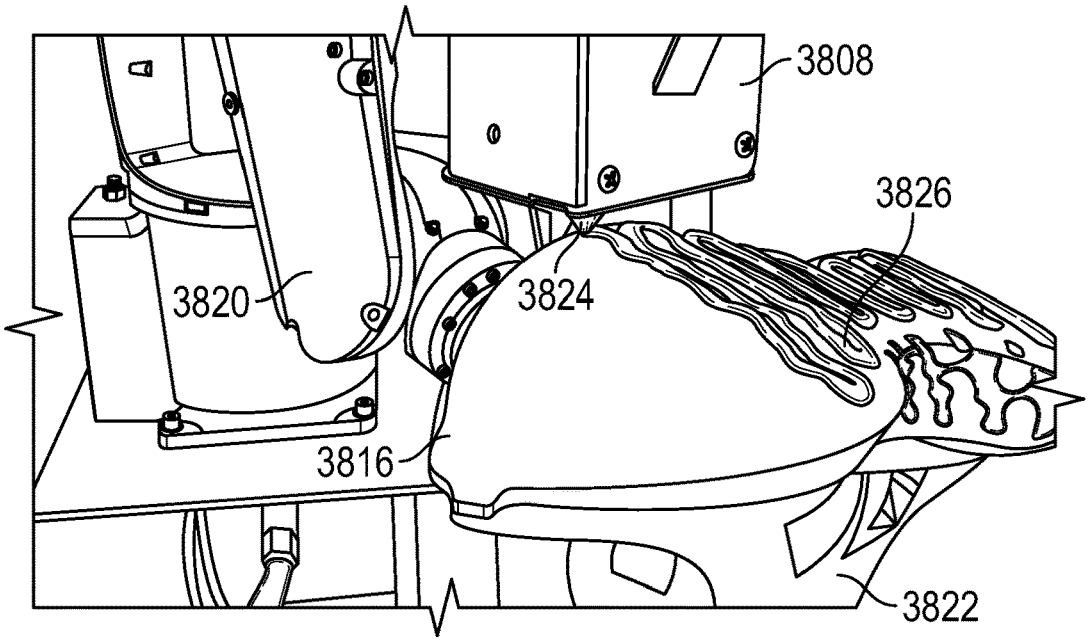
Figure 41:
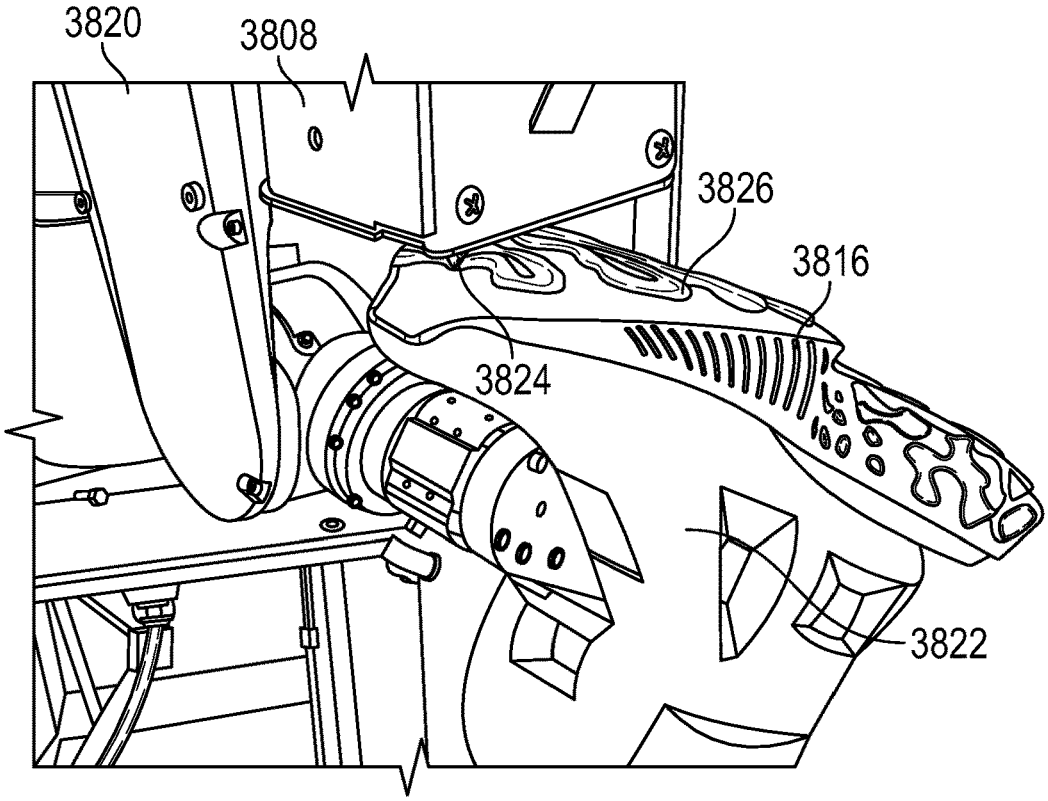
Figure 42:
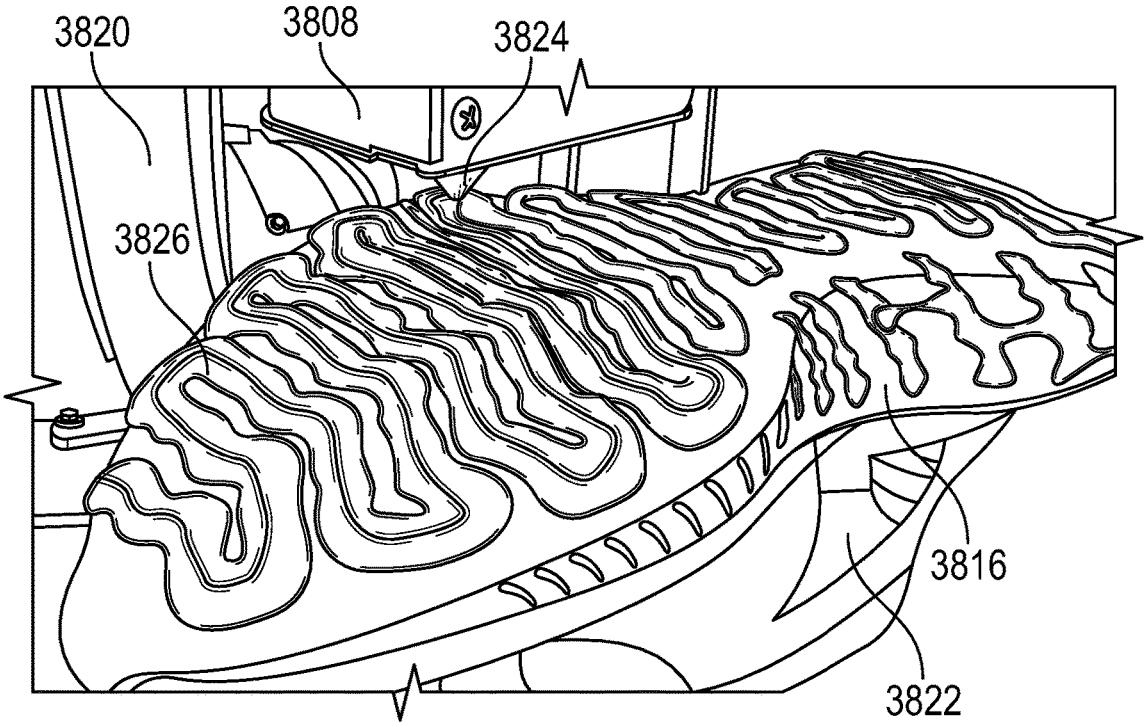
Figure 43:
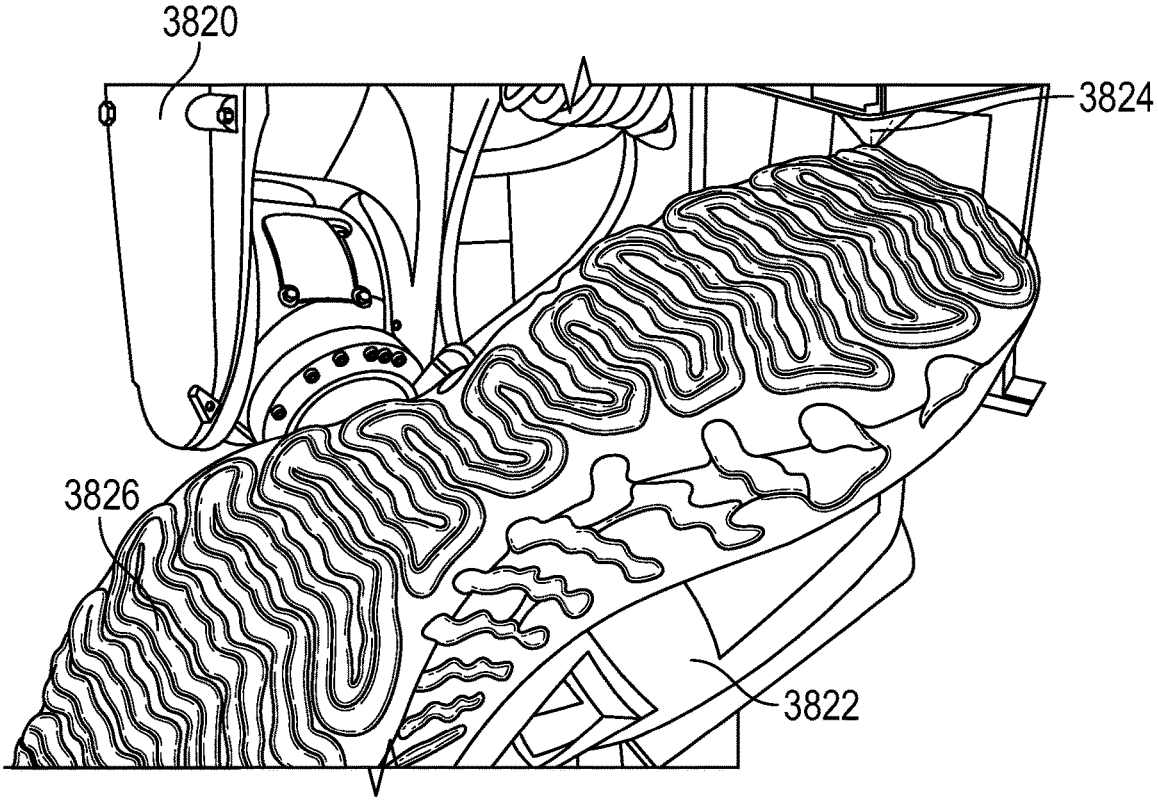

FIG. 37 depicts a portion of a sole structure printing station 3800, according to one example. The sole structure printing station 3800 comprises a loading apparatus 3802, a sole manipulation apparatus 3804, a scanning apparatus 3806, a printing apparatus 3808, an inspection apparatus 3810, and an unloading apparatus 3812. It should be noted that one or more of the components of the sole structure printing station 3800 can be omitted. For example, the loading apparatus 3802, the scanning apparatus 3806, the inspection apparatus 3810, and/or the unloading apparatus 3812 can be omitted, and the tasks performed at these stages can be performed manually.

The loading apparatus 3802 of the sole structure printing station 3800 can, in some instances, include one or more conveyor belts 3814 (e.g., one in the depicted example). One or more midsoles 3816 can be disposed on the conveyor belts 3814, and the conveyor belts 3814 can be configured to transport the midsoles 3816 from an input location to a location in which the midsoles 3816 can be releasably coupled to the sole manipulation apparatus 3804. In some examples, the loading apparatus 3802 can include one or more positioning members 3818 (e.g., jigs) configured to align the midsoles 3816 to a predetermined position prior to attaching the midsoles 3816 to the sole manipulation apparatus 3804.

The sole manipulation apparatus 3804 of the sole structure printing station 3800 is configured to move each midsole 3816 from the loading apparatus 3802, to the scanning apparatus 3806, to the printing apparatus 3808, to the inspection apparatus 3810, and/or to the unloading apparatus 3812. The sole manipulation apparatus 3804 can comprise one or more robotic arms 3820 (e.g., one in the depicted example) and holder element 3822. In certain examples, a robotic arm can be a multi-axis robotic arm (e.g., a six-axis robotic arm). The holder element 3822 can be coupled to the robotic arm 3820 and is configured to have a midsole 3816 releasably coupled thereto. The robotic arm 3820 can move the holder element 3822 and/or the midsoles 3816 relative to the other components of the sole structure printing station 3800.

The holder element 3822 can, for example, be a last, a clamp, and/or other structure to which the midsoles 3816 can be releasably coupled. For example, in some instances, the holder element can releasably couple the midsoles thereto via vacuum. In other examples, various other types of holding devices can be used (e.g., mechanical, pneumatic, magnetic, etc.).

The scanning apparatus 3806 of the sole structure printing station 3800 can be configured to determine one or more properties of the midsole. For example, the one or more properties can include dimensions (e.g., size, width, etc.), material type of the midsole (e.g., EVA, PEBA, TPU, etc.), surface condition (e.g., clean/unclean and/or primed/non-primed), to name a few. In some examples, the scanning apparatus can generate a three-dimensional model of the midsole. The three-dimensional model can be used, for example, by the printing apparatus to print an outsole onto the midsole. The scanning apparatus can include one or more sensors and/or one or more cameras.

Prior to scanning a midsole, the midsole can, in some instances, be cleaned and/or primed. The cleaning and/or priming process can prepare the surface of the midsole for printing. In some examples, a solvent-based primer can be used. The cleaning and/or priming process can, in some instances, expand the foam material at least slightly. The expanded foam can, for example, allow the printed material to penetrate further into the foam material, thereby improving the bonding between the midsole and outsole.

In other examples, a midsole can have an outsole printed thereon without any cleaning and/or priming. As one example, a midsole comprising TPU can, in some instances, have an outsole comprising TPU printed thereon without prior cleaning and/or priming.

The printing apparatus 3808 of the sole structure printing station 3800 can be configured to deposit one or more print materials directly onto a midsole. The printing apparatus 3808 can comprise a print nozzle 3824 (which can also be called a "printhead"), a heating element, a print material feeder system (e.g., a spool, a hopper, etc.), a flow control mechanism, and/or other components for depositing molten or semi-molten outsole material directly onto the midsole.

In some examples, the printing apparatus can be configured to move in one or more directions (in lieu of or in addition to the sole manipulation apparatus 3804 being movable). For example, in some instances, the printing apparatus (e.g., the print nozzle) can move in an x-direction, a y-direction, and/or a z-direction. In other examples, the printing apparatus can be stationary and the sole manipulation apparatus 3804 can be used to move the midsole relative to the printing apparatus 3808.

In some examples, the printing apparatus can comprise a single print nozzle. In other examples, the printing apparatus can comprise a plurality of print nozzles. In some such example, each print nozzle can be configured to deposit a different print configuration. For example, a first print nozzle can be configured to deposit a first thermoplastic material (e.g., directly onto a midsole to form a base layer of an outsole), and a second print nozzle can be configured to deposit a second thermoplastic material (e.g., directly onto the base layer of the outsole to form a ground-contacting layer of the outsole). The print nozzles can deposit various thermoplastic materials, at various flow rates, and/or have various nozzle shapes. Examples of suitable thermoplastic materials include TPU, thermoplastic polyolefins, thermoplastic PEBAs, and combinations thereof.

As one example, FIGS. 38-43 depict the printing apparatus 3808 depositing a printed outsole material 3826 directly onto the midsole 3816. The midsole 3816 is releasably coupled to the holder element 3822 is moved relative to the print nozzle 3824 via the robotic arm 3820.

The print nozzles can deposit various print materials, at various deposition temperatures, at various flow rates, various nozzle shapes/sizes, and/or have various nozzle spacing from the midsole to achieve the desired print configuration and/or bonding with the midsole and/or between segments/layers of the outsole. As discussed above, various types of thermoplastic can be used.

The deposition temperature at which the printed outsole material is deposited on the midsole can vary based on one or more factors such as material type of the print material, material type of the midsole, desired shape/dimensions of the print layer, etc. Generally speaking, the deposition temperature of the printed outsole material for a certain material type will be at least slightly hotter than the temperature of a molded outsole material of the same material type. The deposition temperature of the printed material can be hot enough to flow from the print nozzle and to bond with the midsole and cool enough not to deform or degrade the midsole material. For example, in some instances, the deposition temperature of the printed outsole material can be within a range of 150-300° C. when the print material is at or adjacent the print nozzle. In other example (such as when printing an outsole comprising TPU onto a midsole comprising polyolefin), the deposition temperature of the printed outsole material can be within a range of 180-250° C., or optionally 215-250° C. or 225-245° C. when the print material is at or adjacent the print nozzle.

The flow rate of the print material can also be altered to achieve the desired print configuration and/or bonding. Some exemplary flow rates of the print material that can be used include flow rates within a range of 0.25-1.0 g/s. In certain examples, the flow rate can be within a range of 0.3-0.8 g/s. In particular examples, the flow rate can be within a range of 0.3-0.8 g/s, or within a range of 0.4-0.6 g/s.

In some examples, the print nozzle can comprise a circular opening and/or have a 1.5 mm opening. In other examples, the print nozzle can comprise various other shapes (e.g., rectangular, ovular, etc.) and/or sizes (e.g., 0.5-10 mm).

In some examples, the print nozzle can be spaced apart from the midsole by less than 5 mm. In certain examples, the print nozzle can be spaced apart from the midsole by 0.5-2 mm. In particular examples, the print nozzle can be spaced apart from the midsole by a distance of 0.6-1.6 mm.

Referring again to FIG. 37, after printing, the sole manipulation apparatus 3804 can be configured to position and/or release the sole structure at the inspection apparatus 3810. The inspection apparatus 3810 can be configured to provide an operator and/or a computing device with information about the printed outsole and/or the sole structure (e.g., midsole and outsole). The inspection apparatus 3810 can include one or more sensors and/or one or more cameras.

The unloading apparatus 3812 of the sole structure printing station 3800 can, in some instances, include one or more conveyor belts 3828 (e.g., one in the depicted example). One or more sole structure assemblies (e.g., the midsoles 3816 with the printed outsole material 3826 disposed thereon) can be disposed on the conveyor belts 3828, and the conveyor belts 3828 can be configured to transport the sole structure assemblies from the inspection apparatus 3810 to another location (e.g., a location at which an upper is attached to the sole structure).

Although the sole structure printing station 3800 is configured to print an outsole onto a midsole that is not yet coupled to an upper, in other examples, the sole structure printing station 3800 can be configured to print an outsole onto an article of footwear comprising an upper and a midsole.

In some examples, the sole structure printing station can be configured to print an outsole onto an article of footwear as part of manufacturing a new article of footwear. In other examples, the sole structure printing station can be configured to print an outsole onto an article of footwear that has (or previously had) an outsole. In other words, the sole structure printing station can be used to re-sole an article of footwear. In this manner, the devices and methods disclosed herein can, for example, reduce waste by allowing an article of footwear with a worn outsole to be re-soled rather than discarded.

Figure 44:
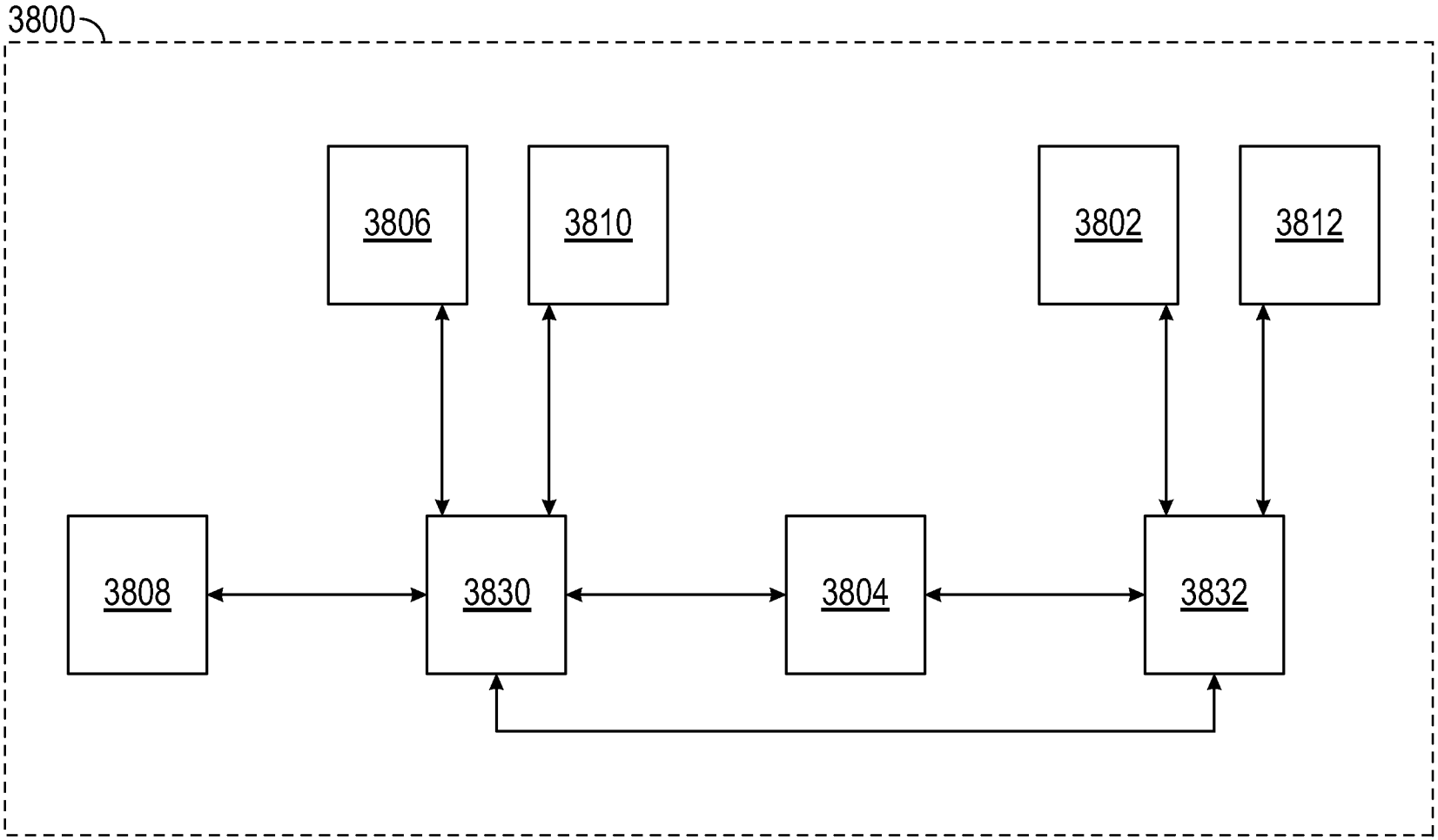
FIG. 44 depicts a schematic representation of the sole structure printing station of FIG. 37.

FIG. 44 depicts additional components that can be coupled to the sole structure printing station 3800. For example, the sole structure printing station can comprise one or more computer and/or controller devices such as a computing system 3830 and a programmable logic controller 3832.

A sole structure printing station can also comprise one or more additional components. For example, one or more apparatus can be provided to help the printed material solidify (e.g., between printing each layer and/or after the printing process is complete). Exemplary devices include heated chambers (e.g., for print annealing), fans, heating elements, dryers, etc.

Figure 45:
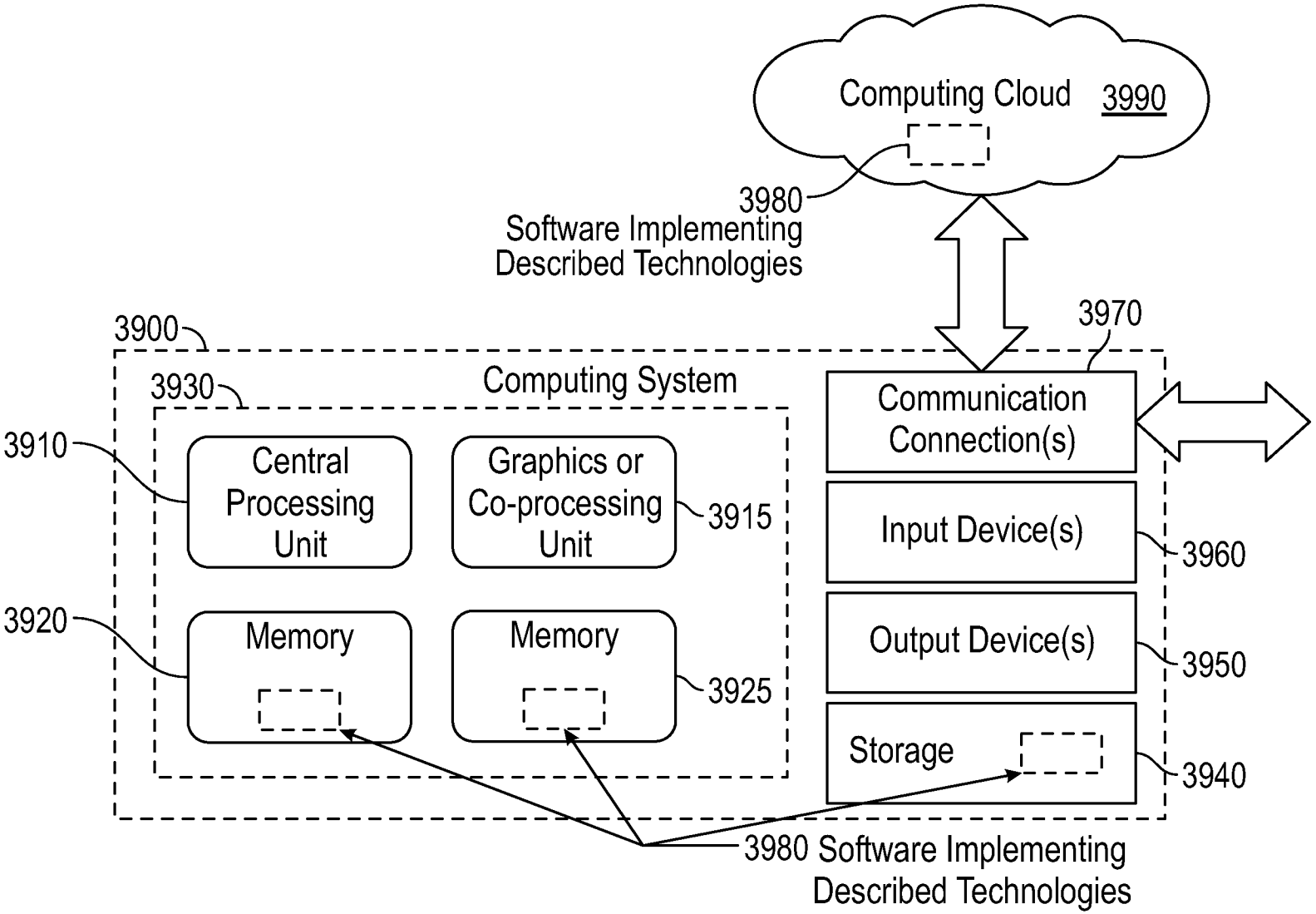
FIG. 45 depicts an exemplary computing system for implementing the disclosed technology.

FIG. 45 depicts a generalized example of a suitable computing system 3900 in which the described innovations may be implemented. The computing system 3900 is not intended to suggest any limitation as to scope of use or functionality, as the innovations may be implemented in diverse general-purpose or special-purpose computing systems. For example, the computing system 3900 can be used to implement hardware and software.

With reference to FIG. 45, the computing system 3900 includes one or more processing units 3910, 3915, non-volatile memory 3920, and memory 3925. In FIG. 45, this computing configuration 3930 is included within a dashed line. The processing units 3910, 3915 execute computer-executable instructions, including instructions for generating shape models, locating fiducials in images, and/or aligning an output device with an article as disclosed herein. A processing unit can be a general-purpose central processing unit ("CPU"), processor in an application-specific integrated circuit ("ASIC"), or any other type of processor. In a multi-processing system, multiple processing units execute computer-executable instructions to increase processing power. For example, FIG. 45 shows a central processing unit 3910 as well as a graphics processing unit ("GPU") or co-processing unit 3915. The tangible memory 3925 may be volatile memory (e.g., registers, cache, RAM), non-volatile memory (e.g., ROM, EEPROM, flash memory, etc.), or some combination of the two, accessible by the processing unit(s). The memory 3925 stores software 3980 implementing one or more innovations described herein, in the form of computer-executable instructions suitable for execution by the processing unit(s).

A computing system may have additional features. For example, the computing system 3900 includes storage 3940, one or more input devices 3950, one or more output devices 3960, and one or more communication connections 3970. An interconnection mechanism (not shown) such as a bus, controller, or network interconnects the components of the computing system 3900. Typically, operating system software (not shown) provides an operating environment for other software executing in the computing system 3900, and coordinates activities of the components of the computing system 3900.

The tangible storage 3940 may be removable or non-removable, and includes magnetic disks, magnetic tapes or cassettes, CD-ROMs, DVDs, or any other medium which can be used to store information, and which can be accessed within the computing system 3900. The storage 3940 stores instructions for the software 3980 implementing one or more innovations described herein.

The input device(s) 3950 may be a touch input device such as a keyboard, mouse, pen, or trackball, a voice input device, a scanning device, microphone, button, pedal, or another device that provides input to the computing system 3900. For video encoding, the input device(s) 3950 may be a camera with an image sensor, video card, TV tuner card, or similar device that accepts video input in analog or digital form, or a CD-ROM, CD-RW, DVD, or Blu-Ray that reads video samples into the computing system 3900. The output device(s) 3960 may be a display, printer, speaker, CD-writer, or another device that provides output from the computing system 3900.

The communication connection(s) 3970 enable communication over a communication medium (e.g., a connecting network) to another computing entity. The communication medium conveys information such as computer-executable instructions, compressed graphics information, video, or other data in a modulated data signal. The communication connection(s) 1170 are not limited to wired connections (e.g., megabit or gigabit Ethernet, Infiniband, Fibre Channel over electrical or fiber optic connections) but also include wireless technologies (e.g., RF connections via Bluetooth, WiFi (IEEE 802.11a/b/n), WiMax, cellular, satellite, laser, infrared) and other suitable communication connections for providing a network connection for the disclosed agents, bridges, and agent data consumers. In a virtual host environment, the communication(s) connections can be a virtualized network connection provided by the virtual host.

Some embodiments of the disclosed methods can be performed using computer-executable instructions implementing all or a portion of the disclosed technology in a computing cloud 3990. For example, disclosed computer-readable instructions can be executed by processors located in the computing configuration 3930, or the disclosed computer-readable instructions can be executed on servers located in the computing cloud 3990.

Computer-readable media are any available media that can be accessed within a computing system 3900. By way of example, and not limitation, with the computing system 3900, computer-readable media include memory 3920 and/or storage 3940. As should be readily understood, the term computer-readable storage media includes the media for data storage such as memory 3920 and storage 3940 but does not include transmission media such as modulated data signals or other transitory signals.

The innovations can be described in the general context of computer-executable instructions, such as those included in program modules, being executed in a computing system on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing system.

In some embodiments, the computing system 3830 and/or the programmable logic controller 3832 can be configured with components and/or functionality of computing system 3900.

Figure 46:
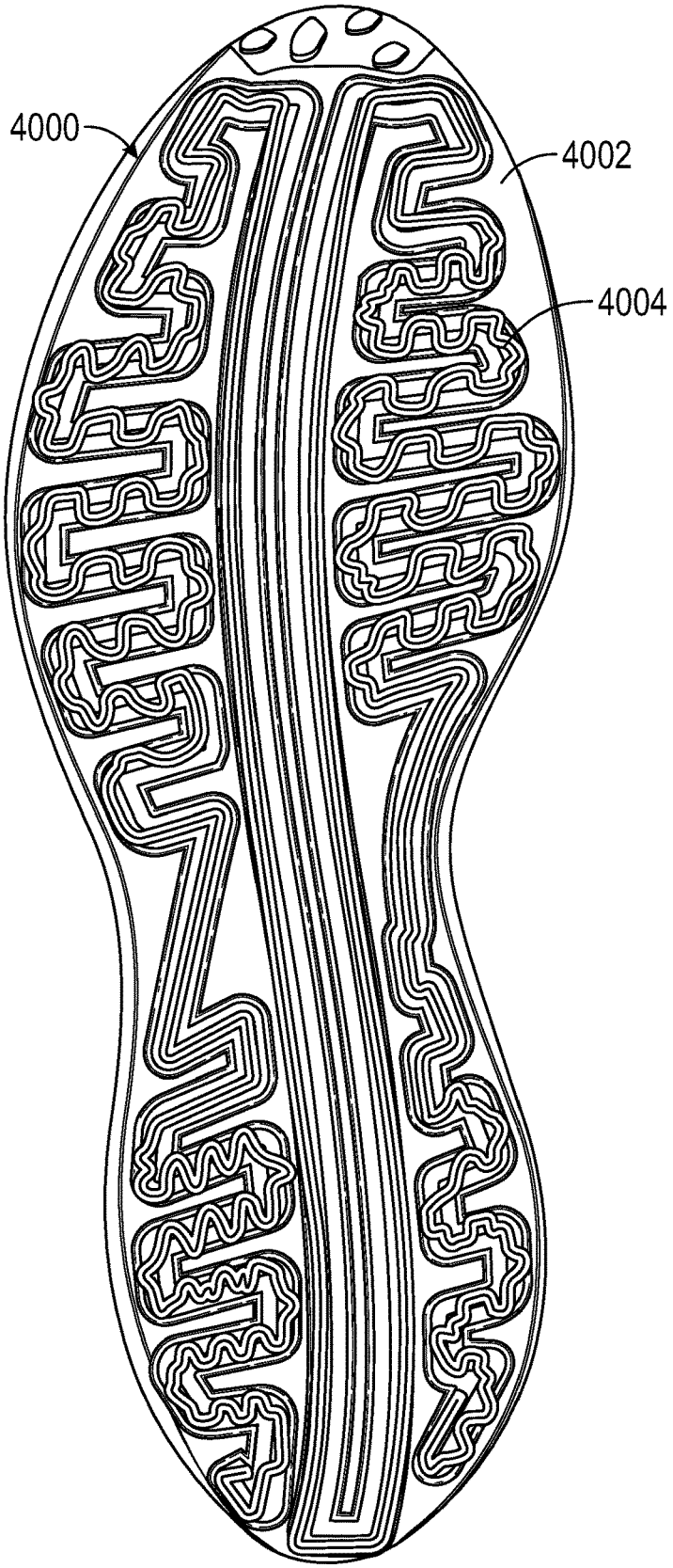
FIG. 46 depicts a bottom plan view of a sole structure for an article of footwear, according to another example.

FIG. 46 depicts a sole structure 4000, according to another example. The sole structure 4000 comprises a midsole 4002 and an outsole 4004 directly coupled to the midsole 4002.

The outsole 4004 comprises a plurality of layers. The layers of the outsole 4004 comprise a plurality of substantially straight portions and a plurality of serpentine portions. The substantially straight portions extend from the heel region to the toe region and are disposed toward the middle of the outsole in the medial-lateral direction. The serpentine portions are disposed lateral or medial relative to the substantially straight portions.

Further examples of the disclosed subject matter are provided below.

Example 1. An article of footwear comprising a sole structure configured to support a wearer's foot and including a midsole and an outsole. The outsole comprises a base layer and an outermost layer. The base layer comprises a first printed material, and the first printed material includes a deposition directly in contact with the midsole and includes a first width. The outermost layer comprises a second printed material deposited onto the base layer and includes a second width, and the second width is less than the first width.

Example 2. The article of footwear of any example herein, and particularly example 1, wherein the outsole comprises an intermediate layer disposed between the base layer and the outermost layer, wherein the intermediate layer comprises a third printed material and includes a third width.

Example 3. The article of footwear of any example herein, and particularly example 2, wherein the intermediate layer is a deposition directly in contact with the base layer.

Example 4. The article of footwear of any example herein, and particularly either example 2 or example 3, wherein the outermost layer is a deposition directly in contact with the intermediate layer.

Example 5. The article of footwear of any example herein, and particularly any one of examples 2-4, wherein the second width of the outermost layer is less than the third width of the intermediate layer.

Example 6. The article of footwear of any example herein, and particularly any one of examples 2-4, wherein the second width of the outermost layer is greater than the third width of the intermediate layer.

Example 7. The article of footwear of any example herein, and particularly any one of examples 2-4, wherein the third width of the intermediate layer is less than the first width of the base layer.

Example 8. The article of footwear of any example herein, and particularly any one of examples 2-4, wherein the third width of the intermediate layer is greater than the first width of the base layer.

Example 9. The article of footwear of any example herein, and particularly any one of examples 1-8, wherein the first width of the base layer is within a range of 0.5-20 mm.

Example 10. The article of footwear of any example herein, and particularly any one of examples 1-8, wherein the first width of the base layer is within a range of 7-11 mm.

Example 11. The article of footwear of any example herein, and particularly any one of examples 1-8, wherein the first width of the base layer is within a range of 3-6 mm.

Example 12. The article of footwear of any example herein, and particularly any one of examples 1-11, wherein the second width of the outermost layer is within a range of 0.25-20 mm.

Example 13. The article of footwear of any example herein, and particularly any one of examples 1-11, wherein the second width of the outermost layer is within a range of 0.75-5 mm.

Example 14. The article of footwear of any example herein, and particularly any one of examples 1-11, wherein the second width of the outermost layer is within a range of 1-3 mm.

Example 15. The article of footwear of any example herein, and particularly any one of examples 1-14, wherein the first width of the base layer is defined by a single deposition of the first printed material.

Example 16. The article of footwear of any example herein, and particularly any one of examples 1-14, wherein the first width of the base layer is a collective width defined by a plurality of depositions of the first printed material that are in direct contact with each other.

Example 17. The article of footwear of any example herein, and particularly any one of examples 1-16, wherein the second width of the outermost layer is defined by a single deposition of the second printed material.

Example 18. The article of footwear of any example herein, and particularly any one of examples 1-16, wherein the second width of the outermost layer is a collective width defined by a plurality of depositions of the second printed material that are in direct contact with each other.

Example 19. The article of footwear of any example herein, and particularly any one of examples 1-18, wherein the base layer includes a first height, wherein the outermost layer includes a second height, wherein the outsole includes a total height, and wherein the first height is greater than the second height.

Example 20. The article of footwear of any example herein, and particularly any one of examples 1-18, wherein the base layer includes a first height, wherein the outermost layer includes a second height, wherein the outsole includes a total height, and wherein the first height is less than the second height.

Example 21. The article of footwear of any example herein, and particularly any one of examples 1-20, wherein the outsole comprises a total height defined at least in part by a first height of the base layer and a second height of the outermost layer, wherein the total height is uniform across the outsole.

Example 22. The article of footwear of any example herein, and particularly any one of examples 1-20, wherein the outsole comprises a total height defined at least in part by a first height of the base layer and a second height of the outermost layer, wherein the total height varies across the outsole such that the outsole includes a first total height at a first location of the outsole and a second total height a second location of the outsole, and wherein the first total height is greater than the second total height.

Example 23. The article of footwear of any example herein, and particularly example 22, wherein the first location comprises a heel region of the article of footwear, and wherein the second location comprises a toe region of the article of footwear.

Example 24. The article of footwear of any example herein, and particularly example 22, wherein the first location comprises a toe region of the article of footwear, and wherein the second location comprises a heel region of the article of footwear.

Example 25. The article of footwear of any example herein, and particularly any one of examples 21-24, wherein the first height of the base layer is greater than the second height of the outermost layer.

Example 26. The article of footwear of any example herein, and particularly any one of examples 21-24, wherein the first height of the base layer is less than the second height of the outermost layer.

Example 27. The article of footwear of any example herein, and particularly any one of examples 19-26, wherein the total height is within a range of 0.25-30 mm.

Example 28. The article of footwear of any example herein, and particularly any one of examples 19-26, wherein the total height is within a range of 1-3 mm.

Example 29. The article of footwear of any example herein, and particularly any one of examples 1-28, wherein the first printed material of the base layer exhibits a first hardness, and wherein the second printed material of the outermost layer exhibits a second hardness, the second hardness being less than the first hardness.

Example 30. The article of footwear of any example herein, and particularly any one of examples 1-28, wherein the first printed material of the base layer exhibits a first hardness, and wherein the second printed material of the outermost layer exhibits a second hardness, the second hardness being greater than the first hardness.

Example 31. The article of footwear of any example herein, and particularly any one of examples 1-30, wherein the first printed material, the second printed material, or both the first printed material and the second printed material are thermoset materials.

Example 32. The article of footwear of any example herein, and particularly any one of examples 1-31, wherein the first printed material is a first printed thermoplastic comprising one or more first thermoplastics.

Example 33. The article of footwear of any example herein, and particularly any one of examples 1-32, wherein the second printed material is a second printed thermoplastic comprising one or more second thermoplastics.

Example 34. The article of footwear of any example herein, and particularly either example 32 or example 33, wherein the one or more thermoplastics include a thermoplastic polyurethane.

Example 35. The article of footwear of any example herein, and particularly any one of examples 1-34, further comprising an upper coupled to the sole structure, wherein the upper and the sole structure define a foot-receiving cavity therebetween.

Example 36. An article of footwear comprising a sole structure configured for supporting a wearer's foot and including a midsole and an outsole. The outsole comprises a base layer and an outermost layer. The base layer comprises a first printed material deposited directly onto the midsole and includes a first width. The outermost layer comprises a second printed material deposited onto the base layer and includes a second width, which is greater than the first width.

Example 37. The article of footwear of any example herein, and particularly example 36, wherein the outsole comprises an intermediate layer disposed between the base layer and the outermost layer, wherein the intermediate layer comprises a third printed material and includes a third width.

Example 38. The article of footwear of any example herein, and particularly example 37, wherein the intermediate layer is deposited directly onto the base layer.

Example 39. The article of footwear of any example herein, and particularly either example 37 or example 38, wherein the outermost layer is deposited directly onto the intermediate layer.

Example 40. The article of footwear of any example herein, and particularly any one of examples 37-39, wherein the second width of the outermost layer is less than the third width of the intermediate layer.

Example 41. The article of footwear of any example herein, and particularly any one of examples 37-39, wherein the second width of the outermost layer is greater than the third width of the intermediate layer.

Example 42. The article of footwear of any example herein, and particularly any one of examples 37-39, wherein the third width of the intermediate layer is less than the first width of the base layer.

Example 43. The article of footwear of any example herein, and particularly any one of examples 37-39, wherein the third width of the intermediate layer is greater than the first width of the base layer.

Example 44. The article of footwear of any example herein, and particularly any one of examples 36-43, wherein the first width of the base layer is within a range of 0.5-20 mm.

Example 45. The article of footwear of any example herein, and particularly any one of examples 36-43, wherein the first width of the base layer is within a range of 7-11 mm.

Example 46. The article of footwear of any example herein, and particularly any one of examples 36-43, wherein the first width of the base layer is within a range of 3-6 mm.

Example 47. The article of footwear of any example herein, and particularly any one of examples 36-46, wherein the second width of the outermost layer is within a range of 0.25-20 mm.

Example 48. The article of footwear of any example herein, and particularly any one of examples 36-46, wherein the second width of the outermost layer is within a range of 0.75-5 mm.

Example 49. The article of footwear of any example herein, and particularly any one of examples 36-46, wherein the second width of the outermost layer is within a range of 1-3 mm.

Example 50. The article of footwear of any example herein, and particularly any one of examples 36-49, wherein the first width of the base layer is defined by a single deposition of the first printed material.

Example 51. The article of footwear of any example herein, and particularly any one of examples 36-49, wherein the first width of the base layer is a collective width defined by a plurality of depositions of the first printed material that are in direct contact with each other.

Example 52. The article of footwear of any example herein, and particularly any one of examples 36-51, wherein the second width of the outermost layer is defined by a single deposition of the second printed material.

Example 53. The article of footwear of any example herein, and particularly any one of examples 36-51, wherein the second width of the outermost layer is a collective width defined by a plurality of depositions of the second printed material that are in direct contact with each other.

Example 54. The article of footwear of any example herein, and particularly any one of examples 36-53, wherein the base layer includes a first height, wherein the outermost layer includes a second height, wherein the outsole includes a total height, and wherein the first height is greater than the second height.

Example 55. The article of footwear of any example herein, and particularly any one of examples 36-53, wherein the base layer includes a first height, wherein the outermost layer includes a second height, wherein the outsole includes a total height, and wherein the first height is less than the second height.

Example 56. The article of footwear of any example herein, and particularly any one of examples 36-55, wherein the outsole comprises a total height defined at least in part by a first height of the base layer and a second height of the outermost layer, wherein the total height is uniform across the outsole.

Example 57. The article of footwear of any example herein, and particularly any one of examples 36-55, wherein the outsole comprises a total height defined at least in part by a first height of the base layer and a second height of the outermost layer, wherein the total height varies across the outsole such that the outsole includes a first total height at a first location of the outsole and a second total height a second location of the outsole, and wherein the first total height is greater than the second total height.

Example 58. The article of footwear of any example herein, and particularly example 57, wherein the first location comprises a heel region of the article of footwear, and wherein the second location comprises a toe region of the article of footwear.

Example 59. The article of footwear of any example herein, and particularly example 57, wherein the first location comprises a toe region of the article of footwear, and wherein the second location comprises a heel region of the article of footwear.

Example 60. The article of footwear of any example herein, and particularly any one of examples 56-59, wherein the first height of the base layer is greater than the second height of the outermost layer.

Example 61. The article of footwear of any example herein, and particularly any one of examples 56-59, wherein the first height of the base layer is less than the second height of the outermost layer.

Example 62. The article of footwear of any example herein, and particularly any one of examples 54-61, wherein the total height is within a range of 0.25-30 mm.

Example 63. The article of footwear of any example herein, and particularly any one of examples 54-61, wherein the total height is within a range of 1-3 mm.

Example 64. The article of footwear of any example herein, and particularly any one of examples 36-63, wherein the first printed material of the base layer comprises a first hardness, and wherein the second printed material of the outermost layer comprises a second hardness, the second hardness being less than the first hardness.

Example 65. The article of footwear of any example herein, and particularly any one of examples 36-63, wherein the first printed material of the base layer comprises a first hardness, and wherein the second printed material of the outermost layer comprises a second hardness, the second hardness being greater than the first hardness.

Example 66. The article of footwear of any example herein, and particularly any one of examples 36-65, wherein the first printed material comprises one or more printable thermoplastic materials.

Example 67. The article of footwear of any example herein, and particularly any one of examples 36-66, wherein the second printed material comprises one or more printable thermoplastic materials.

Example 68. The article of footwear of any example herein, and particularly any one of examples 36-67, further comprising an upper coupled to the sole structure, wherein the upper and the sole structure define a foot-receiving cavity therebetween.

Example 69. An article of footwear comprising a sole structure configured for supporting a wearer's foot and including a midsole and an outsole. The outsole comprises a plurality of layers of print material, and one or more of the plurality of layers of print material includes at least one segment that is deposited directly onto the midsole. The plurality of layers of print material form one or more reverse tapered shapes.

Example 70. An article of footwear comprising a sole structure configured for supporting a wearer's foot and including a midsole and an outsole. The outsole comprises a plurality of layers of print material, and one or more of the plurality of layers of print material includes at least one segment that is deposited directly onto the midsole. The plurality of layers of print material form one or more interior segments and one or more barrier segments. The one or more barrier segments circumscribe at least a portion of the one or more interior segments.

Example 71. The article of footwear of any example herein, and particularly example 70, wherein at least one of the one or more barrier segments defines at least a portion of a peripheral edge of the outsole.

Example 72. The article of footwear of any example herein, and particularly either example 70 or 71, wherein the one or more barrier segments are spaced apart from at least one or more of the one or more interior segments.

Example 73. The article of footwear of any example herein, and particularly any one of examples 70-72, wherein the one or more barrier segments directly contact at least one or more of the one or more interior segments.

Example 74. The article of footwear of any example herein, and particularly any one of examples 70-73, wherein the one or more barrier segments circumscribe all of the one or more interior segments.

Example 75. The article of footwear of any example herein, and particularly any one of examples 70-74, wherein the one or more barrier segments is a continuous structure.

Example 76. The article of footwear of any example herein, and particularly any one of examples 70-74, wherein the one or more barrier segments comprises a plurality of individual sections.

Example 77. The article of footwear of any example herein, and particularly example 76, wherein the plurality of individual sections is contiguous.

Example 78. A sole structure for an article of footwear comprising a midsole and an outsole. The outsole comprising one or more layers, and the one or more layers comprise printed material deposited directly onto the midsole.

Example 79. An article of footwear comprising the sole structure of any example herein, and particularly example 78.

Example 80. A method of manufacturing a sole structure for an article of footwear comprising depositing a base layer of print material directly onto a midsole and depositing an outermost layer of print material onto the base layer of print material. The base layer of print material comprises a first width, and the outermost layer of print material comprises a second width, which is less than the first width.

Example 81. The method of any example herein, and particularly example 80, wherein depositing the base layer of print material directly onto the midsole is performed with a printing device.

Example 82. The method of any example herein, and particularly either example 80 or example 81, wherein depositing the outermost layer of print material directly onto the midsole is performed with a printing device.

Example 83. The method of any example herein, and particularly either example 81 or example 82, wherein the printing device is a three-dimensional printing device.

Example 84. The method of any example herein, and particularly either example 81 or example 82, wherein the printing device is a screen-printing device.

Example 85. The method of any example herein, and particularly any one of examples 80-84, wherein the base layer of printed material and the outermost layer of printed material comprise a thermoplastic material.

Example 86. The method of any example herein, and particularly any one of examples 80-85, wherein the midsole comprises a foam material.

Example 87. The method of any example herein, and particularly any one of examples 80-86, wherein prior to depositing the base layer of print material directly onto the midsole, the method further comprises applying a cleaning agent to the midsole.

Example 88. The method of any example herein, and particularly any one of examples 80-87, wherein prior to depositing the base layer of print material directly onto the midsole, the method further comprises applying a priming agent to the midsole.

Example 89. A method of manufacturing a sole structure for an article of footwear comprising printing a base layer of an outsole directly onto a midsole and printing an outermost layer of the outsole onto the base layer of the outsole. The base layer comprises a first width, and the outermost layer comprises a second width, which is different than the first width.

Example 90. The method of any example herein, and particularly example 89, wherein the acts of printing including printing via one or more three-dimensional printing devices.

Example 91. The method of any example herein, and particularly either example 89 or example 90, wherein the acts of printing including printing via one or more screen-printing devices.

Example 92. The method of any example herein, and particularly any one of examples 89-91, wherein the base layer and the outermost layer comprise one or more thermoplastic materials.

Example 93. The method of any example herein, and particularly any one of examples 89-92, wherein the midsole comprises a foam material.

Example 94. The method of any example herein, and particularly any one of examples 89-93, wherein the base layer or the outermost layer forms a portion of a tapered shape.

Example 95. The method of any example herein, and particularly any one of examples 89-93, wherein the base layer and the outermost layer form a portion of a tapered shape.

Example 96. The method of any example herein, and particularly any one of examples 89-93, wherein the base layer or the outermost layer form a portion of a reverse tapered shape.

Example 97. The method of any example herein, and particularly any one of examples 89-93, wherein the base layer and the outermost layer form a portion of a reverse tapered shape.

Example 98. The method of any example herein, and particularly any one of examples 89-97, wherein prior to depositing the base layer of print material directly onto the midsole, the method further comprises applying a cleaning agent to the midsole.

Example 99. The method of any example herein, and particularly any one of examples 89-98, wherein prior to depositing the base layer of print material directly onto the midsole, the method further comprises applying a priming agent to the midsole.

Example 100. A sole structure for an article of footwear comprising a midsole and an outsole. One or more segments of the outsole are printed directly onto the midsole. The one or more segments include a first laterally-extending segment having a first width and a second laterally-extending segment having a second width. The first laterally-extending segment and the second laterally-extending segment are disposed adjacent to each other and spaced apart from each other by a distance that is greater than the first width and the second width.

Example 101. The sole structure of any example herein, and particularly example 100, wherein the distance by which the first laterally-extending segment and the second laterally-extending segment are spaced apart is greater than a combined width comprising the first width and the second width.

Example 102. A sole structure for an article of footwear comprising a midsole and an outsole. One or more segments of the outsole are printed directly onto the midsole. The one or more segments include a first laterally-extending segment having a first width, a second laterally-extending segment having a second width, and a longitudinally-extending segment extending from the first laterally-extending segment to the second laterally-extending segment and having a first length. The first length is greater than the first width and the second width.

Example 103. The sole structure of any example herein, and particularly example 102, wherein the first length is greater than the first width and the second width combined.

Example 104. A sole structure for an article of footwear, comprising a midsole and an outsole. One or more segments of the outsole are printed directly onto the midsole. The one or more segments include a first laterally-extending segment, a second laterally-extending segment, and a longitudinally-extending segment extending from the first laterally-extending segment to the second laterally-extending segment. A first intersection between the first laterally-extending segment and the longitudinally-extending segment forms a first angle. A second intersection between the second laterally-extending segment and the longitudinally-extending segment forms a second angle. The first angle or the second angle is within a range of 85-120 degrees.

Example 105. The sole structure of any example herein, and particularly example 104, wherein the first angle and the second angle within a range of 85-120 degrees.

Example 106. A sole structure of an article of footwear, the sole structure comprising a midsole and a first contiguous trace path. The midsole having a top surface configured to face inwardly toward a foot-receiving void of the article of footwear and an opposing bottom surface configured to face outwardly away from the foot-receiving void of the article of footwear. The first contiguous trace path disposed on the bottom surface of the midsole, the trace path extending from a first terminal end to a second terminal end of the trace path, and the trace path comprises at least a first layer of a printed material bonded with the bottom surface of the midsole.

Example 107. The sole structure of any example herein, and particularly example 106, wherein the continuous trace path extends from proximate an anterior end of the midsole to proximate a posterior end of the midsole.

Example 108. The sole structure of any example herein, and particularly any one of examples 106-107, wherein the continuous trace path extends from proximate a medial edge of the midsole to proximate a lateral edge of the midsole.

Example 109. The sole structure of any example herein, and particularly any one of examples 106-108, wherein the continuous trace path comprises plural layers, each layer of the plural layers extending at least a portion of a total length of the trace path from the first terminal end to the second terminal end.

Example 110. The sole structure of any example herein, and particularly any one of examples 106-109, wherein each layer of the plural layers extends contiguously from the first terminal end to the second terminal end.

Example 111. The sole structure of any example herein, and particularly any one of examples 106-110, wherein the contiguous trace path includes one or more trace path segments extending longitudinally in a medial-lateral direction of the midsole.

Example 112. The sole structure of any example herein, and particularly any one of examples 106-111, wherein the contiguous trace path includes one or more trace path segments extending longitudinally in an anterior-posterior direction of the midsole.

Example 113. The sole structure of any example herein, and particularly any one of examples 106-112, wherein the contiguous trace path includes one or more trace path segments extending longitudinally in an anterior-posterior direction of the midsole and one or more trace path segments extending longitudinally in an anterior-posterior direction of the midsole.

Example 114. The sole structure of any example herein, and particularly any one of examples 106-113, wherein one of the first terminal end or the second terminal end of the trace path is disposed at an anterior end of the midsole, and the other of the first terminal end or the second terminal end of the trace path is disposed at a posterior end of the midsole.

Example 115. The sole structure of any example herein, and particularly any one of examples 106-113, wherein the trace path comprises one or more peripheral trace segments disposed adjacent to and extending in parallel with a peripheral edge of the midsole.

Example 116. The sole structure any example herein, and particularly of example 115, wherein a length of the one or more peripheral trace segments is greater than its width.

Example 117. The sole structure of any example herein, and particularly example 116, wherein the one or more peripheral trace segments include an anterior end and a posterior end, and wherein a first trace segment extends contiguously from one of the anterior end or the posterior end of the one or more peripheral trace segments and inwardly toward a longitudinal midline of the midsole from one of the anterior end or the posterior end.

Example 118. The sole structure of any example herein, and particularly example 117, further comprising a second trace segment extending contiguously from the other of the anterior end or the posterior end of the one or more peripheral trace segments and inwardly toward a longitudinal midline of the midsole from the other of the anterior end or the posterior end.

Example 119. The sole structure of any example herein, and particularly any one of examples 106-118, wherein the trace path comprises plural layers of sequentially deposited printed materials.

Example 120. The sole structure of any example herein, and particularly example 119, wherein the trace path comprises three or more layers of sequentially deposited printed materials.

Example 121. The sole structure of any example herein, and particularly example 119, wherein the trace path comprises four or more layers of sequentially deposited printed materials.

Example 122. The sole structure of any example herein, and particularly any one of examples 106-121, wherein the trace path comprises two or more printed materials, wherein at least one of the printed materials is different from another of the printed materials in at least one of color, elasticity, hardness, sheen, or deposition temperature.

Example 123. The sole structure of any example herein, and particularly example 119, wherein at least a second layer of the plural layers has a narrower width than a first layer of the plural layers.

Example 124. The sole structure of any example herein, and particularly example 121, wherein at least a portion of the first layer is disposed between the bottom surface of the midsole and the second layer.

Example 125. The sole structure of any example herein, and particularly any one of examples 106-124, wherein at least a portion of the trace path along a total length of the trace path varies in thickness relative to at least another portion of the trace path along the total length of the trace path.

Example 126. The sole structure of any example herein, and particularly any one of examples 106-124, wherein across a width of the trace path in at least a portion of the trace path, a thickness of the printed material is less at a center of the trace path than at a first edge and a second edge of the trace path, comprising a substantially concave ground-facing surface profile in cross-section of the trace path.

Example 127. The sole structure of any example herein, and particularly any one of examples 106-126, wherein at least a portion of the first contiguous trace path comprises a serpentine pattern.

Example 128. The sole structure of any example herein, and particularly example 127, wherein a length of each successive segment of the serpentine pattern increases as the serpentine pattern extends from a more anterior portion of the sole structure toward a more posterior portion of the sole structure.

Example 129. The sole structure of any example herein, and particularly any one of examples 127-128, wherein plural successive segments of the serpentine pattern each has a longitudinal axis extending generally in a medial-lateral direction relative to the sole structure.

Example 130. The sole structure of any example herein, and particularly any one of examples 127-129, wherein plural successive segments of the serpentine pattern each has a longitudinal axis extending diagonally from an anterior medial portion of the sole structure toward a more posterior lateral portion of the sole structure.

Example 131. The sole structure of any example herein, and particularly any one of examples 127-129, wherein plural successive segments of the serpentine pattern each has a longitudinal axis extending diagonally from an anterior lateral portion of the sole structure toward a more posterior medial portion of the sole structure.

Example 132. The sole structure of any example herein, and particularly example 127, wherein plural adjacent segments of the trace path each have a long axis and opposing edges disposed on either side of the long axis, and wherein the plural adjacent segments are in contact with one another along at least a portion of their respective edges.

Example 133. The sole structure of any example herein, and particularly any one of examples 106-132, wherein the trace path extends fully to a peripheral edge of the midsole in at least a first portion of the midsole.

Example 134. The sole structure of any example herein, and particularly any one of examples 106-132, wherein the trace path does not extend fully to a peripheral edge of the midsole.

Example 135. The sole structure of any example herein, and particularly any one of examples 106-134, wherein a gap between any portion of the trace path and any portion of a peripheral edge of the midsole is equal to or greater than a cross-sectional width of the printed material along any portion of the trace path.

Example 136. The sole structure of any example herein, and particularly any one of examples 106-135, further comprising at least a second contiguous trace path disposed on the ground facing surface of the midsole.

Example 137. The sole structure of any example herein, and particularly example 136, wherein the at least second contiguous trace path comprises a first terminal end and a second terminal end of the second contiguous trace path.

Example 138. The sole structure of any example herein, and particularly any one of examples 136-137, further comprising at least a third contiguous trace path disposed on the ground facing surface of the midsole.

Example 139. The sole structure of any example herein, and particularly example 138, wherein the at least third contiguous trace path comprises a first terminal end and a second terminal end of the third contiguous trace path.

Example 140. The sole structure of any example herein, and particularly any one of examples 136-137, wherein the sole structure comprises a longitudinal midline extending from an anterior-most extent of the midsole to the posterior-most extent of the midsole, and wherein a majority of a total length of the first contiguous trace path is disposed on a medial side of the longitudinal midline.

Example 141. The sole structure of any example herein, and particularly example 140, wherein a majority of a total length of the second contiguous trace path is disposed on a lateral side of the longitudinal midline.

Example 142. The sole structure of any example herein, and particularly any one of examples 136-141, wherein at least a portion of the second contiguous trace path comprises a serpentine pattern.

Example 143. The sole structure of any example herein, and particularly any one of examples 138-139, further comprising four or more contiguous trace paths each having a respective first terminal end and a respective second terminal end.

Example 144. The sole structure of any example herein, and particularly any one of examples 136-137, wherein a majority of a total length of the first contiguous trace path is disposed more closely to an anterior end of the midsole than is a majority of a total length of the second contiguous trace path.

Example 145. The sole structure of any example herein, and particularly any one of example 140-141, wherein at least one of the first contiguous trace path and the second contiguous trace path extends from a forefoot portion of the sole structure disposed anteriorly relative to the concave medial midfoot arch to a heel portion of the sole structure disposed posteriorly relative to the concave medial midfoot arch.

Example 146. The sole structure of any example herein, and particularly any one of examples 136-145, wherein the first contiguous trace path and the second contiguous trace path intersect at an orthogonal angle at one or more locations along a respective total length of the first contiguous trace path and the second contiguous trace path.

Example 147. The sole structure of any example herein, and particularly any one of examples 136-145, wherein the first contiguous trace path and the second contiguous trace path intersect at an oblique angle at one or more locations along a respective total length of the first contiguous trace path and the second contiguous trace path.

Example 148. The sole structure of any example herein, and particularly any one of examples 106-145, wherein the first contiguous trace path intersects itself at an orthogonal angle.

Example 149. The sole structure of any example herein, and particularly any one of examples 106-145, wherein the first contiguous trace path intersects itself at an oblique angle.

Example 150. The sole structure of any example herein, and particularly example 106, wherein at least a portion of the first contiguous trace path extends around at least a majority of a periphery of the midsole proximate a peripheral edge of the midsole.

Example 151. The sole structure of any example herein, and particularly any one of examples 106-150, wherein the midsole comprises a foam material.

Example 152. The sole structure of any example herein, and particularly example 151, wherein the foam material comprises one or more of include polyurethane (PU) foam, ethylene-vinyl acetate (EVA) foam, polyether block amide (PEBA) foam, or copolyester foam.

Example 153. The sole structure of any example herein, and particularly any one of examples 1-152, wherein the first printed material, the second printed material, or both the first printed material and the second printed material comprise one or more of a polyurethane, a polyurea, a polyester, a polyether, a polyamide, a polyimide, a polyolefin, a polystyrene, a polysiloxane, a polycarbonate, a polyacetate, a polylactide, or a vinyl polymer.

Any feature(s) of any example(s) disclosed herein can be combined with or isolated from any feature(s) of any example(s) disclosed herein, unless otherwise stated.

In view of the many possible examples to which the principles of the disclosure may be applied, it should be recognized that the illustrated examples should not be taken as limiting the scope of the claims. Rather, the scope of the claimed subject matter is defined by the following claims and their equivalents.

The invention claimed is:

1. An article of footwear comprising:

an upper and a sole structure directly coupled to the upper around a lower periphery of the upper and configured to support a wearer's foot, wherein the sole structure comprises a midsole directly coupled to the upper around the entire lower periphery of the upper and an outsole, and wherein:

the outsole comprises a base layer, an outermost layer, and an intermediate layer disposed between the base layer and the outermost layer;

the base layer comprises a first printed material arranged in a contiguous trace path comprising a plurality of substantially straight portions and a plurality of serpentine portions directly connected to the plurality of substantially straight portions, wherein the contiguous trace path extends a length from a first terminal end to a second terminal end, and wherein the first printed material includes a deposition directly in contact with the midsole and includes a first width;

the outermost layer comprises a second printed material arranged along and aligned with the contiguous trace path substantially from the first terminal end to the second terminal end, wherein the second printed material is deposited onto the base layer and includes a second width, the second width being less than the first width; and the intermediate layer comprises a third printed material and includes a third width that is less than the first width of the base layer, wherein each substantially straight portion of the plurality of substantially straight portions extends from a heel region of the article of footwear to a forefoot region of the article of footwear, and is disposed along a middle portion of the outsole relative to a medial-lateral direction.

2. The article of footwear of claim 1, wherein the intermediate layer is a deposition directly in contact with the base layer.

3. The article of footwear of claim 1, wherein the outermost layer is a deposition directly in contact with the intermediate layer.

4. The article of footwear of claim 1, wherein the second width of the outermost layer is less than the third width of the intermediate layer.

5. The article of footwear of claim 1, wherein a first subset of the plurality of serpentine portions is disposed lateral relative to the plurality of substantially straight portions and a second subset of the plurality of serpentine portions is disposed medial relative to the plurality of substantially straight portions.

6. The article of footwear of claim 1, wherein the second width is less than the first width along the length of the contiguous trace path.

7. The article of footwear of claim 1, wherein the first width of the first printed material extends from a first edge of the first printed material to a second edge of the first printed material, and wherein the second width of the second printed material is disposed within the first and second edges of the first printed material along the contiguous trace path.

8. The article of footwear of claim 1, wherein each serpentine portion of the plurality of serpentine portions comprises more than one bend.

9. An article of footwear comprising:

an upper and a sole structure directly coupled to the upper around a lower periphery of the upper and configured to support a wearer's foot, wherein the sole structure comprises a midsole directly coupled to the upper around the entire lower periphery of the upper and an outsole, and wherein:

the outsole comprises a base layer, an outermost layer, and an intermediate layer disposed between the base layer and the outermost layer;

the base layer comprises a first printed material arranged in a contiguous trace path comprising a plurality of substantially straight portions and a plurality of serpentine portions directly connected to and disposed in a common layer with the plurality of substantially straight portions, wherein the first printed material includes a deposition directly in contact with the midsole and includes a first width;

the outermost layer comprises a second printed material arranged along and aligned with the contiguous trace path, wherein the second printed material is deposited onto the base layer and includes a second width less than the first width; and the intermediate layer comprises a third printed material and includes a third width that is less than the first width of the base layer, wherein the substantially straight portions of the plurality of substantially straight portions extend from a heel region of the article of footwear to a forefoot region of the article of footwear, and wherein each serpentine portion of the plurality of serpentine portions comprises more than one bend.

10. The article of footwear of claim 9, wherein the plurality of serpentine portions comprises a first serpentine portion and a second serpentine portion, wherein the first serpentine portion is arranged lateral relative to the plurality of substantially straight portions and the second serpentine portion is arranged medial relative to the plurality of substantially straight portions.

11. The article of footwear of claim 9, wherein the intermediate layer is a deposition directly in contact with the base layer.

12. The article of footwear of claim 9, wherein the outermost layer is a deposition directly in contact with the intermediate layer.

13. The article of footwear of claim 9, wherein the second width of the outermost layer is less than the third width of the intermediate layer.

* * * * *